US008851609B2

(12) United States Patent
Saita

(10) Patent No.: US 8,851,609 B2
(45) Date of Patent: Oct. 7, 2014

(54) INKJET RECORDING APPARATUS

(71) Applicant: FUJIFILM Corporation, Tokyo (JP)

(72) Inventor: Hirofumi Saita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/040,251

(22) Filed: Sep. 27, 2013

(65) Prior Publication Data

US 2014/0043386 A1 Feb. 13, 2014

Related U.S. Application Data

(63) Continuation-in-part of application No. PCT/JP2012/057279, filed on Mar. 22, 2012.

(30) Foreign Application Priority Data

Mar. 29, 2011 (JP) ..... 2011-072575

(51) Int. Cl.
*B41J 11/00* (2006.01)

(52) U.S. Cl.
CPC ..... *B41J 11/002* (2013.01); *B41J 11/001* (2013.01)
USPC ..... 347/15; 347/100; 347/102

(58) Field of Classification Search
CPC ..... B41J 2/01; B41J 11/002; B41M 7/0081; B41M 7/0045; B41M 7/009
USPC ..... 347/15, 40, 43, 37, 101–102
See application file for complete search history.

(56) References Cited

U.S. PATENT DOCUMENTS

| | | | | |
|---|---|---|---|---|
| 7,137,696 | B2 * | 11/2006 | Siegel | 347/102 |
| 7,600,867 | B2 | 10/2009 | Mills et al. | |
| 8,123,346 | B2 * | 2/2012 | Ohnishi et al. | 347/102 |
| 8,215,761 | B2 * | 7/2012 | Takezawa et al. | 347/102 |
| 2005/0237352 | A1 | 10/2005 | Yoneyama | |
| 2008/0278560 | A1 | 11/2008 | Niekawa | |
| 2009/0167794 | A1 | 7/2009 | Hosono et al. | |

FOREIGN PATENT DOCUMENTS

| | | | |
|---|---|---|---|
| JP | 2006-073383 | A | 3/2006 |
| JP | 2008-143123 | A | 6/2008 |
| JP | 2009-081083 | A | 4/2009 |
| JP | 2009-160920 | A | 7/2009 |
| WO | 2005/105452 | A1 | 11/2005 |

OTHER PUBLICATIONS

International Search Report; PCT/JP2012/057279; Apr. 24, 2012.

(Continued)

*Primary Examiner* — Thinh Nguyen
(74) *Attorney, Agent, or Firm* — Studebaker & Brackett PC

(57) ABSTRACT

Curing processing is realized according to differences in absorption characteristics of activation light among inks and characteristics of layers to be formed with the inks. A scanning device reciprocally moves in a first direction an inkjet head including a first nozzle array ejecting a first ink and a second nozzle array ejecting a second ink; a relative movement device relatively moves a recording medium in a second direction with respect to the head; an ejection control device divides the nozzle array into regions in the second direction and controls ink ejection for each unit of the divided nozzle region; an activation light irradiation device irradiates the inks deposited on the medium with the activation light; an irradiation region dividing device divides an irradiation range into divided irradiation regions corresponding respectively to the divided nozzle regions; and a light quantity control device controls light quantities respectively for the divided irradiation regions.

15 Claims, 50 Drawing Sheets

(56) References Cited

OTHER PUBLICATIONS

Written Opinion of the International Searching Authority; PCT/JP2012/057279; Apr. 24, 2012.
An Office Action; "Notification of Reasons for Rejection," issued by the Japanese Patent Office on Jun. 20, 2014, which corresponds to Japanese Patent Application No. 2011-072575 and is related to U.S. Appl. No. 14/040,251; with English language partial translation.
The extended European search report issued by the European Patent Office on Jun. 2, 2014, which corresponds to EP12765430.9-1701 and is related to U.S. Appl. No. 14/040,251.

* cited by examiner

W/mm$^2$

Y(mm)

W/mm$^2$

Y(mm)

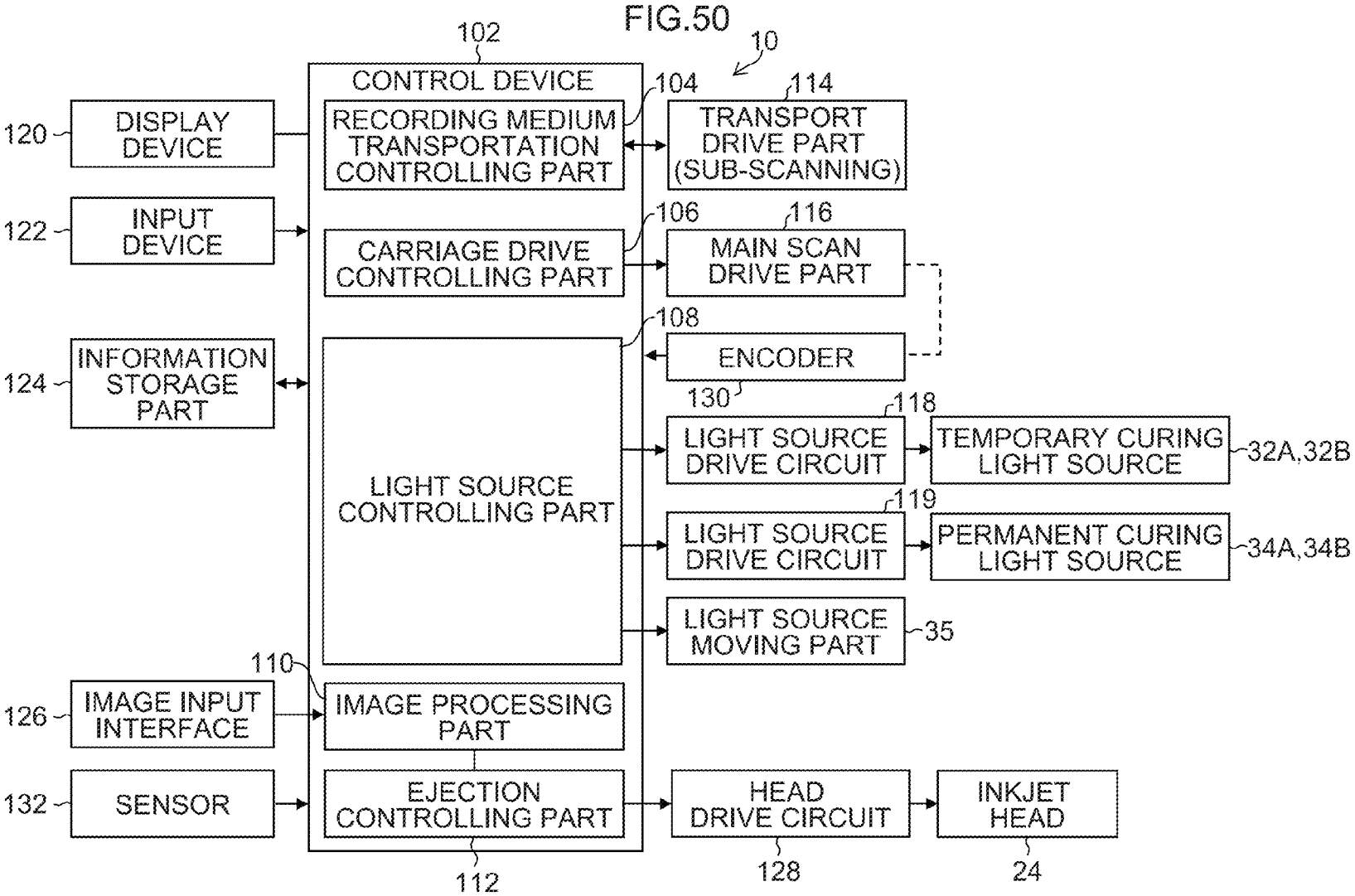
FIG.50
10
CONTROL DEVICE
102
RECORDING MEDIUM TRANSPORTATION CONTROLLING PART
104
CARRIAGE DRIVE CONTROLLING PART
106
LIGHT SOURCE CONTROLLING PART
108
IMAGE PROCESSING PART
110
EJECTION CONTROLLING PART
112
TRANSPORT DRIVE PART (SUB-SCANNING)
114
MAIN SCAN DRIVE PART
116
ENCODER
130
LIGHT SOURCE DRIVE CIRCUIT
118
LIGHT SOURCE DRIVE CIRCUIT
119
LIGHT SOURCE MOVING PART
35
TEMPORARY CURING LIGHT SOURCE
32A,32B
PERMANENT CURING LIGHT SOURCE
34A,34B
HEAD DRIVE CIRCUIT
128
INKJET HEAD
24
DISPLAY DEVICE
120
INPUT DEVICE
122
INFORMATION STORAGE PART
124
IMAGE INPUT INTERFACE
126
SENSOR
132

INKJET RECORDING APPARATUS

TECHNICAL FIELD

The present invention relates to an inkjet recording apparatus and an image forming method, and particularly to an image forming technology in an inkjet system using inks that are cured by irradiation with activation light such as ultraviolet light.

BACKGROUND ART

As an image forming apparatus for general purpose, an inkjet recording apparatus has been known, which ejects color inks from an inkjet head and forms a desired image on a recording medium. In recent years, not only media that have permeability such as paper, but also impermeable (less-permeable) media such as resin film have been used, and an apparatus that cures the inks landed on a medium by irradiating the inks with ultraviolet light as activation light has been proposed. The ultraviolet curable inks that are applied to such an apparatus contain an initiator that has predetermined sensitivity to ultraviolet light.

In the inkjet recording apparatus to which ultraviolet curable inks are applied, a light source for ultraviolet irradiation is mounted on a carriage on which an inkjet head is mounted, the ultraviolet light source is caused to scan to follow the inkjet head, the ink droplets immediately after being landed on the medium are irradiated with ultraviolet light, and positional displacement and landing interference of the ink droplets are avoided.

Patent Literature 1 discloses a print system of an ultraviolet-curable type in which curing light sources disposed at both sides in the main scanning direction of an inkjet head are configured to be movable to a downstream side in the transporting direction of a recording medium. The print system described in Patent Literature 1 irradiates ink droplets immediately after ink deposition with ultraviolet light of a small light quantity to half cure (temporarily cure), and irradiates the ink droplets to permanently cure with ultraviolet light of a large light quantity after a lapse of a constant time.

The step of partially curing the ink to such an extent as to inhibit displacement and deformation of the ink droplets immediately after being deposited is referred to as "temporary curing", "partial curing", "half curing", "pinning", "set", or the like. In the present description, the terms "temporary curing", "pinning" and the like are used. Meanwhile, the step of sufficiently curing the ink by performing further ultraviolet irradiation after the temporary curing is referred to as "permanent curing" or "curing".

CITATION LIST

Patent Literature

Patent Literature 1: U.S. Pat. No. 7,600,867

SUMMARY OF INVENTION

Technical Problem

By dividing pinning irradiation and curing irradiation as described in Patent Literature 1, improvement in controllability of curing of inks has been enabled. Namely, by providing a time interval between the temporary curing and the permanent curing, enhancement in adhesiveness between the cured inks and the medium has been enabled. Further, curing that hardens the inks is performed at one time at the downstream side, whereby as compared with an irradiation method that performs pinning and curing at the same time while performing shingling ejection, the integrated light quantities of adjacent inks generally become substantially the same. This brings about the advantage of improving the curing (blocking) property of surfaces.

However, for example, when with use of an inkjet head having nozzle arrays for ejecting a white ink or a transparent (clear) ink besides color inks, the nozzle arrays in the head are divided, and by ejection from the respective divided nozzle regions, a color layer, a white ink layer (white layer) to be a foundation of the color layer, or a clear ink layer (transparent layer) that is on the color layer to improve glossiness are formed by being stacked on a medium, if the conventional configuration is applied, a banding phenomenon has been likely to be conspicuous on the white ink layer or the transparent layer. The phenomenon referred to as the banding phenomenon here is a phenomenon in which glossiness differs in response to a swath width period by multi-pass printing.

As a result of assessing and studying the phenomenon more, it has been found that banding streaks sometimes become significantly outstanding, because the curing performances to the ultraviolet irradiation light quantity respectively differ according to the kinds of inks that are the color inks forming the color layer, the white ink and the clear ink. The print system described in Patent Literature 1 changes the light quantities for the temporary curing and the permanent curing; however, the quantities of light applied to all the inks are substantially the same. In the image formation in which the layer of the color inks and the layer of the white ink or the clear ink are stacked, it is difficult to solve the above-described problem due to the differences in ultraviolet light absorption characteristics among the respective inks.

Further, in the white ink layer as a foundation layer, and the transparent layer that is an outermost layer and improves the glossiness, the dot dissolution is not required so much unlike the color layer, and flatness and the uniformity of the layer rather tend to be regarded as important.

The present invention has been contrived in view of these circumstances, an object thereof being to provide an inkjet recording apparatus and an image forming method that realize preferable curing processing in response to differences in absorption characteristics of activation energy of respective inks and the properties of layers to be formed by the respective inks.

Solution to Problem

In order to attain the aforementioned object, the present invention provides an inkjet recording apparatus, including: an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged; a scanning device which is configured to reciprocally move the inkjet head in a first direction with respect to a recording medium on which the first ink and the second ink ejected from the inkjet head are deposited; a relative movement device which is configured to relatively move the recording medium with respect to the inkjet head in a second direction that is not parallel to the first direction; an ejection control device which is configured to control ink ejection of the inkjet head for each of units of divided nozzle regions obtained by dividing each of the nozzle arrays into a plurality of regions in the second direction; an activation light irradiation device which is configured to irradiate the inks deposited on the recording medium with the activation light; an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device.

Further, the present invention provides an image forming method, including: a scan step of moving an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged, in a first direction with respect to a recording medium; a relative movement step of relatively moving the recording medium with respect to the inkjet head in a second direction that is not parallel to the first direction; an ejection control step of controlling ink ejection of the inkjet head for each of units of divided nozzle regions obtained by dividing each of the nozzle arrays into a plurality of regions in the second direction; and an activation light irradiation step of irradiating the inks ejected from the inkjet head and deposited on the recording medium in the ejection control step with the activation light, a range irradiated with the activation light being divided into a plurality of divided irradiation regions corresponding respectively to the divided nozzle regions, irradiation with the activation light being performed by controlling light quantities respectively for the divided irradiation regions.

The other invention modes will be made apparent from the descriptions in the specification and the drawings.

Advantageous Effects of Invention

According to the present invention, the irradiation region of the activation light is divided in correspondence with the division of the region of the nozzle arrays, and adjustment of the irradiation regions corresponding to the divided nozzle regions is enabled. Thereby, suitable curing processing can be performed for each of the divided nozzle regions. According to the present invention, irradiation of the activation light can be restrained for the ink deposition regions at the time of forming a white layer and a transparent layer, flattening and uniformization of the layers are promoted, and a banding phenomenon can be avoided.

BRIEF DESCRIPTION OF DRAWINGS

FIG. 50 is a block diagram showing a schematic configuration of a control system of the inkjet recording apparatus.

DESCRIPTION OF EMBODIMENTS

Below, preferred embodiments of the present invention are described in detail with reference to the accompanying drawings.

First Embodiment

Entire Configuration of Inkjet Recording Apparatus

Figure 1:
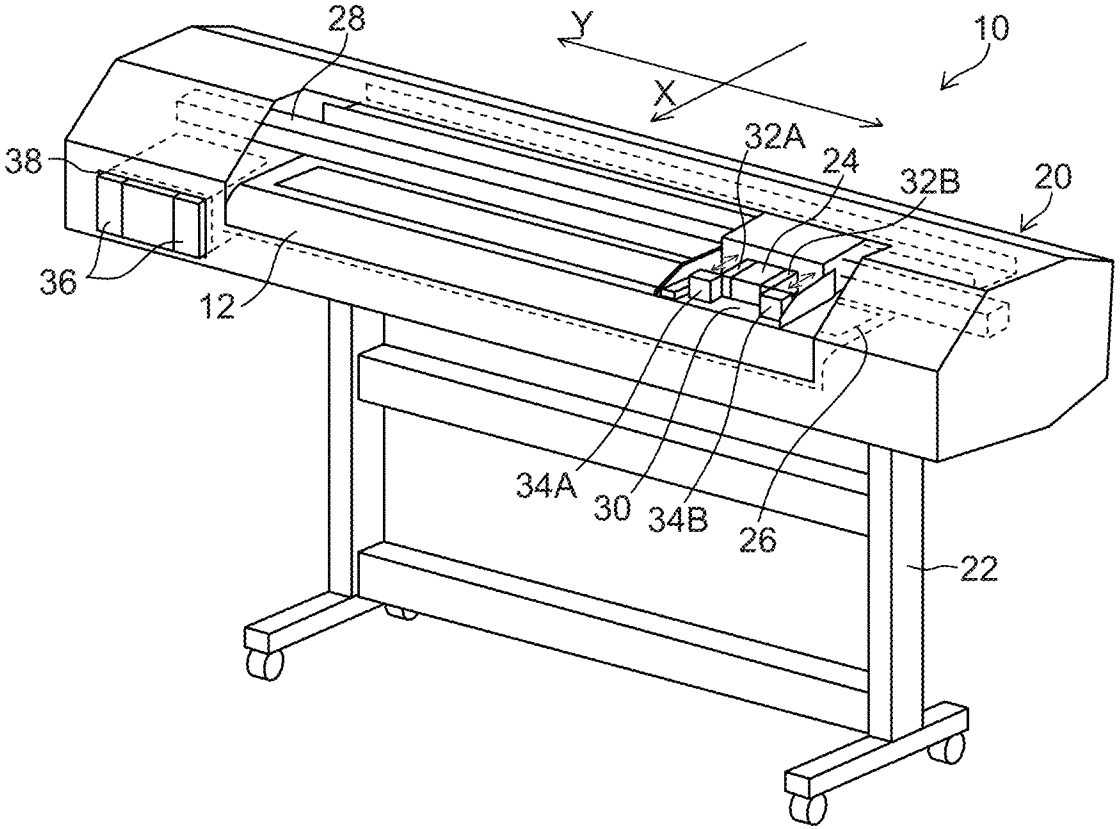
FIG. 1 is an external perspective view of an inkjet recording apparatus according to one embodiment of the present invention.

FIG. 1 is an external perspective view of an inkjet recording apparatus according to a first embodiment of the present invention. The inkjet recording apparatus 10 is a wide format printer that forms a color image on a recording medium 12 by using an ultraviolet curable ink (UV curable ink). A wide format printer is an apparatus favorable for recording a wide image forming range such as a large-sized poster, and a commercial wide surface advertisement. In this case, a format corresponding to A3 plus (in general, 483 mm×329 mm, but there is no rule concerning an accurate dimension, and a size slightly larger than A3 (420 mm×297 mm) can be included) or more is referred to as a "wide format".

The inkjet recording apparatus 10 includes an apparatus main body 20 and supporting legs 22, which support the apparatus main body 20. The apparatus main body 20 is provided with a drop-on-demand type inkjet head 24, which ejects inks toward the recording medium (medium) 12; a platen 26, which supports the recording medium 12; and a guide mechanism 28 and a carriage 30 as a head moving device (a scanning device).

The guide mechanism 28 is disposed above the platen 26 and extends along a scanning direction (Y direction), which is perpendicular to a transporting direction (X direction) of the recording medium 12 and is parallel to a medium supporting surface of the platen 26. The carriage 30 is supported by the guide mechanism 28 to be reciprocally movable in the Y direction along the guide mechanism 28. On the carriage 30, the inkjet head 24 is mounted, and temporary curing light sources (pinning light sources) 32A and 32B and permanent curing light sources (curing light sources) 34A and 34B, which irradiate the inks on the recording medium 12 with ultraviolet light, are mounted.

The temporary curing light sources 32A and 32B are light sources that, after the ink droplets ejected from the inkjet head 24 are landed on the recording medium 12, apply ultraviolet light for temporarily curing the ink to such an extent to prevent the adjacent droplets from uniting with each other. The permanent curing light sources 34A and 34B are light sources that apply ultraviolet light for completely curing (permanently curing) the ink finally by performing additional irradiation after the temporary curing. Although the details will be described later, any one or both of the permanent curing light sources 34A and 34B is or are configured to be movable in the X direction so as to be aligned with the inkjet head 24 and the temporary curing light sources 32A and 32B with respect to the Y direction.

The inkjet head 24, the temporary curing light sources 32A and 32B and the permanent curing light sources 34A and 34B, which are disposed on the carriage 30, move integrally (together) with the carriage 30 along the guide mechanism 28. The reciprocally moving direction (Y direction) of the carriage 30 is sometimes referred to as the "main scanning direction", and the transporting direction (X direction) of the recording medium 12 is sometimes referred to as the "sub-scanning direction". The Y direction corresponds to the "first direction", and the X direction corresponds to the "second direction".

For the recording medium 12, various media can be used regardless of material, and whether a permeable medium or an impermeable medium, such as paper, unwoven fabrics, vinyl chloride, synthetic chemical fibers, polyethylene, polyester, and tarpaulin. The recording medium 12 is fed from a roll paper state (see FIG. 2) from a back side of the apparatus, and after printing, is wound up by a wind-up roller (not shown in FIG. 1, reference numeral 44 in FIG. 2) at a front side of the apparatus. To the recording medium 12 transported onto the platen 26, ink droplets are ejected from the inkjet head 24, and to the ink droplets that have been deposited on the recording medium 12, ultraviolet light is applied from the temporary curing light sources 32A and 32B, and the permanent curing light sources 34A and 34B.

In FIG. 1, a mounting portion 38 for ink cartridges 36 is arranged in a front face at the left-hand side, facing the front of the apparatus main body 20. The ink cartridges 36 are replaceable ink supply sources (ink tanks), which store ultraviolet curable inks. The ink cartridges 36 are provided to correspond to respective color inks that are used in the inkjet recording apparatus 10 of the present embodiment. The respective ink cartridges 36 according to the colors are connected to the inkjet head 24 through ink supply paths (not shown), which are formed independently from each other. When the ink remaining quantities of the respective colors become small, the ink cartridges 36 are replaced.

Further, although not illustrated, a maintenance part for the inkjet head 24 is arranged at the right-hand side, facing the front of the apparatus main body 20. The maintenance part is provided with a cap for retaining moisture of the inkjet head 24 during a non-printing time, and a wiping member (a blade, a web or the like) for cleaning a nozzle face (an ink ejection face) of the inkjet head 24. The cap, which caps the nozzle face of the inkjet head 24, is provided with an ink receiver for receiving ink droplets that are ejected from the nozzles for the purpose of maintenance.

<Explanation of Recording Medium Transport Path>

Figure 2:
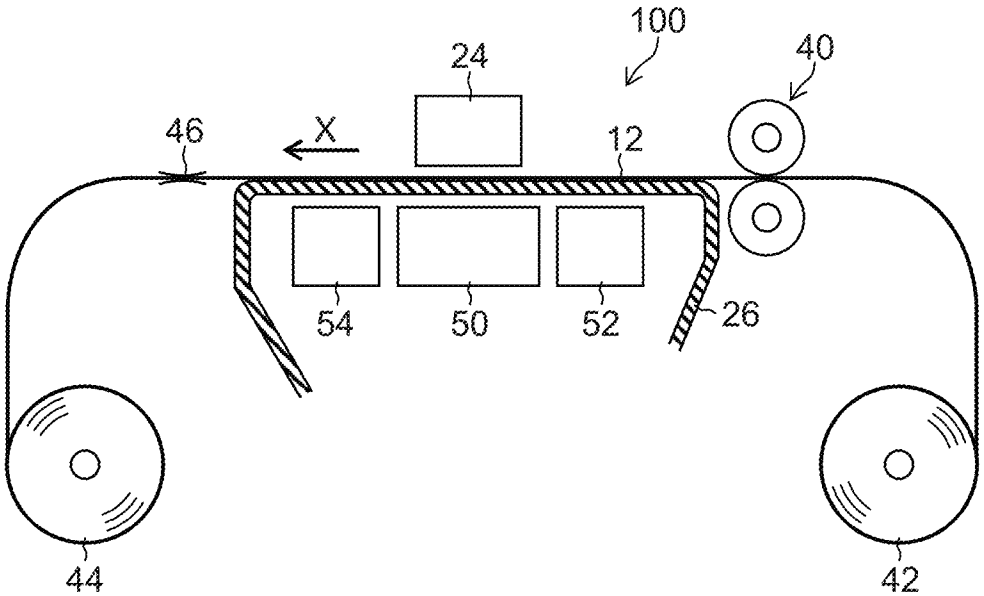
FIG. 2 is an explanatory view schematically showing a paper transport path in the inkjet recording apparatus shown in FIG. 1.

FIG. 2 is an explanatory view schematically showing a recording medium transport path in the inkjet recording apparatus 10. As shown in FIG. 2, the platen 26 is formed in an inverted gutter shape, and the top surface thereof serves as the supporting surface (medium supporting surface) for the recording medium 12. In the vicinity of the platen 26, at an upstream side thereof in the recording medium transporting direction (X direction), a pair of nip rollers 40 is arranged to serve as a recording medium transporting device for intermittently transporting the recording medium 12. The nip rollers 40 move the recording medium 12 in the recording medium transporting direction on the platen 26.

The recording medium 12 that is fed out from a roll (sending-out supply roll) 42 at a supply side, which configures a roll to roll type medium transport device, is intermittently transported in the recording medium transporting direction by the pair of nip rollers 40 arranged at an inlet (an upstream side in the recording medium transporting direction of the platen 26) of a printing part. On the recording medium 12 that reaches the printing part directly under the inkjet head 24, printing is executed by the inkjet head 24, and after the printing, the recording medium 12 is wound up on a wind-up roll 44. At a downstream side in the recording medium transporting direction of the printing part, a guide 46 for the recording medium 12 is arranged.

On a rear surface (the surface at the opposite side from the surface supporting the recording medium 12) side of the platen 26 located at a position facing the inkjet head 24 in the printing part, a temperature regulating part 50 for regulating the temperature of the recording medium 12 under printing is arranged. When the temperature regulating part 50 is regulated so that the recording medium 12 at the printing time has a predetermined temperature, the physical property values such as viscosity and surface tension of the ink droplets landed on the recording medium 12 become desired values, and a desired dot diameter can be obtained. Note that in accordance with necessity, a pre-temperature regulating part 52 can be arranged at an upstream side of the temperature regulating part 50, and a post-temperature regulating part 54 can be arranged at a downstream side of the temperature regulating part 50.

<Explanation of Inkjet Head>

Figure 3:
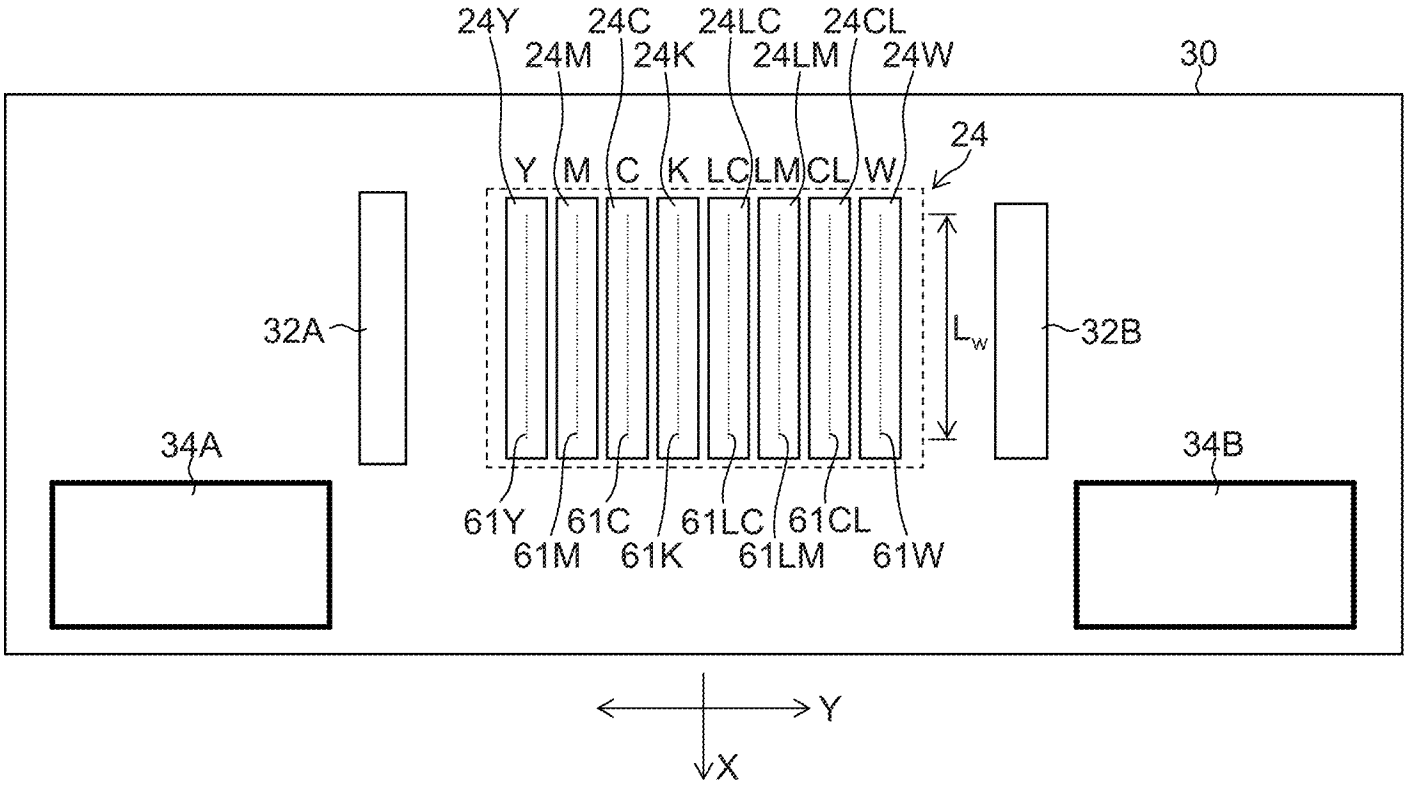
FIG. 3 is a planar perspective view showing a disposition configuration of the inkjet head and ultraviolet emission parts shown in FIG. 1.

FIG. 3 is a planar perspective view showing an embodiment of a disposition form of the inkjet head 24, the temporary curing light sources 32A and 32B and the permanent curing light sources 34A and 34B, which are disposed on the carriage 30.

The inkjet head 24 is provided with nozzle arrays 61Y, 61M, 61C, 61K, 61LC, 61LM, 61CL and 61W for ejecting inks in corresponding colors for the inks in the respective colors of yellow (Y), magenta (M), cyan (C), black (K), light cyan (LC), light magenta (LM), a clear (transparent) ink (CL) and a white ink (W). FIG. 3 illustrates the nozzle arrays with the dotted lines, and illustration of individual nozzles is omitted. Further, in the following explanation, the nozzle arrays 61Y, 61M, 61C, 61K, 61LC, 61LM, 61CL and 61W are sometimes denoted with reference numeral 61 generically representing the nozzle arrays.

The kinds (the number of colors) of ink colors and the combination of the colors are not limited to the present embodiment. For example, a form in which the nozzle arrays of LC and LM are omitted, a form in which any one of the nozzle arrays of CL and W is omitted, a form in which a nozzle array of a metallic ink is added, a form provided with the nozzle array of the metallic ink instead of the nozzle array of W, a form in which a nozzle array that ejects an ink in a special color is added, and the like are possible. Further, the disposition sequence of the nozzle arrays according to the colors is not especially limited. However, a configuration is preferable, in which out of the plurality of kinds of inks, the ink with lower curing sensitivity to ultraviolet light is disposed at the side near to the temporary curing light source 32A or 32B.

Head modules are configured respectively for the nozzle arrays 61 according to the colors, and the head modules are aligned, and thereby the inkjet head 24 capable of color image printing can be configured. For example, a mode is possible, in which a head module 24Y having the nozzle array 61Y, which ejects the yellow ink, a head module 24M having the nozzle array 61M, which ejects the magenta ink, a head module 24C having the nozzle array 61C, which ejects the cyan ink, a head module 24K having the nozzle array 61K, which ejects the black ink, and head modules 24LC, 24LM, 24CL and 24W respectively having the nozzle arrays 61LC, 61LM, 61CL and 61W, which eject the inks of the respective colors of LC, LM, CL and W are equidistantly disposed to be aligned along the reciprocally moving direction (the main scanning direction, the Y direction) of the carriage 30. A module group (head group) of the head modules 24Y, 24M, 24C, 24K, 24LC, 24LM, 24CL and 24W according to the colors can be regarded as "the inkjet head", or the modules can be regarded respectively as "the inkjet heads". Alternatively, a configuration is possible, which includes nozzle arrays that eject inks in plurality of colors with one head by separately forming ink flow paths according to the colors inside one inkjet head 24.

In each of the nozzle arrays 61, the plurality of nozzles are aligned in line (rectilinearly) along the recording medium transporting direction (the sub-scanning direction, the X direction) at constant intervals. In the inkjet head 24 of the present embodiment, a disposition pitch (nozzle pitch) of the nozzles configuring each of the nozzle arrays 61 is 254 μm (100 dpi), the number of nozzles configuring each nozzle array 61 is 256 nozzles, an entire length Lw of each nozzle array 61 (an entire length of the nozzle array) is approximately 65 mm (254 μm×255=64.8 mm) Further, in the present embodiment, an ejection frequency is 15 kHz, and three kinds of ejection droplet quantities of 10 pl, 20 pl and 30 pl can be separately ejected by change of drive waveforms.

As an ink ejection system of the inkjet head 24, a system (piezoelectric jet system) that ejects ink droplets by deformation of piezoelectric elements (piezoelectric actuators) is adopted. As the ejection energy generating elements, a form that heats inks by using heat generators (heating elements) such as heaters to generate bubbles, and ejects ink droplets by the pressure (thermal jet system) also can be adopted, besides a form that uses electrostatic actuators (electrostatic actuator system). However, the ultraviolet curable ink generally has high viscosity as compared with a solvent ink, and therefore, in the case of using the ultraviolet curable ink, the piezoelectric jet system with a relatively large ejection force is preferably adopted.

<Image Formation Mode>

In the inkjet recording apparatus 10 shown in the present embodiment, image formation control of a multipass system is applied, and the inkjet recording apparatus 10 can change print resolutions by change of the number of printing passes. For example, three kinds of image formation modes that are a high production mode, a standard mode and a high image quality mode are prepared, and the print resolutions differ among the respective modes. In response to a print purpose and use purpose, the image formation mode can be selected.

In the high production mode, the printing is executed with a resolution of, for example, 600 dpi (in the main scanning direction)×400 dpi (in the sub-scanning direction). In the case of the high production mode, the resolution of 600 dpi is realized by two passes (scanning of two times) in the main scanning direction. In the scan of the first time (outgoing trip of the carriage 30), dots are formed with a resolution of 300 dpi. In the scan of the second time (return trip), dots are formed so as to interpolate spaces among the dots formed by the scan of the first time (outgoing trip) with 300 dpi, and the resolution of 600 dpi is obtained with respect to the main scanning direction.

Meanwhile, with respect to the sub-scanning direction, the nozzle pitch is 100 dpi, and dots are formed with a resolution of 100 dpi in the sub-scanning direction by main scanning of one time (one pass). Accordingly, the resolution of 400 dpi is realized by performing interpolation printing by four-pass printing (scanning of four times). Note that a main scanning speed of the carriage 30 in the high production mode is 1270 mm/sec.

In the standard mode, the printing is executed with a resolution of, for example, 600 dpi×800 dpi, and the resolution of 600 dpi×800 dpi is obtained by two-pass printing in the main scanning direction, and eight-pass printing in the sub-scanning.

In the high image quality mode, the printing is executed with a resolution of, for example, 1200×1200 dpi, and the resolution of 1200 dpi×1200 dpi is obtained by four passes in the main scanning direction, and 12 passes in the sub-scanning direction.

<<Swath Width by Shingling Scan>>

In the image formation mode of the wide format apparatus, the image formation conditions for shingling (interlace) are determined respectively for the resolution settings. More specifically, shingling image formation is performed by dividing the width Lw (length of the nozzle array) of the ejection nozzle array of the inkjet head by the number of passes (the number of scan repetition times), and therefore, the swath width differs according to the nozzle array width of the inkjet head, and the number of passes (the number of divisions to be interlaced) in the main scanning direction and the sub-scanning direction. Note that the details of shingling image formation by the multipass system are described in, for example, Japanese Patent Application Publication No. 2004-306617.

As one embodiment, the relationship of the number of passes and the swath width by the shingling image formation in the case of using QS-10 head (100 dpi, 256 nozzles) made by FUJIFILM Dimatix, Inc. is as in the following table (Table 1). The swath width that is assumed in the image formation has the value obtained by dividing the nozzle array width to be used by the product of the number of passes in the main scanning direction and the number of passes in the sub-scanning direction.

TABLE 1

| | | | | |
|---|---|---|---|---|
| NOZZLE ARRAY WIDTH FOR USE (mm) | 64.8 | 64.8 | 64.8 | 64.8 |
| NUMBER OF MAIN PASSES | 1 | 1 | 2 | 2 |
| NUMBER OF SUB PASSES | 2 | 4 | 2 | 4 |
| SWATH WIDTH (mm) | 32.4 | 16.2 | 16.2 | 8.1 |

<Disposition of Ultraviolet Emission Parts>

As shown in FIG. 3, the temporary curing light sources 32A and 32B are disposed at both left and right sides in the carriage moving direction (Y direction) of the inkjet head 24. Further, the permanent curing light sources 34A and 34B are disposed at the downstream side in the recording medium transporting direction (X direction) of the inkjet head 24. The permanent curing light sources 34A and 34B are disposed at outer sides (in farther positions) than the temporary curing light sources 32A and 32B in the Y direction from the inkjet head 24. The permanent curing light sources 34A and 34B are configured to be movable in the direction (−X direction) opposite to the recording medium transporting direction, and disposition can be changed so that the permanent curing light sources 34A and 34B are aligned with the temporary curing light sources 32A and 32B and the inkjet head 24, along the carriage moving direction.

The color ink droplets that have been ejected from the nozzles for the color inks (the nozzles included in the nozzle arrays 61Y, 61M, 61C, 61K, 61LC and 61LM) of the inkjet head 24 and landed on the recording medium 12 are irradiated with ultraviolet light for temporary curing by the temporary curing light source 32A (or 32B) that passes over the droplets immediately after the landing.

Further, the ink droplets on the recording medium 12 that have passed the print region of the inkjet head 24 with intermittent transport of the recording medium 12 are irradiated with ultraviolet light for permanent curing by the permanent curing light sources 34A and 34B. Thus, the ink droplets are temporarily brought into a temporarily cured state, whereby the developing time of dots (time period in which the dots are spread into predetermined sizes) can be ensured while landing interference is prevented, the dot heights can be made uniform, interaction of the droplets and the medium is promoted, and mutual adhesiveness can be increased.

Meanwhile, a white layer formed by the white ink becomes a foundation for the color image layer, and therefore, is not required to have such a high dot resolution as the color image layer. Similarly, a transparent layer formed by the clear ink becomes a surface gloss layer for enhancing glossiness of the surface of the color image layer, and therefore, is not required to have such a high dot resolution as the color image layer.

When the banding phenomena of the foundation white layer and the clear layer were examined in detail, pinning light is required for color inks to fix the deposition positions; however, a white or clear ink forms a foundation or a surface layer, and therefore, lacks necessity to be pinned in the deposited position. If anything, at the time of formation of a white layer and a transparent layer, it is preferable to flatten and uniformize the layers by bringing about the state in which the landed droplets are not pinned, and creating the situation in which the inks wettedly spread easily, by turning the pinning light quantity off (0 mJ/cm$^2$) or reducing the light application quantity, corresponding to the ejection position of the white or clear ink.

Accordingly, the present embodiment adopts a configuration that does not apply ultraviolet light or adopts a configuration that applies ultraviolet light of a smaller light quantity than that at the time of the temporary curing of the color inks even when applying ultraviolet light, for temporary curing to the white ink droplets, which are ejected from the nozzles for the white ink (the nozzles included in the nozzle array 61W) and landed on the recording medium 12, and the clear ink droplets, which are ejected from the nozzles for the clear ink (the nozzles included in the nozzle array 61CL) and are landed on the recording medium 12.

Thereby, a spreading time period of the dots of the white ink or the clear ink that has been landed on the recording medium can be ensured, and flatness and uniformity of the layer can be enhanced.

Further, in the present embodiment, the white ink, which has been ejected from the nozzles for the white ink (the nozzles included in the nozzle array 61W) and landed on the recording medium, is irradiated with substantially the same amount of ultraviolet light as at the time of the permanent curing processing by the permanent curing light source 34A, which is moved to the position where ultraviolet irradiation is possible in response to the ejection position of the white ink.

Due to the fact that the ultraviolet transmittance of the white layer formed with the white ink is low, substantially the same amount of activation energy as that at the time of permanent curing is applied at a state in which the film thickness of the white ink is small (from the time immediately after the white ink is landed on the recording medium), and curing processing is executed.

Note that both the temporary curing light sources 32A and 32B can be simultaneously lit during a printing operation by the inkjet head 24, or the lives of the light sources can be extended by lighting only the temporary curing light source that is located at the rear side in the carriage movement in the main scanning direction. Further, both the permanent curing light sources 34A and 34B are simultaneously lit during the printing operation of the inkjet recording apparatus 10. In the image formation mode with a low scanning speed, one of the permanent curing light sources 34A and 34B can be turned off, and the light emission start timing of the temporary curing light sources 32A and 32B, and the permanent curing light sources 34A and 34B can be the same or different.

<Explanation of Movement of Permanent Curing Light Source>

Figure 4:
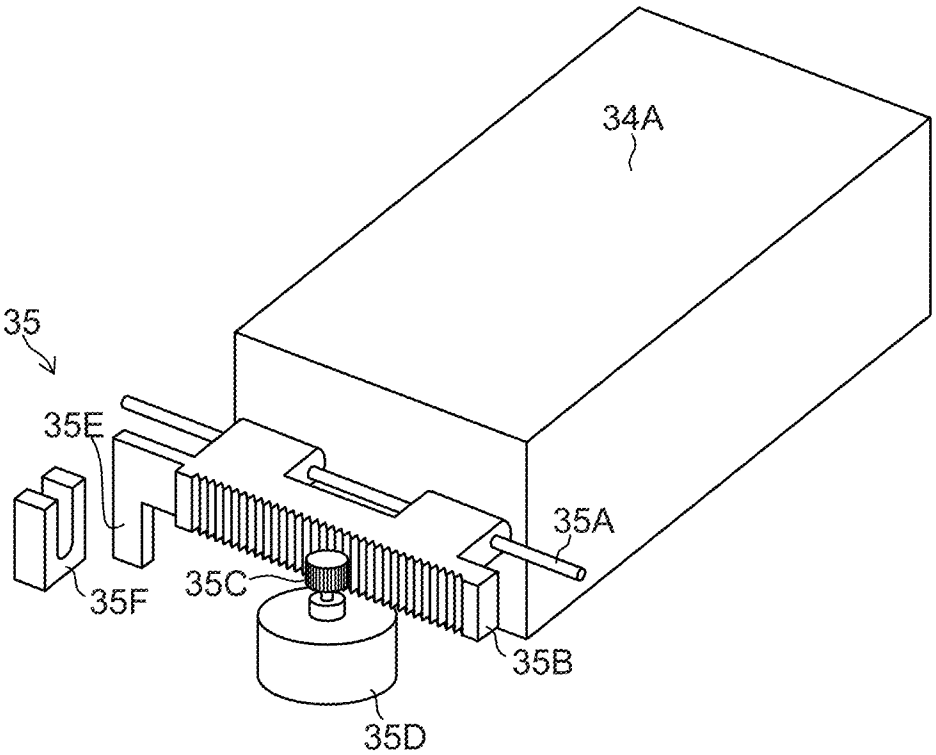
FIG. 4 is a perspective view showing a configuration embodiment of a light source moving part that moves the ultraviolet emission parts shown in FIG. 3.

FIG. 4 is a perspective view showing a configuration embodiment of a moving mechanism (light source moving part) 35 of the permanent curing light source 34A. As the light source moving part 35 shown in FIG. 4, a rectilinearly moving mechanism of a rack and pinion system is applied. Namely, the light source moving part 35 includes: a shaft 35A, which is fixedly disposed along the recording medium transporting direction, which is the moving direction of the permanent curing light source 34A; a rack 35B, which is attached to a case of the permanent curing light source 34A and has teeth-shaped projections and depressions formed along the shaft 35A; a drive motor 35D with a pinion gear 35C attached to a rotary shaft; and an optical position sensor 35F for detecting a detection piece 35E formed at an end portion of the rack 35B.

When the rotary shaft of the drive motor 35D is rotated, the pinion gear 35C rotates, the rack 35B moves along the shaft 35A by meshing of the teeth of the pinion gear 35C and the rack 35B, and the permanent curing light source 34A moves along the shaft 35A together with the rack 35B. When the detection piece 35E arranged at the end of the rack 35B enters a detection range of the position sensor 35F, the rotation of the drive motor 35D is stopped, and the permanent curing light source 34A stops at a predetermined position.

Note that the permanent curing light source 34B located at the opposite side from the permanent curing light source 34A with the inkjet head 24 therebetween can be configured to be movable by also including a moving mechanism having a similar configuration. Further, the permanent curing light sources 34A and 34B can be configured to be moved to a plurality of positions by including a plurality of the position sensors 35F.

<Explanation of Image Forming Process>

The inkjet recording apparatus 10 shown in the present embodiment is configured to form an image of a layered structure by stacking a color image layer (illustrated by being denoted with reference numeral 82 in FIG. 5), which is formed with the color inks (Y, M, C, K, LC, LM and the like), a white layer (illustrated by being denoted with reference numeral 80 in FIG. 5), which is formed with the white ink, and/or a transparent layer (illustrated by being denoted with reference numeral 84 in FIG. 29), which is formed with the clear ink. Further, the ultraviolet irradiation quantity is controlled in accordance with the sequence of the layer formation and the ultraviolet absorption characteristics of the inks (the curing characteristics of the inks).

For example, since the white ink contains titanium oxide, zinc oxide or the like as a pigment, the white ink is inferior in transmittance of ultraviolet light as compared with the color inks and the clear ink, and when the same amount of ultraviolet light per unit volume as that for the color inks or the clear ink is applied, the curing time is longer. In order to eliminate the difference in curing characteristic due to the ultraviolet transmission properties between the white ink, and the color inks and the clear ink, ultraviolet irradiation is controlled so that the ultraviolet irradiation amount per unit time to the white ink becomes larger than those to the color inks and the clear ink. A specific embodiment of the above-described image formation will be described later.

Note that the K ink is classified into an ink with a long curing time according to the viewpoint of the ultraviolet transmission property, but is classified into a color ink since the K ink is used for formation of a color image layer, and needs to be temporarily cured immediately after deposition to prevent deposition interference.

<<White Layer and Surface Gloss Layer (Transparent Layer)>>

In contrast with the color layer formed with the color inks, the white ink layer (white layer) to be a foundation thereof generally uses titanium dioxide, zinc oxide or the like as a pigment, and has a lower transmittance than the color inks. Meanwhile, the transparent layer does not contain any pigment, has a high transmittance, and is a polymer formed from a monomer cured by photo polymerization. Any of these ink layers is used as a foundation layer or a surface gloss layer when used in a wide format printer, and therefore lacks necessity of pinning irradiation (temporary curing) immediately after being deposited. If anything, in order to promote the droplets (droplets configuring the white ink layer and the transparent layer) after deposition to wettedly spread positively and be flattened, a configuration is preferable, that adopts a mechanism that does not apply the pinning light unlike the color layer, or a mechanism that reduces the action of curing by the pinning light.

According to the experiment, the color layer is desirably irradiated with 1 mJ/cm$^2$ to 20 mJ/cm$^2$ per unit area as the pinning light, immediately after deposition, and 2 mJ/cm$^2$ to 6 mJ/cm$^2$ is more preferable. Meanwhile, the white layer to be the foundation, or the clear layer to be the surface gloss layer is desirably irradiated with the pinning light of 0 mJ/cm$^2$ to 4 mJ/cm$^2$ as the pinning light quantity, immediately after deposition, and 0 mJ/cm$^2$ to 2 mJ/cm$^2$ is more preferable.

The pinning light is applied one time to a plurality of times by carriage scanning immediately after deposition of the inks in order to avoid unification with other inks, loss of droplet shapes due to interference, or movement of the droplets. The curing light refers to light application that completely cures the inks forming an image. The curing light is also applied a plurality of times by carriage scanning. By one to a plurality of times of the pinning light application, and a plurality of times of the curing light application, a total integrated applied light quantity reaches a light quantity of 200 mJ/cm$^2$ to 1000 to 3000 mJ/cm$^2$. Tendency of ink sensitivity is determined by sensitivity of an initiator and a sensitizer contained in the ultraviolet curable ink to the irradiation wavelength, and contents thereof, and the ink is cured by radical polymerization, and cationic polymerization.

In the present embodiment, the emission region of the temporary curing light source is divided to correspond to the divided nozzle regions, and the light quantities (illuminance distribution) of the respective regions are regulated so that suitable pinning light can be applied in response to the image forming ranges of the divided nozzle regions forming the respective layers such as the color layer, the white layer and the transparent layer. The details will be described later.

<Detailed Explanation of Image Forming Process>

An image forming method that is applied to the inkjet recording apparatus 10 shown in the present embodiment is such that each of the nozzle arrays 61 is divided into a plurality of regions with respect to the recording medium transporting direction, the color ink, the clear ink or the white ink is ejected by using any of the divided regions, and the color image layer, the transparent layer and the white layer are formed. The number of divisions of the nozzle array 61 is a number N of image forming layers.

Further, the recording medium 12 is configured to be intermittently fed in one direction by a unit obtained by dividing a length in the recording medium transporting direction of the divided regions of the nozzle array 61 (unit obtained by ("the total length Lw of the nozzle array"/"the number N of image forming layers")/"the number of multipasses"), so that a layer of the ink ejected from the region at the downstream side in the recording medium transporting direction is stacked on a layer of the ink ejected from the region at the upstream side in the recording medium transporting direction of the nozzle array 61. Here, "the number of multipasses" is defined by a product of the number of passes in the carriage scanning direction and the number of passes in the recording medium transporting direction.

Furthermore, the white ink, which requires a longer time until it is cured than other inks, is irradiated with ultraviolet light of substantially the same light quantity as that at the time of the permanent curing processing, immediately after landing, by any one of the permanent curing light sources 34A and 34B that is moved to the ejection position of the white ink. In order that only the area where the white ink is deposited is irradiated with ultraviolet light of the same light quantity as that at the time of the permanent curing processing, the lengths of the irradiation areas in the recording medium transporting direction of the permanent curing light sources 34A and 34B are set at ("the total length Lw of the nozzle array"/"the number N of image forming layers") or less.

Note that in the following description, the description is made on the precondition that the lengths in the recording medium transporting direction of the irradiation areas of the permanent curing light sources 34A and 34B and the lengths in the recording medium transporting direction of the permanent curing light sources 34A and 34B are the same. The lengths in the recording medium transporting direction of the actual permanent curing light sources 34A and 34B are determined so that predetermined irradiation areas are obtained, with consideration given to broadening of the irradiation areas. Further, "the number N of image forming layers" is sometimes described as "the number of divisions".

First Specific Embodiment

Figure 5:
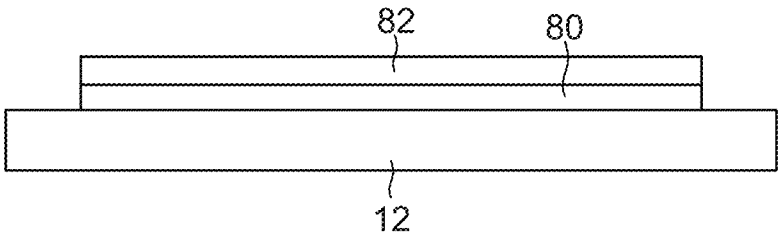
FIG. 5 is an explanatory view schematically illustrating a layer structure of an image according to a first specific embodiment.

FIG. 5 is an explanatory view schematically illustrating a layer structure of an image formed by an image forming process according to a first specific embodiment. The image shown in FIG. 5 has a layer structure in which the white layer 80 is formed on the recording medium 12, and the color image layer 82 is formed (stacked) on the white layer 80, and the number of image forming layers is two.

Figure 6:
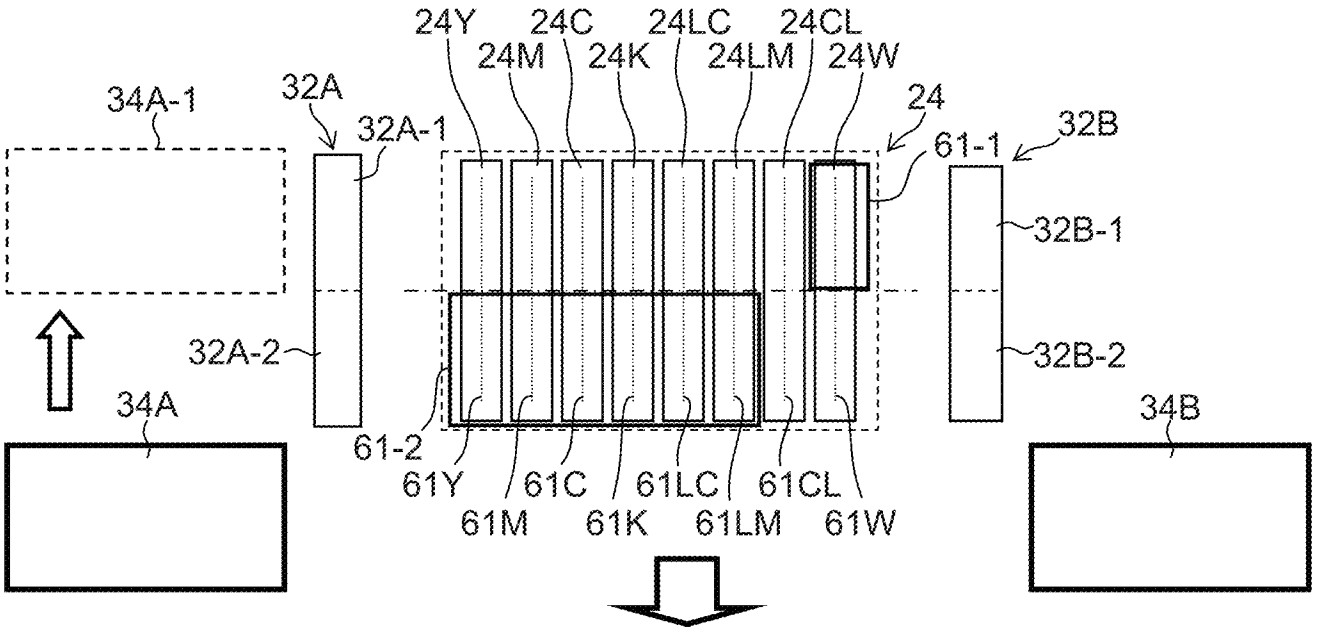
FIG. 6 is an explanatory view showing a configuration embodiment of the inkjet head and the ultraviolet emission parts for forming the image shown in FIG. 5.

FIG. 6 is an explanatory view schematically illustrating a configuration of the inkjet head 24 for forming the image having the layer structure shown in FIG. 5, and disposition of the permanent curing light sources 34A and 34B. Note that the recording medium transporting direction (X direction) is downward from a top illustrated by the downward arrow line in FIG. 6, and the reciprocally moving direction (Y direction) of the carriage 30 is a lateral direction.

As shown in FIG. 6, each of the nozzle arrays 61 is divided into two, which are an upstream side region 61-1 and a downstream side region 61-2, and the white ink is ejected from only the upstream side region 61-1 of the nozzle array 61W, whereas the color ink is ejected from only the downstream side regions 61-2 of the nozzle arrays 61Y, 61M, 61C, 61K, 61LC and 61LM. Subsequently, when the white layer 80 (see FIG. 5) of the white ink ejected from the upstream side region 61-1 is formed, the recording medium 12 is moved by a distance ((Lw/2)/"the number of multipasses") in the recording medium transporting direction, and the color image layer 82 of the color inks ejected from the downstream side regions 61-2 is formed on the white layer 80, which is previously formed.

While the color image layer 82 is formed on the white layer 80, the white ink is ejected from only the upstream side region 61-1 of the nozzle array 61W at the deposition position of the white ink at the upstream side in the recording medium transporting direction adjacent to the deposition position of the color inks. Namely, simultaneously with formation of the color image layer 82, formation of the white layer 80 to be a formation region of the next color image advances. Further, the multipass system described above is applied to ejection of the white ink forming the white layer 80 and ejection of the color inks forming the color image layer 82.

The permanent curing light source 34A is moved (the moving direction is illustrated by the upward arrow line) to a position illustrated with the broken line by being denoted with reference 34A-1, that is, a position corresponding to the ejection position of the white ink (the position aligned in the carriage moving direction with the upstream side region 61-1 of the nozzle array 61W ejecting the white ink), and ultraviolet light of substantially the same quantity as that of the permanent curing processing are applied by the permanent curing light source 34A immediately after the white ink is landed on the recording medium 12. Meanwhile, to the color inks, permanent curing processing by the permanent curing light source 34B is applied after temporary curing processing by the temporary curing light sources 32A and 32B.

Namely, step 1 of the image forming process is a forming step of the white layer 80, the permanent curing light source 34A at the left-hand side in FIG. 6 is moved in correspondence with the ejection position of the white ink (reference 34A-1), and the carriage 30 (see FIG. 3) is caused to scan in the carriage moving direction. Subsequently, the white ink is ejected from only the upstream side region 61-1 of the nozzle array 61W. When the carriage 30 moves from the left-hand side to the right-hand side in FIG. 6, the white ink is ejected, and ultraviolet light is applied to the white ink immediately after being landed on the recording medium 12, from the permanent curing light source 34A that follows the nozzle array 61W and scans in the carriage moving direction. The same amount of ultraviolet light as that of permanent curing processing (10 mJ/cm$^2$ or more per one time of scan of the carriage) are applied by scan of the carriage of one time, and the white layer 80 (see FIG. 5) in which the white ink is substantially cured is formed.

Note that in the case of the present embodiment, ejection of the white ink is stopped at the time of scan when the carriage 30 moves from the right-hand side to the left-hand side in FIG. 6, but the lighting state of the permanent curing light source 34A is kept, and the application of the ultraviolet light from the permanent curing light source 34A is continued.

In the white ink, yellowing of the cured film becomes significantly outstanding, and therefore, the white ink has a lower content of the reaction initiator than the color inks and the like in order to prevent the yellowing. Further, the white ink contains titanium oxide or zinc oxide as a pigment, and therefore, the white ink has the property of being less prone to absorb ultraviolet light (less prone to be cured) as compared with the color inks and the clear ink.

When the case is considered, in which ultraviolet light-emitting diode (UV-LED) elements are applied as the light source of the temporary curing light sources 32A and 32B and the permanent curing light sources 34A and 34B, the emission light wavelength band of the UV-LED elements is only a long wave band of 365 nm to 405 nm, and adaptation to long wave of the initiators contained in the inks becomes essential. Meanwhile, since the cured films of the inks are sometimes yellowed due to adaptation of the initiators to the long wave, and therefore, the contents of the initiators are limited in the white ink and the clear ink in which yellowing is significantly outstanding.

Moreover, the white layer 80 is a so-called solid image, and therefore, dots (droplets) in larger size as compared with those of color images can be used. Further, since as described above, the ultraviolet transmittance of the white ink (white layer 80) is lower than the color inks and the like, substantially the same amount of activation energy as that at the time of permanent curing processing is applied at the state in which the film thickness of the white ink is small, and curing processing for the white ink is executed. Accordingly, for the white ink, pinning light irradiation by the temporary curing light sources 32A and 32B is not performed (or irradiation by a lower light quantity than the pinning light quantity for the color inks is performed), and the time in which the landed droplets wettedly spread is ensured as much as possible, after which, the white ink is irradiated with the activation energy equivalent to that of the permanent curing processing to be completely cured.

Step 2 is a forming step of the color image layer 82. In the ejection position of the color inks at the downstream side by a distance (Lw/2) in the recording medium transporting direction from the deposition position of the white ink of the recording medium 12, the white layer 80 is already formed. In the color image layer forming step (step 2), the carriage 30 is caused to scan in the carriage moving direction in the position above the white layer 80, the color inks are ejected from the downstream side regions 61-2 of the nozzle arrays 61Y, 61M, 61C, 61K, 61LC and 61LM, and the color inks are deposited by being overlaid on the white layer 80.

Further, from the temporary curing light sources 32A and 32B following the nozzle arrays 61Y, 61M, 61C, 61K, 61LC and 61LM, ultraviolet light is applied to the color inks immediately after being landed on the recording medium 12 to temporarily cure the color inks and bring the color inks into a gel state. By doing as described above, landing interference of the color inks is prevented.

At this time, the ultraviolet light applied from the temporary curing light sources 32A and 32B to the color inks immediately after being landed have a low light quantity and, for example, 1 to 5 mJ/cm$^2$ per one time of scan of the carriage. The low light quantity for temporary curing applied to image formation shown in the present embodiment is approximately 1/10 to 1/2 with respect to the large light quantity for permanent curing.

Further, although the details will be described later, the temporary curing light sources 32A and 32B have the emission regions divided into two in the X direction in response to the image forming ranges of the respective divided nozzle regions (the upstream side regions 61-1, the downstream side regions 61-2) of the nozzle arrays divided into two, and are capable of controlling the light quantities in each of the division units (divided emission regions) denoted with references 32A-1, 32A-2, 32B-1 and 32B-2 in FIG. 6.

Step 3 is a time period from the forming step until a permanent curing processing step of the color image layer 82, and a portion where the color image layer 82 is stacked on the white layer 80 at the downstream side by (Lw/2) in the recording medium transporting direction further from the deposition position of the color inks of the recording medium 12 is out of the ejection position of the nozzle arrays 61, and is located in the ultraviolet irradiation area by the permanent curing light source 34B. By providing a predetermined time period between the temporary curing processing step and the permanent curing processing step, adhesion and affinity of the white layer 80 and the color image layer 82 is enhanced, spread of the dots is promoted while reduction in pile height is promoted, and glossiness of the color image is further enhanced.

Step 4 is the permanent curing processing step, in which with use of the permanent curing light source 34B disposed at the downstream side in the recording medium transporting direction of the inkjet head 24, the carriage 30 is caused to scan in the carriage moving direction, and permanent curing processing is applied to the color image layer 82 that moves to the ultraviolet irradiation position by the permanent curing light source 34B. The ultraviolet light quantity in the permanent curing processing of the color image layer 82 is 10 mJ/cm$^2$ or more per one time of scan of the carriage. By permanently curing the color image layer 82, the glossiness of the color image layer 82 is more enhanced, and improvement of adhesion of the white layer 80 and the color image layer 82 and curing of the film quality of the color image layer 82 are made compatible.

<First Configuration Embodiment of Temporary Curing Light Source Unit>

Figure 7:
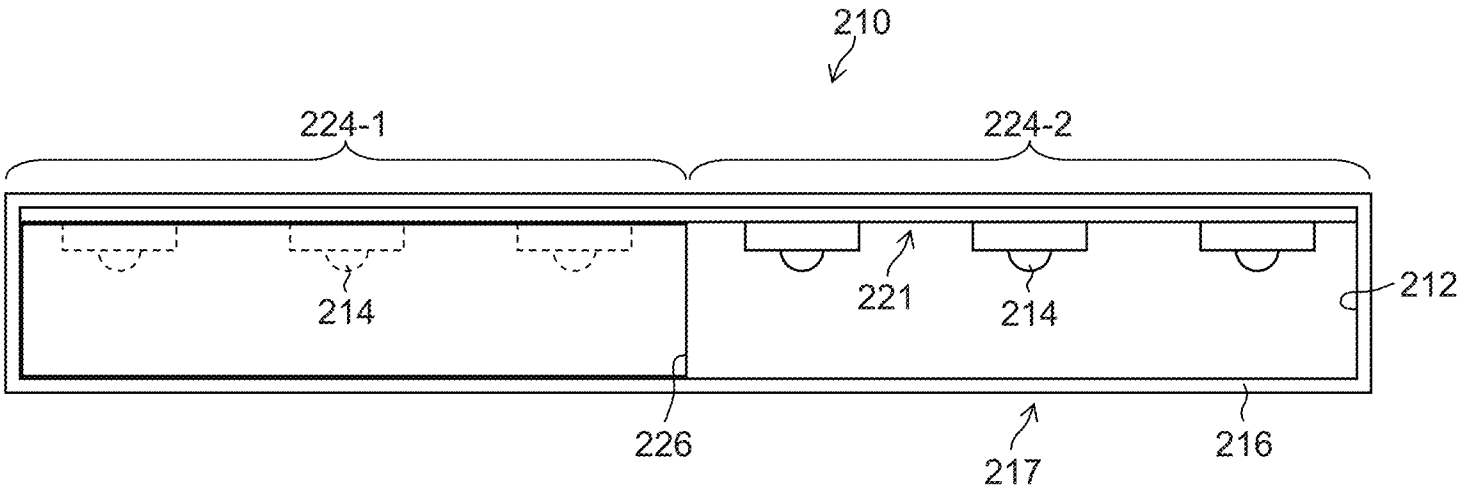
FIG. 7 is a side perspective view showing a first configuration embodiment of a temporary curing light source unit that is used as the temporary curing light source of one embodiment.
Figure 8:
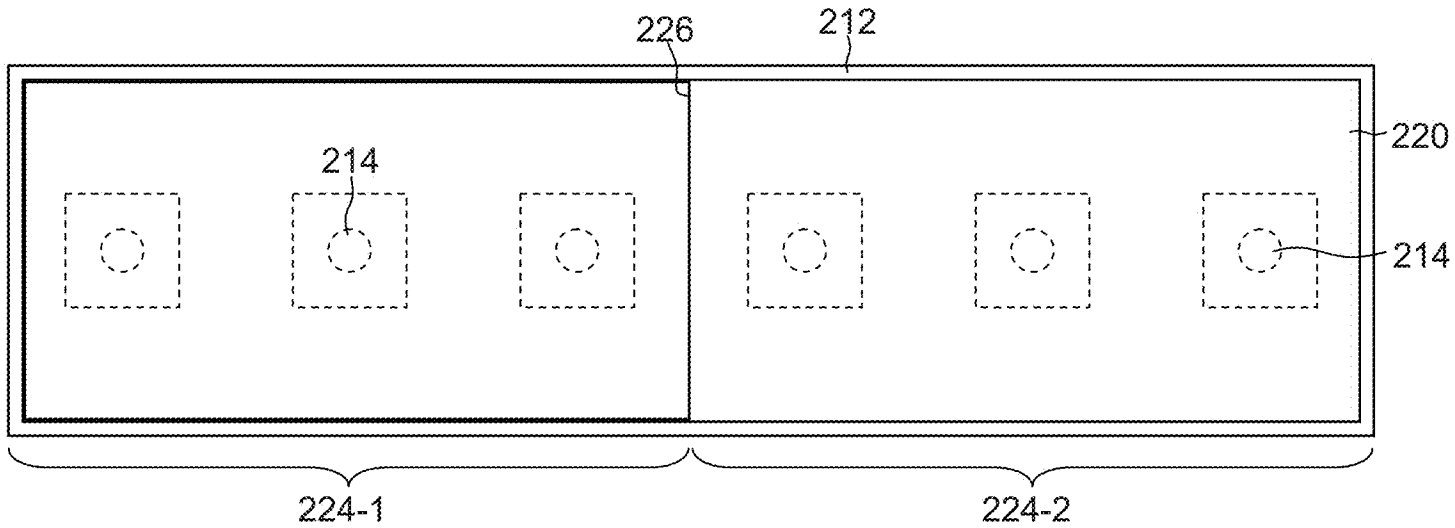
FIG. 8 is a planar perspective view of the temporary curing light source unit in FIG. 7.

FIG. 7 is a side perspective view showing a first configuration embodiment of a temporary curing light source unit that is used as the temporary curing light sources 32A and 32B of the present embodiment. FIG. 8 is a planar perspective view thereof. The temporary curing light source unit 210 according to the first configuration embodiment shown in FIG. 7 and FIG. 8 has a box shape of a substantially rectangular parallelepiped. The temporary curing light source unit 210 has a structure in which a plurality of ultraviolet light emitting diode elements (hereinafter described as "UV-LED elements") 214 are housed in a housing (enclosure) 212 of aluminum, and a transmission-type light diffusion board 216 is disposed on a bottom face portion of the housing 212.

A wiring substrate 220, on which the LED elements 214 are mounted, is disposed on an upper portion of the housing 212 in a state in which an LED mounting surface 221 faces to the light diffusion board 216 (state in which the light emitting faces of the UV-LED elements 214 face down in FIG. 7).

The number of the UV-LED elements 214 that are mounted on the wiring substrate 220 is not especially limited, but from the viewpoint of the required UV application width and cost, the number is preferably made as small as possible. In the present embodiment, the six UV-LED elements 214 are disposed side by side in a single line on the wiring substrate 220. In order to obtain the UV application width by which UV irradiation can be performed at one time for the nozzle array width Lw along the recording medium transporting direction (X direction) of the inkjet head 24 described with FIG. 3 and FIG. 6, the six UV-LED elements 214 are disposed side by side in the recording medium transporting direction. The lateral direction in FIG. 7 refers to the recording medium transporting direction (X direction), and the recording medium 12 is transported from the right-hand side to the left-hand side in FIG. 7.

For the wiring substrate 220, a metal substrate with heat dissipation and heat resistance being reinforced is used. Although a detailed structure of the metal substrate is not illustrated, an insulating layer is formed on a metal substrate of aluminum, copper or the like, and the UV-LED elements 214 and a wiring circuit (anode wiring, cathode wiring) for driving the LEDs, and the like are formed on the insulating layer. Note that the metal base substrate with a circuit formed on a base metal can be used, or a metal core substrate with a metal board being buried inside the substrate can be used.

Further, to a periphery of the LED elements 214 on the LED mounting surface 221 in the wiring substrate 220, white resist processing with UV resistance and high reflectivity is applied. By the white resist layer (not shown), ultraviolet light can be reflected and scattered on the surface of the wiring substrate 220, and light generated by the UV-LED elements 214 can be efficiently used for UV irradiation for temporary curing.

The light diffusion board 216 is a semiopaque board formed of an optical material that diffuses the light emitted from the UV-LED elements 214 while transmitting the light. For example, for the light diffusion board 216, a white acrylic board with a white pigment (light diffusion substance) being dispersed is used. Without being limited to the white acrylic board, an optical member that is molded with fine particles for light diffusion being dispersed and mixed into a transparent material such as glass can be also used. By changing the content and the average particle size of the light diffusion substance (white pigment or the like), the light diffusion boards with different transmittances and diffusion characteristics can be obtained.

Note that as the transmission type light diffusion board, means that diffuses light is not limited to the means that disperses silica powder into an acrylic resin, but can be also easily realized by applying frost processing, obscure glass processing, ground glass processing and the like to the surface of a substrate made of fused silica.

The transmission type light diffusion board 216 as described above is disposed on a lower portion of the housing 212 to face the LED mounting surface 221 of the wiring substrate 220. In FIG. 7, an undersurface (reference numeral 217) of the light diffusion board 216 is a light emission surface facing the recording medium (not shown). When all the UV-LED elements 214 (six in the case of the present embodiment) are lit, ultraviolet light is emitted with the light application width of not less than the nozzle array width Lw, of the inkjet head 24 from the light emission surface 217 of the light diffusion board 216 onto the recording medium 12.

In the temporary curing light source unit 210 of the present embodiment, the LED array in which the six UVLED elements 214 are aligned in the X direction is divided into two regions. Namely, the plurality of the UV-LED elements 214 that are aligned along the X direction are divided into the two regions that are a region 224-1 at the upstream side in the recording medium transporting direction (X direction) and a region 224-2 at the downstream side, and the three UV-LED elements 214 are included in each of the divided regions 224-1 and 224-2.

In an inside of the housing 212, a partitioning member 226 with a light blocking effect is arranged as a range restricting member for partitioning the above-described regions of the LED element array divided into two so as to provide a structure in which the light of the UV-LED elements 214 in one of the regions does not enter the other region. In general, the UV-LED elements have wide emission ranges and the property of propagating while broadening, and by the structure that covers the periphery of the LED elements with the partitioning member 226 as the present embodiment, the emission region can be divided.

Further, for each of the divided regions 224-1 and 224-2, the light emission amount of the UV-LED elements 214 in each of the regions can be controlled. For example, at the time of layer formation with the white ink, the three UV-LED elements 214 that belong to the region 224-1 at the upstream side are turned off, and the three UV-LED elements 214 that belong to the region 224-2 at the downstream side are turned on.

By the combination of the division of the light emission range by the partitioning member 226 like this and the light emission control of the LED elements that belong to the respective regions 224-1 and 224-2, the emission region of ultraviolet light can be divided, and the light quantities of the respective divided emission regions can be individually controlled.

Namely, the first configuration embodiment shown in FIG. 7 and FIG. 8 is the LED light source unit of an upper side emission type in which the LED element array is disposed on the upper portion of the light source box, and is configured to perform divided lighting control of the light emitting region of the LEDs to correspond to the divided regions of the nozzle array of the inkjet head 24. Control of the light emission amount includes current value control, pulse width modulation control, on-off control and the like. Control of the light emission amount can be performed by a configuration adopting any one of a current control device that controls a current value, a pulse width modulation control device that performs pulse width modulation control, and an on-off control device that performs on-off control, or a proper combination of these devices.

Without being limited to the configuration illustrated in FIG. 7 and FIG. 8, the emission regions at the upstream side and the downstream side can be switched, by providing an aluminum board with high reflectivity that determines the emission region, on an undersurface of the housing 212, and shifting the frame of the aluminum board. Alternatively, a mode of changing the emission region by replacing the frame of the aluminum board with high reflectivity is also possible. In this case, the emission range is restricted by the aluminum board with high reflectivity, and therefore, the aluminum board corresponds to a "range restricting member". Besides, a mode of restricting the emission region by providing a mechanical shutter, a liquid crystal shutter or the like that restricts the light emission range is also possible.

<Second Configuration Embodiment of Temporary Curing Light Source Unit>

Figure 9:
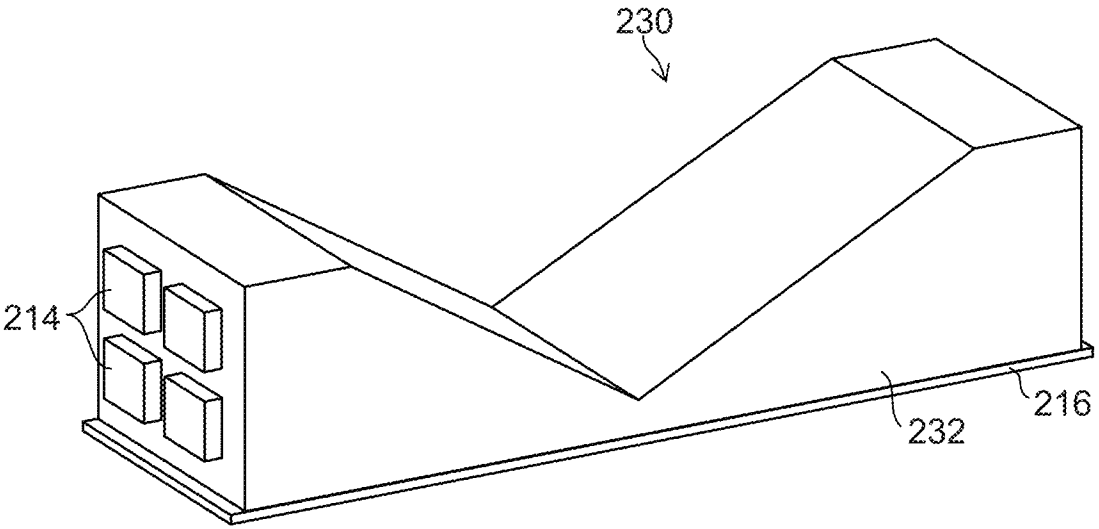
FIG. 9 is a perspective view of a temporary curing light source unit according to a second configuration embodiment.
Figure 10:
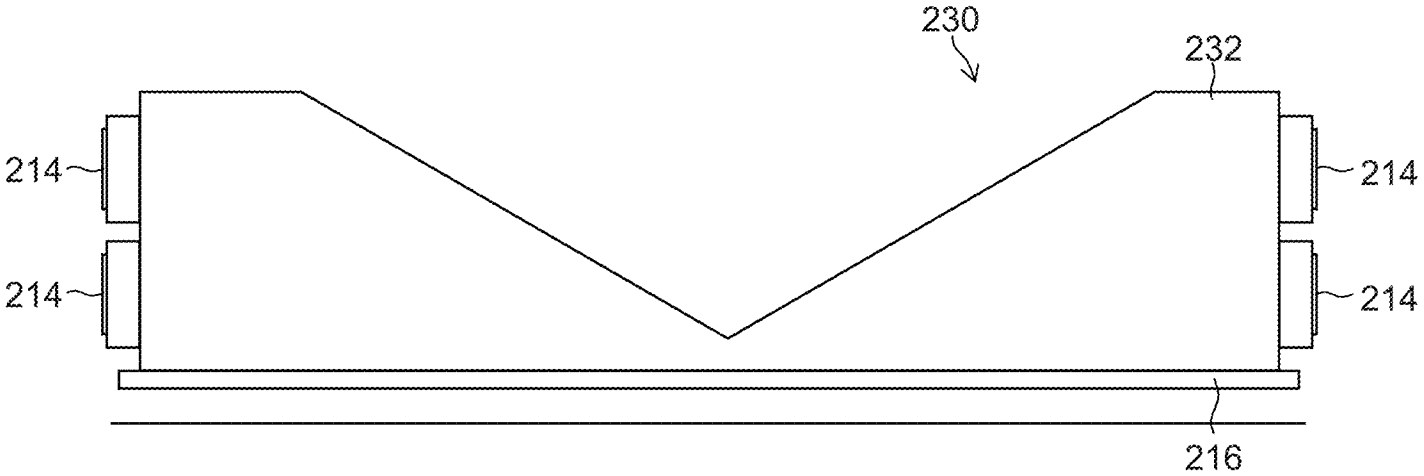
FIG. 10 is a side view of the temporary curing light source unit shown in FIG. 9.
Figure 11:
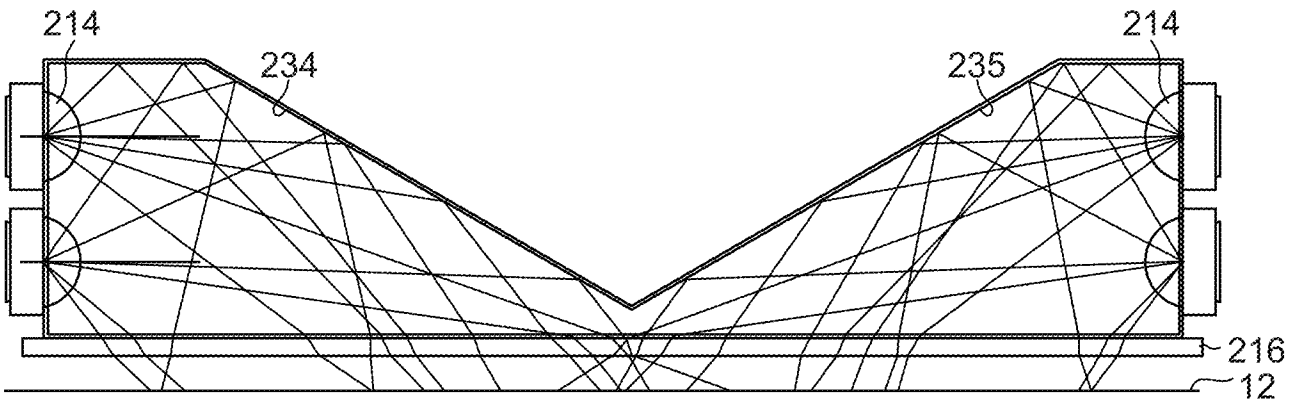
FIG. 11 is a perspective view illustrating rays in an inside of the temporary curing light source unit shown in FIG. 9.

FIG. 9 is a perspective view of a temporary curing light source unit according to a second configuration embodiment. FIG. 10 is a side view, and FIG. 11 is a perspective view of an inside. In the drawings, the same or similar elements to those in the first configuration embodiment described in FIG. 7 and FIG. 8 are denoted with the same references, and the description thereof will be omitted.

The temporary curing light source unit 230 shown in FIG. 9 to FIG. 11 has a structure of a light source box in which the UV-LED elements 214 are disposed on both end faces at an upstream side and a downstream side, and a light emission region is selectable according to the LED elements that are lit. An inner surface of a housing 232 includes reflection surfaces 234 and 235 by aluminization, and the light that is reflected on the inner surface of the housing 232 is applied to the recording medium 12.

Light emission control is performed respectively for a UV-LED element 214 group that is disposed on the end face at the upstream side (the right-hand side in FIG. 10) and a UV-LED element 214 group that is disposed on the end face at the downstream side (the left-hand side in FIG. 10), whereby temporary curing light irradiation of the upstream side region corresponding to the image forming range by the upstream side nozzle region (see the reference numeral 61-1 in FIG. 6) of the nozzle array divided into two, and temporary curing light irradiation of the downstream side region corresponding to the image forming range by the downstream side nozzle region (see the reference numeral 61-2 in FIG. 6) are separately controllable.

FIG. 11 is a perspective view illustrating rays at a time when the LED element groups on both end faces at the upstream side and the downstream side are all lit, and ultraviolet light for temporary curing are applied to all the regions in the image forming range corresponding to the entire width (Lw) of the nozzle array (in the case of performing entire face light emission). In FIG. 11, a half of a ceiling face at the left-hand side (downstream side) of the housing 232 is an inclined face with a height gradually becoming lower toward the upstream side. The light emitted from the UV-LED elements 214 disposed on the downstream side end face of the housing 232 is reflected on the inclined ceiling face (reflection face 234), and is guided to the recording medium 12 below.

Similarly, in FIG. 11, a half of the ceiling face at the right-hand side (upstream side) of the housing 232 is an inclined face with a height gradually becoming lower toward the downstream side. The light emitted from the UV-LED elements 214 disposed on the upstream side end face of the housing 232 is reflected on the inclined ceiling face (reflection face 235), and is guided to the recording medium 12 below.

Figure 12B:
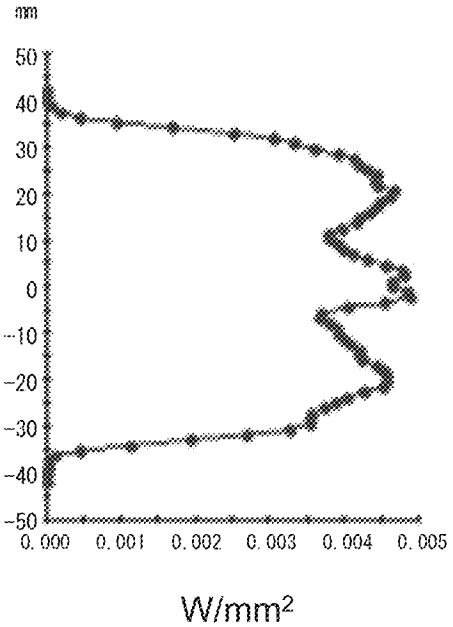
FIG. 12(*a*) is a diagram showing an illuminance distribution on a medium surface at a time of whole surface irradiation explained in FIG. 11, and FIG. 12(*b*) is a graph showing an illuminance distribution section with respect to a medium transporting direction (X direction) in FIG. 12(*a*).
Figure 12A:
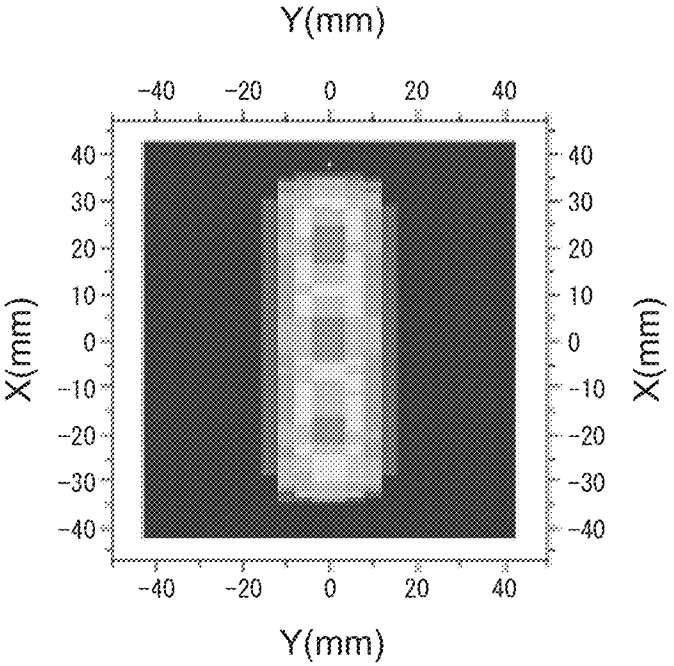

FIG. 12(*a*) is a diagram showing a distribution of an irradiation light quantity (illuminance distribution) on a medium surface at the time of the entire face light emission described in FIG. 11, and FIG. 12(*b*) is a graph showing an illuminance distribution section with respect to the medium transporting direction (X direction) in FIG. 12(*a*). Note that FIG. 12(*b*) shows a distribution on a center line (Y direction center line) of the irradiation region on the medium surface.

Note that the axis of ordinates of FIG. 12(*a*) is an X axis, a plus direction corresponds to the downstream side direction in the recording medium transporting direction, and a minus direction corresponds to an upstream side direction in the recording medium transporting direction.

Figure 13:
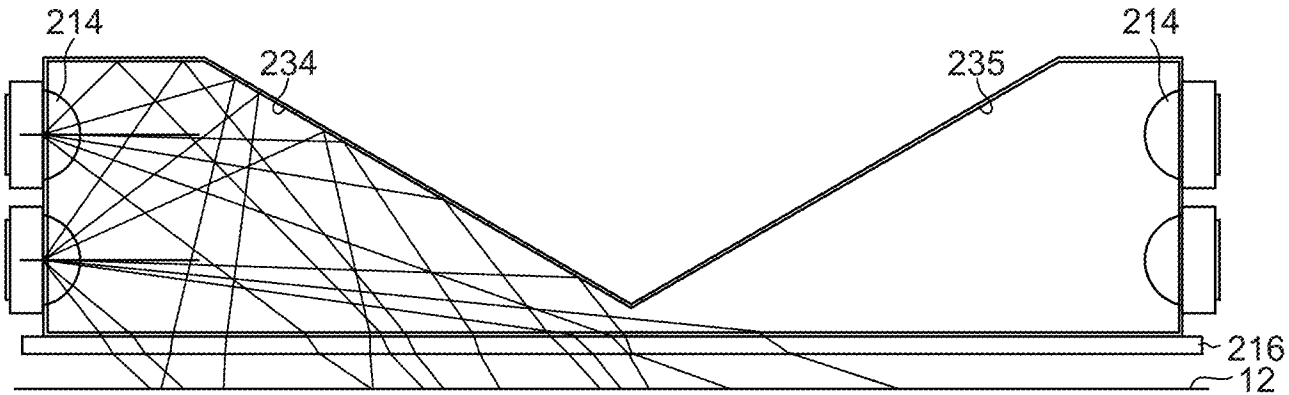
FIG. 13 is a perspective view in a case where light emission is performed only at the downstream side in the temporary curing light source unit according to the second configuration embodiment.

FIG. 13 is a perspective view in a case in which light emission is performed only at the downstream side, in the temporary curing light source unit 230. The UV-LED elements 214 disposed on the end face at one side are turned off, and the UV-LED elements 214 on the end face at the other side are turned on, whereby the emission region can be separately controlled as in FIG. 13. Note that the UV-LED elements 214 disposed on the end face at the downstream side are turned off, and the UV-LED elements 214 disposed on the end face at the upstream side are turned on, whereby the light emission can be performed at only the upstream side.

Figure 14B:
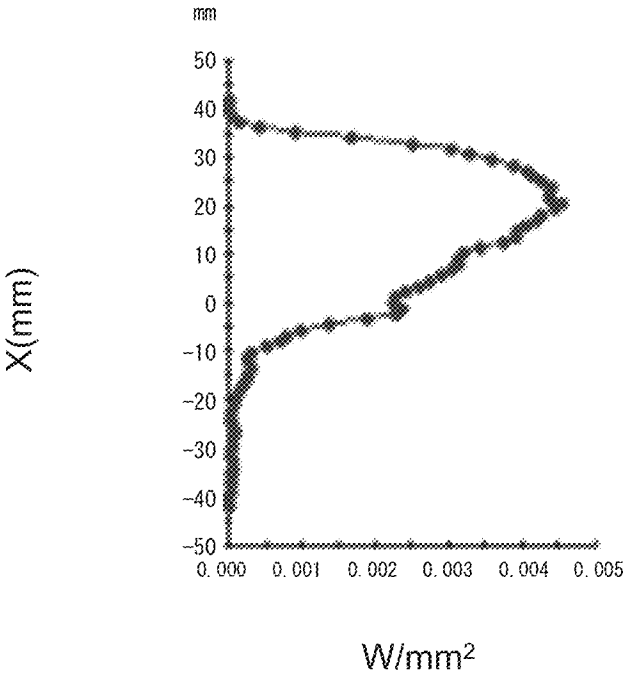
FIG. 14(*a*) is a diagram showing an irradiation distribution on a medium surface when the upstream side is turned on, and the downstream side is turned off in the temporary curing light source unit according to the second configuration embodiment, and FIG. 14(*b*) is a graph showing an illuminance distribution section with respect to the medium transporting direction (X direction) in FIG. 14(*a*).
Figure 14A:
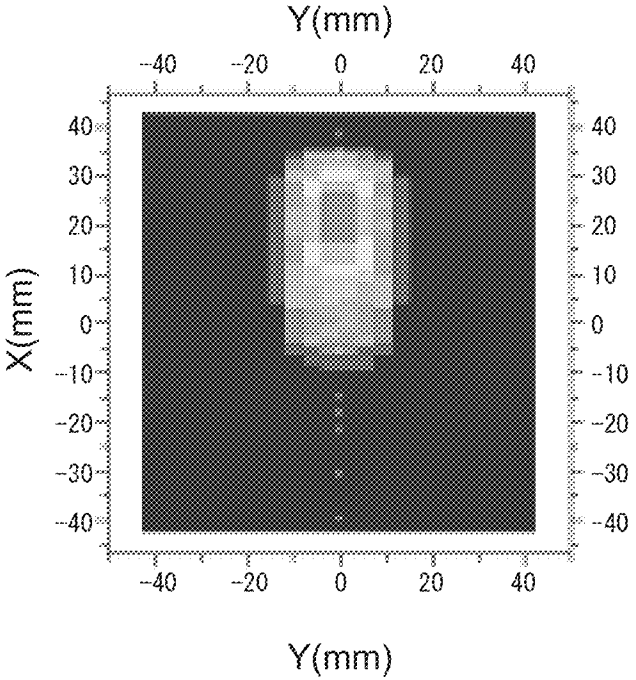

FIG. 14(*a*) shows an irradiation distribution on the medium surface when the upstream side UV-LED elements 214 are turned off and the downstream side UV-LED elements 214 are turned on. FIG. 14(*b*) is a graph showing an illuminance distribution section (distribution on a center line (Y direction center line) of the irradiation region on the medium surface) with respect to the medium transporting direction (X direction) in FIG. 14(*a*).

Figure 15B:
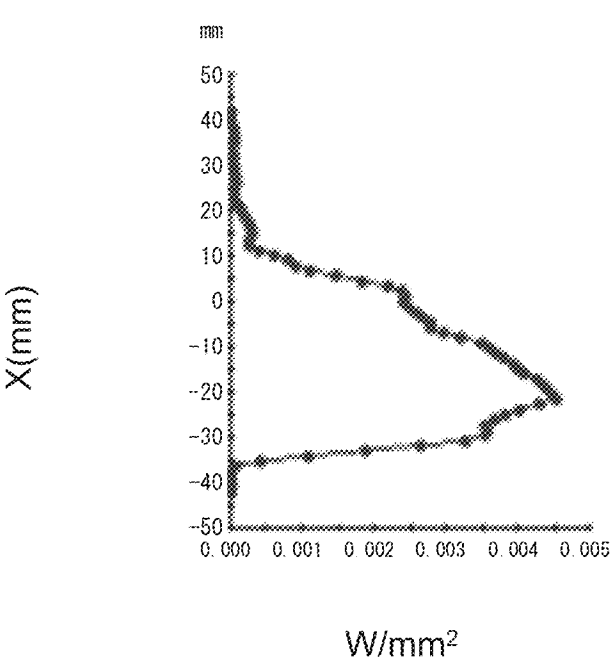
FIG. 15(*a*) is a diagram showing an irradiation distribution on a medium surface when the upstream side is turned off, and the downstream side is turned on in the temporary curing light source unit according to the second configuration embodiment, and FIG. 15(*b*) is a graph showing an illuminance distribution section with respect to the medium transporting direction (X direction) in FIG. 15(*a*).
Figure 15A:
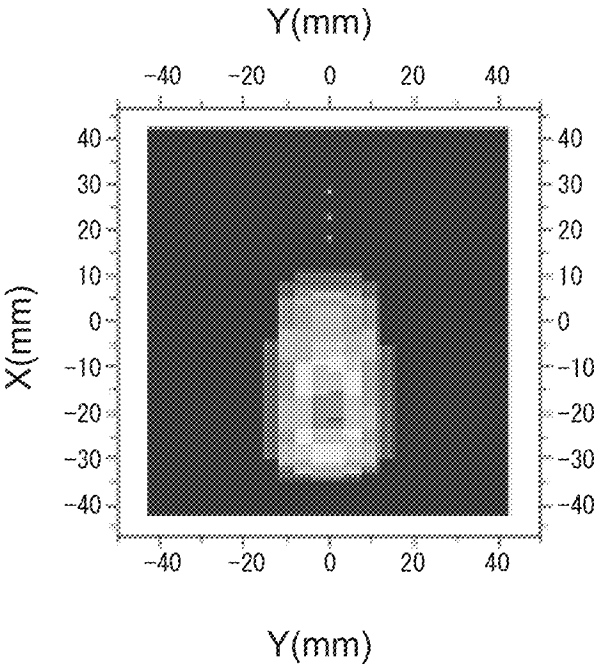

FIG. 15(*a*) shows an irradiation distribution on the medium surface when the upstream side UV-LED elements 214 are turned on and the downstream side UV-LED elements 214 are turned off. FIG. 15(*b*) is a graph showing an illuminance distribution section (distribution on the center line (Y direction center line) of the irradiation region on the medium surface) with respect to the medium transporting direction (X direction) in FIG. 15(*a*).

Figure 16:
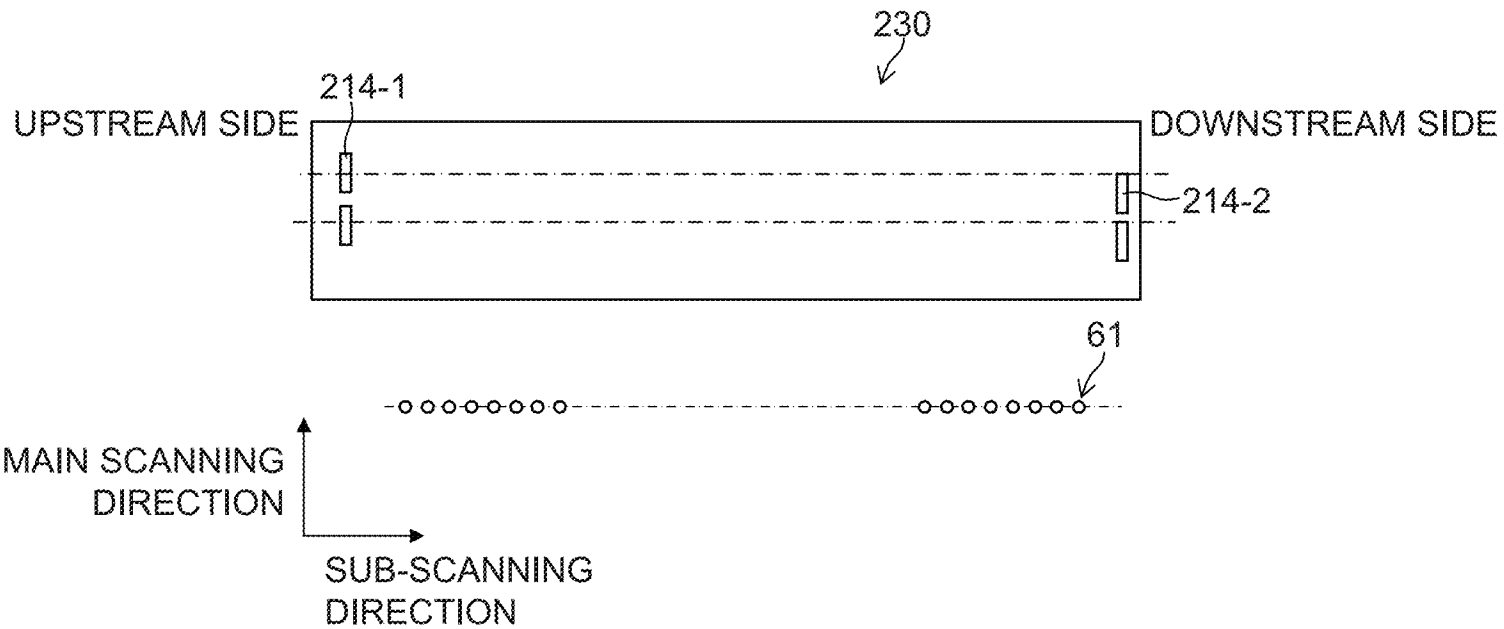
FIG. 16 is a schematic view showing another embodiment of an LED arrangement form in the temporary curing light source unit.

In the temporary curing light source unit 230 of the above-described second configuration embodiment, the UV-LED elements 214 that are respectively disposed on both the end faces at the upstream side and the downstream side can be disposed symmetrically to face to one another, but can be disposed with the positions in the main scanning direction made different from one another as shown in FIG. 16.

FIG. 16 is a schematic view showing another embodiment of the LED arrangement form in the temporary curing light source unit 230 of the second configuration embodiment. In FIG. 16, the left-hand side corresponds to the upstream side in the paper transporting direction, and the right-hand side corresponds to the downstream side, with the temporary curing light source unit 230 therebetween. With respect to the nozzle array 61 in which the nozzles are aligned in the sub-scanning direction (X direction), the UV-LED elements 214-1 disposed on the upstream side end face of the temporary curing light source unit 230, and the UV-LED elements 214-2 disposed on the downstream side end face are disposed at positions with positions in the main scanning direction (Y direction) differing from one another.

According to the configuration as described above, in only the region with a long distance from the nozzles, inks spread more after being deposited and pinned, and therefore, banding streaks or the like become less outstanding. Therefore, curing that is suitable for the white ink and the clear ink is enabled.

<Third Configuration Embodiment of Temporary Curing Light Source Unit>

Figure 17:
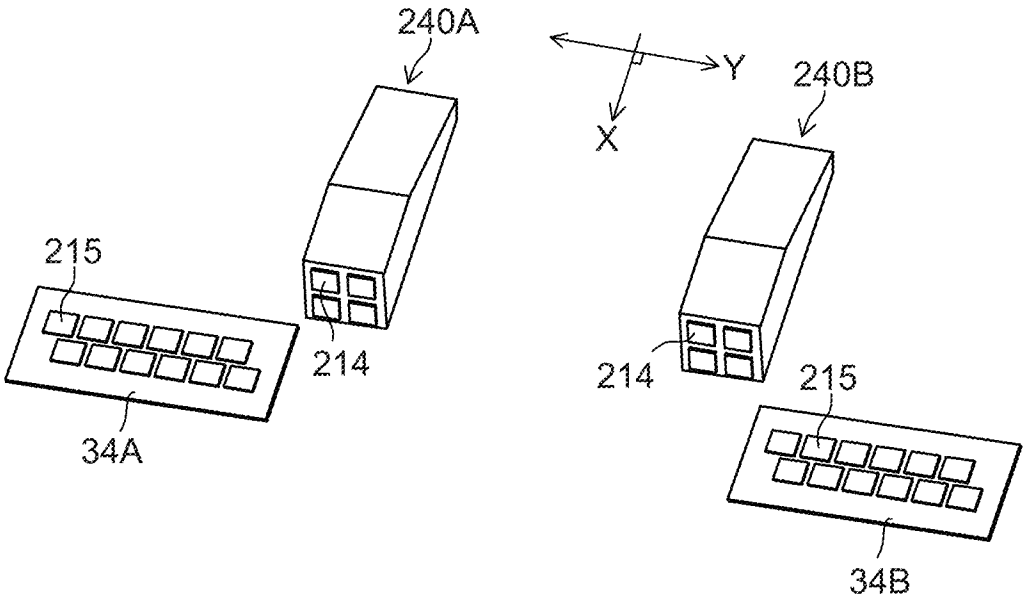
FIG. 17 is a schematic view showing a disposition configuration of the ultraviolet emission parts using temporary curing light source units according to a third configuration embodiment.

FIG. 17 is a schematic view showing a disposition configuration of ultraviolet emission parts using a temporary curing light source unit according to a third configuration embodiment. In FIG. 17, illustration of the inkjet head is omitted, and only a disposition form of temporary curing light source units 240A and 240B and the permanent curing light sources 34A and 34B are shown. Further, in FIG. 17, in order to show a disposition form of respective UV-LED elements 215 that configure the permanent curing light sources 34A and 34B, back sides of the LEDs are shown.

Each of the permanent curing light sources 34A and 34B in FIG. 17 includes twelve of the UV-LED elements 215, and each has a disposition form in which two of LED element arrays with six LEDs being aligned at constant intervals in the Y direction are aligned in the X direction. An LED element group with the disposition of six by two rows is disposed in a staggered state in which the disposition positions of the LED element array at the upstream side in the X direction and the LED element array at the downstream side are shifted in the Y direction. Note that the number and the disposition form of the LEDs that configure the permanent curing light sources 34A and 34B are not limited to this embodiment.

Each of the temporary curing light source units 240A and 240B shown in FIG. 17 has a structure of a light source box in which a plurality of UV-LED elements 214 are disposed on an end face at the downstream side in the X direction, and the light emission region is selectable by the LEDs that are lit. In this case, as each of the temporary curing light source units 240A and 240B, an embodiment is shown, in which four of the UV-LED elements 214 are disposed in an arrangement form of two by two with vertical two rows and lateral two rows, but the number and the disposition form of the LEDs are not limited to this embodiment.

Figure 18:
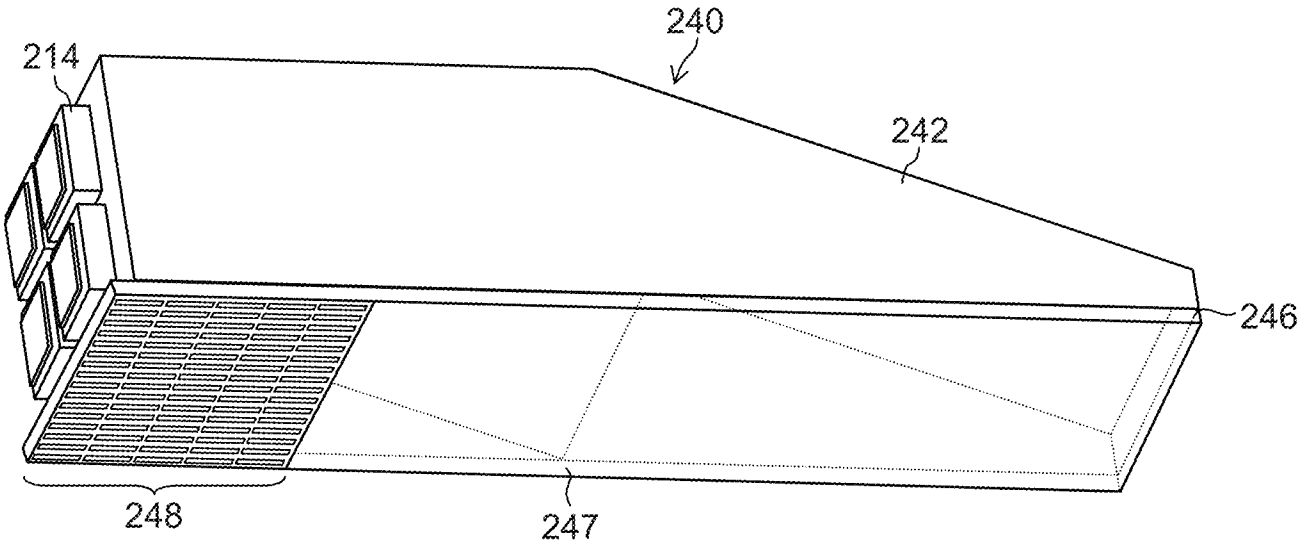
FIG. 18 is a perspective view of the temporary curing light source unit according to the third configuration embodiment seen from an undersurface side.

FIG. 18 is a perspective view of the temporary curing light source unit 240A or 240B seen from the undersurface side. One of the temporary curing light source units 240A and 240B common in structure is shown in FIG. 18 by being denoted with reference numeral 240. On a region near the UV-LED elements 214, of a light emission surface 247 of a light diffusion board 246 disposed on a bottom face of a housing 242, a pattern 248 for regulating a light quantity distribution is formed.

Figure 19:
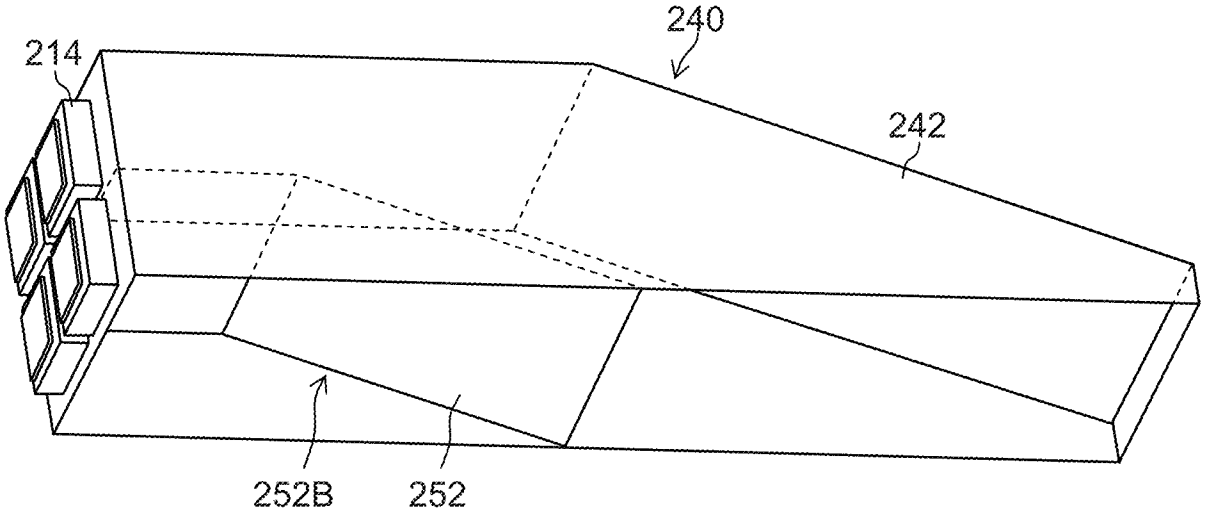
FIG. 19 is a view showing a structure inside a housing of the temporary curing light source unit according to the third configuration embodiment.
Figure 20:
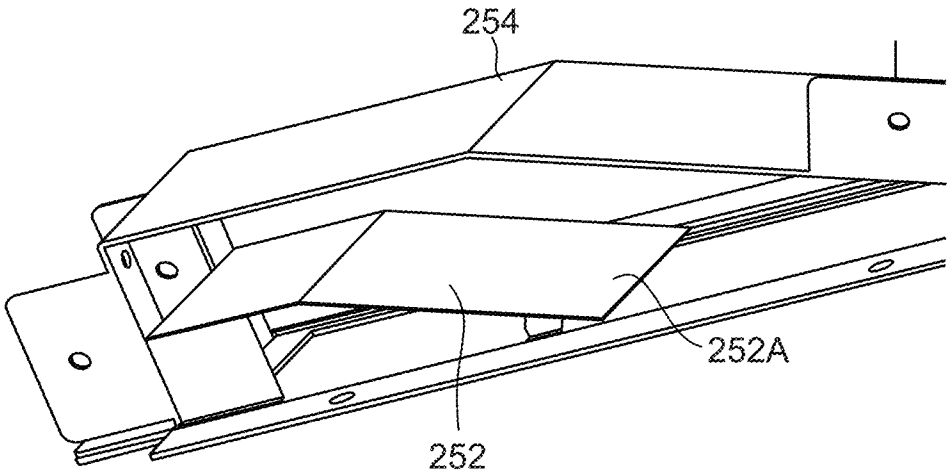
FIG. 20 is a perspective view showing an embodiment of a dividing component (mirror member) disposed inside the housing.

FIG. 19 shows an internal structure of the housing 242. In FIG. 19, illustration of the light diffusion board 246 is omitted. As shown in FIG. 19, in the housing 242, a mirror member 252 as a dividing component that separates light transmission spaces of the UV-LED elements 214 that are aligned vertically. FIG. 20 is a perspective view showing an embodiment of the dividing component (the mirror member 252) that is disposed inside of the housing 242. As shown in FIG. 19 and FIG. 20, the inside of the temporary curing light source unit 240 (light source box) is of a double-ceiling structure partitioned by the mirror member 252. A surface 252A on an upper side and a surface 252B on a lower side of the mirror member 252 both function as reflection faces. Further, a ceiling face (a surface on an inner side of the housing 242) of a frame member 254 that configures the housing 242 also functions as a reflection face.

Figure 21:
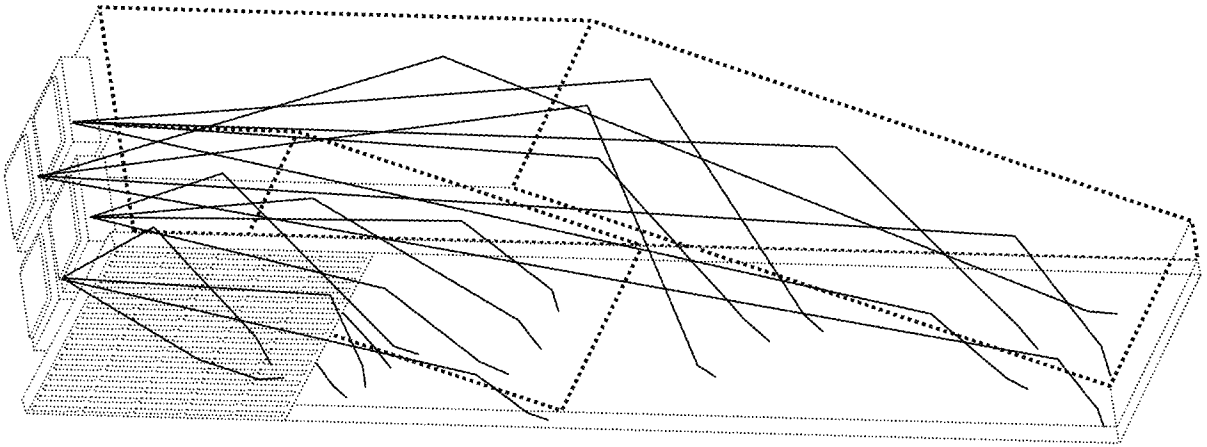
FIG. 21 is a perspective view showing rays at a time of whole surface irradiation, in the temporary curing light source unit according to the third configuration embodiment.
Figure 22:
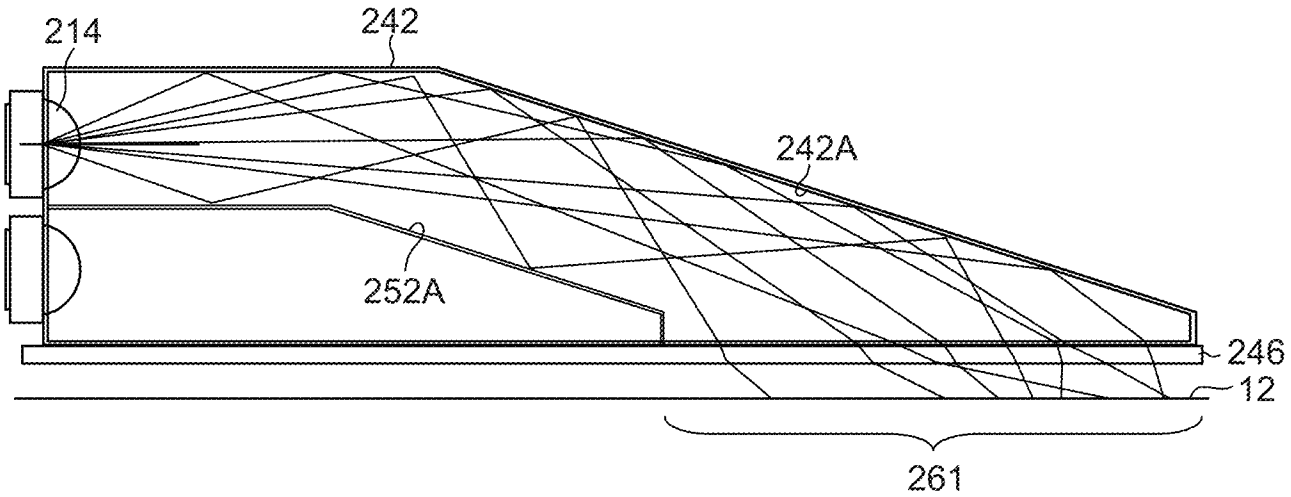
FIG. 22 is a perspective view showing a state at a time of irradiation of only the upstream side, in the temporary curing light source unit according to the third configuration embodiment.

FIG. 21 is a perspective view showing rays at a time of entire face light emission in the temporary curing light source unit 240. FIG. 22 is a perspective view showing a state at a time of light emission of only the upstream side, and FIG. 23 is a perspective view showing a state at a time of light emission of only the downstream side.

The light that is emitted from the two UV-LED elements 214 disposed on the upper row out of the four UV-LED elements 214 that are disposed on the one side end face in the X direction of the housing 242 is reflected on the top surface side (252A) of the mirror member 252 and a ceiling surface 242A of the housing 242, and is guided onto the recording medium 12, as shown in FIG. 22. An emission region 261 by the upper row LEDs is a region at the upstream side in the X direction, of the entire emission range of the temporary curing light source unit 240.

Figure 23:
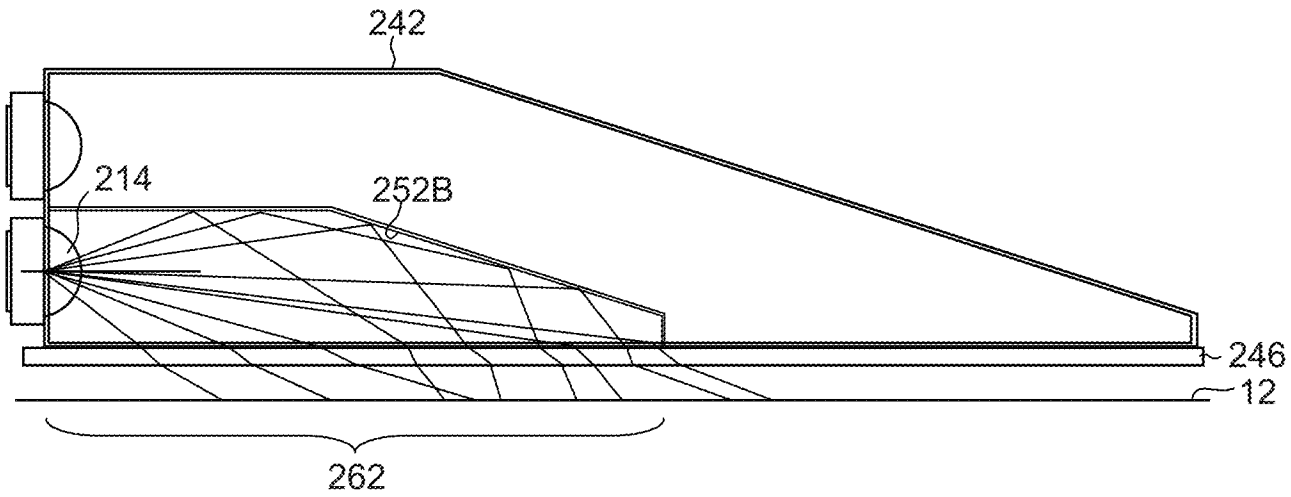
FIG. 23 is a perspective view showing a state at a time of irradiation of only the downstream side, in the temporary curing light source unit according to the third configuration embodiment.

Meanwhile, the light that is emitted from the two UV-LED elements 214 that are disposed on the lower row, out of the four UV-LED elements 214, is reflected on the undersurface side (252B) of the mirror member 252, and is applied onto the recording medium 12, as shown in FIG. 23. An emission region 262 by the lower row LEDs is a region at the downstream side in the X direction, of the entire emission range of the temporary curing light source unit 240.

As described above, by disposition of the mirror member 252, the emission region of ultraviolet light is divided into the two regions at the upstream side and the downstream side, and the respective emission regions correspond to the divided regions of the nozzle array (see reference numerals 61-1 and 61-2 in FIG. 6). According to the above-described configuration, such light quantity control is possible that when the white ink layer to be a foundation is deposited with the nozzles (reference numeral 61-1) at the upstream side, pinning light is not applied in the half at the upstream side, or the pinning light quantity is made a smaller light quantity than that in the half at the downstream side, so that the landed ink spreads on the recording medium 12.

Figure 24B:
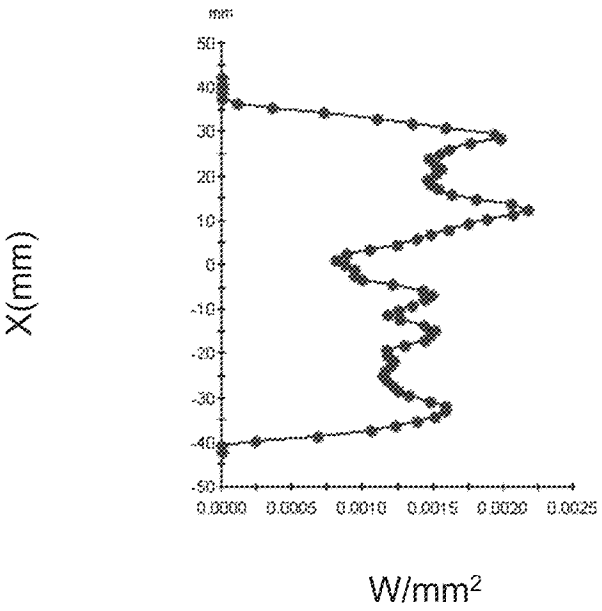
FIG. 24(*a*) is a diagram showing an irradiation distribution on a medium surface at the time of whole surface irradiation in the temporary curing light source unit according to the third configuration embodiment, and FIG. 24(*b*) is a graph showing an illuminance distribution section with respect to the medium transporting direction (X direction) in FIG. 24(*a*).
Figure 24A:
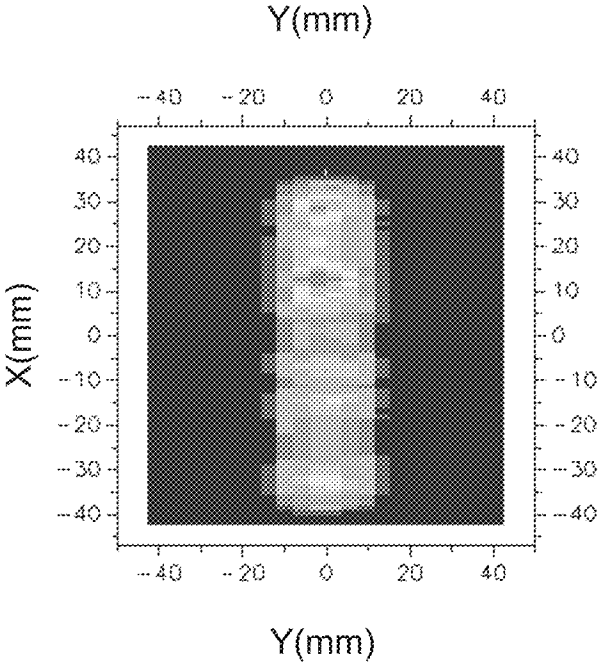

FIG. 24(*a*) is a diagram showing an irradiation distribution on the medium surface at the time of entire face light emission in the temporary curing light source unit 240 according to the third configuration embodiment, and FIG. 24(*b*) is a graph showing an illuminance distribution section (distribution on a center line (Y direction center line) of the irradiation region on the medium surface) with respect to the medium transporting direction (X direction) in FIG. 24(*a*).

Figure 25B:
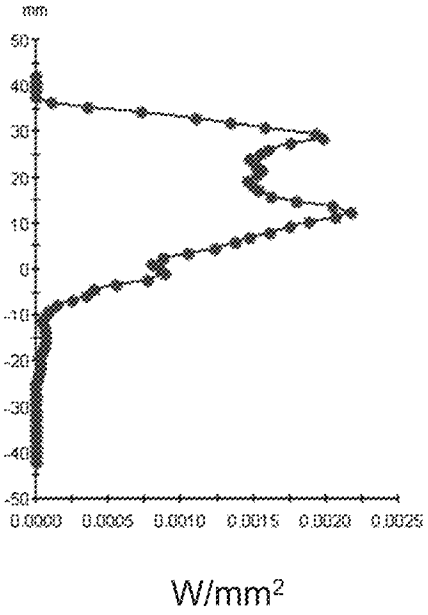
FIG. 25(*a*) is a diagram showing an irradiation distribution on a medium surface when the upstream side is turned on, and the downstream side is turned off in the temporary curing light source unit according to the third configuration embodiment, and FIG. 25(*b*) is a graph showing an illuminance distribution section with respect to the medium transporting direction (X direction) in FIG. 25(*a*).
Figure 25A:
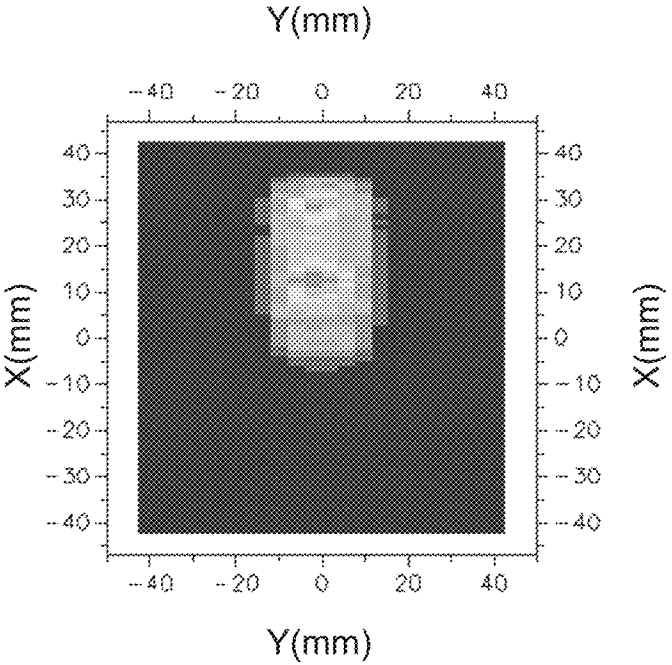

FIG. 25(*a*) shows an irradiation distribution on the medium surface when the downstream side is turned on and the upstream side is turned off. FIG. 25(*b*) is a graph showing an illuminance distribution section (distribution on the center line (the center line in the Y direction) of the irradiation region on the medium surface) with respect to the medium transporting direction (X direction) in FIG. 25(*a*).

Figure 26B:
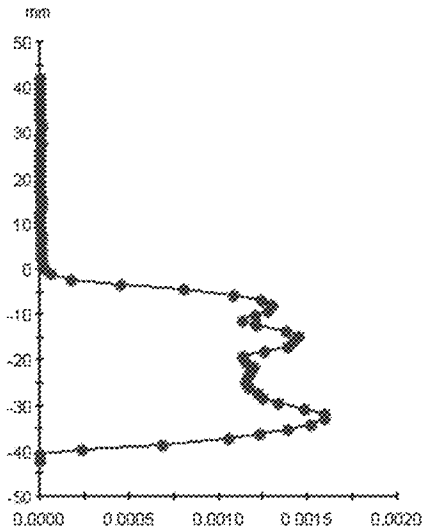
FIG. 26(*a*) is a diagram showing an irradiation distribution on a medium surface when the upstream side is turned on, and the downstream side is turned off in the temporary curing light source unit according to the third configuration embodiment, and FIG. 26(*b*) is a graph showing an illuminance distribution section with respect to the medium transporting direction (X direction) in FIG. 26(*a*).
Figure 26A:
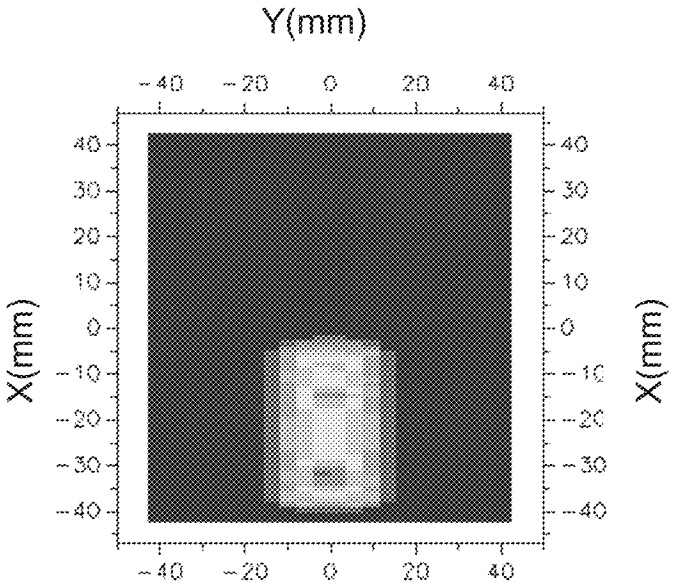

FIG. 26(*a*) shows an irradiation distribution on the medium surface when the downstream side is turned off and the upstream side is turned on. FIG. 26(*b*) is a graph showing an illuminance distribution section (distribution on the center line (the center line in the Y direction) of the irradiation region on the medium surface) with respect to the medium transporting direction (X direction) in FIG. 26(*a*).

Second Specific Embodiment

Figure 27:
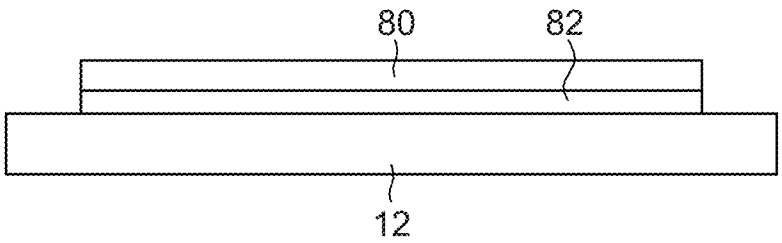
FIG. 27 is an explanatory view schematically illustrating a layer structure of an image formed by an image forming process according to a second specific embodiment.
Figure 28:
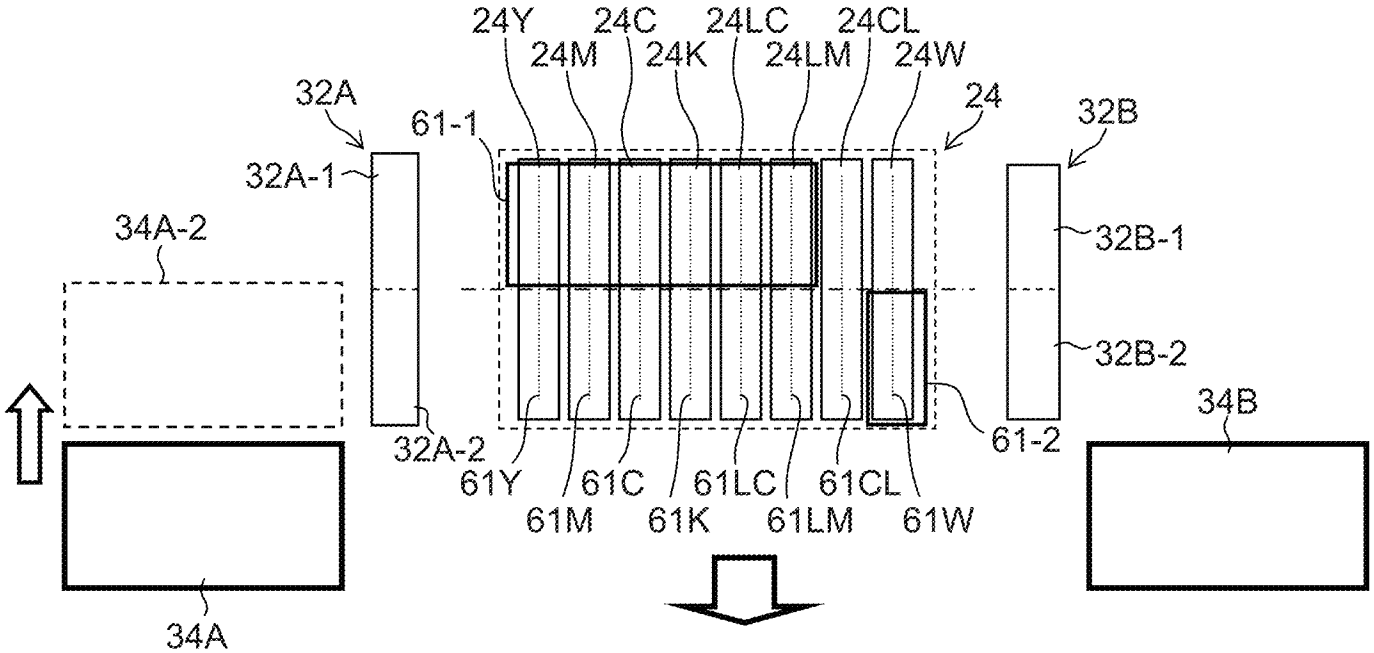
FIG. 28 is an explanatory view schematically showing a configuration embodiment of the inkjet head and the ultraviolet emission parts for forming the image shown in FIG. 27.

FIG. 27 is an explanatory view schematically illustrating a layer structure of an image formed by an image forming process according to a second specific embodiment, and FIG. 28 is an explanatory view schematically illustrating a configuration of the inkjet head 24 for forming an image having a layer structure shown in FIG. 27, and disposition of the permanent curing light sources 34A and 34B. In the following description, the same or similar parts to the above-described parts are denoted with the same references, and the description thereof is omitted.

In the image shown in FIG. 27, the number of image forming layers is two, the color image layer 82 is formed on the transparent recording medium 12, and the white layer 80 is formed on the color image layer 82. In the image having the structure like this, the color image layer 82 can be visually recognized with the white layer 80 as the background seen from the rear surface (the surface at the opposite side from the surface where the image is formed) of the recording medium 12.

Step 1 is a forming step of the color image layer 82, the permanent curing light source 34A at the left-hand side in FIG. 28 is moved to the ejection position of the white ink (position aligned in the carriage moving direction, with the downstream side region 61-2 of the nozzle array 61W) illustrated with the broken line by being denoted with reference 34A-2 (the moving direction is illustrated with the upward arrow line). Subsequently, the carriage 30 is caused to scan in the carriage moving direction, and the color inks are deposited onto the recording medium 12 from the upstream side regions 61-1 of the nozzle arrays 61Y, 61M, 61C, 61K, 61LC and 61LM. Further, from the temporary curing light sources 32A and 32B following the nozzle arrays 61Y, 61M, 61C, 61K, 61LC and 61 LM, ultraviolet light of a small light quantity (1 to 5 mJ/cm$^2$ per one time of scan of the carriage) are applied to the color inks immediately after landed on the recording medium 12 by scan of the carriage of one time, and the color inks are temporarily cured and are brought into a gel state. By doing so, landing interference of the color inks is prevented.

Step 2 is a time period from the forming step of the color image layer 82 until a forming step of the white layer 80, adhesion and affinity of the recording medium 12 and the color image layer 82 are enhanced by the temporarily cured state being kept for a predetermined time period, spread of the dots is promoted while reduction in pile height is promoted, and glossiness of the color image is further enhanced.

Step 3 is the forming step of the white layer 80. In the ejection position of the white ink (on the color image layer 82 that is already formed) at the downstream side by (Lw/2) in the recording medium transporting direction from the ejection position of the color inks on the recording medium 12, the carriage 30 (see FIG. 3) is caused to scan in the carriage moving direction, and from only the downstream side region 61-2 of the nozzle array 61W, the white ink is deposited onto the color image layer 82 in the temporarily cured state. Subsequently, from the permanent curing light source 34A that follows the nozzle array 61W and scans in the carriage moving direction, ultraviolet light of a large light quantity (10 mJ/cm$^2$ per one time of scan of the carriage) equivalent to that in the permanent curing processing or more by scan of the carriage of one time are applied to the white ink immediately after being landed on the recording medium 12, and the color image layer 82 in the temporarily cured state under the white ink, and the white layer 80 (see FIG. 29) is formed, while curing of the color image layer 82 is promoted.

Control of the emission regions of the temporary curing light sources 32A and 32B with respect to the white layer 80 is similar to that described in the first specific embodiment.

Step 4 is a permanent curing processing step, in which permanent curing processing is applied to the white layer 80 and the color image layer 82 with use of the permanent curing light source 34B disposed at the downstream side in the recording medium transporting direction of the inkjet head 24. The ultraviolet light quantity in such permanent curing processing is 10 mJ/cm$^2$ per scan of the carriage of one time. By permanently curing the white layer 80 and the color image layer 82, glossiness of the color image layer 82 is more enhanced, and improvement in adhesiveness of the white layer 80 and the color image layer 82 and curing of film quality of the color image layer 82 are made compatible.

Third Specific Embodiment

Figure 29:
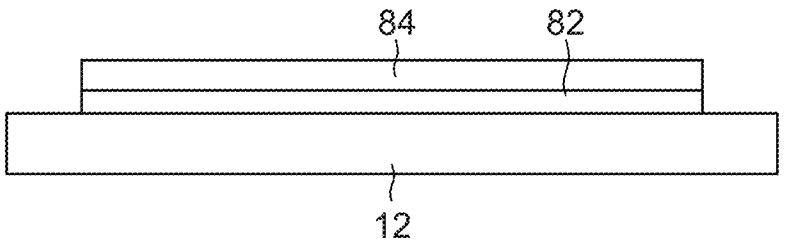
FIG. 29 is an explanatory view schematically illustrating a layer structure of an image according to a third specific embodiment.
Figure 30:
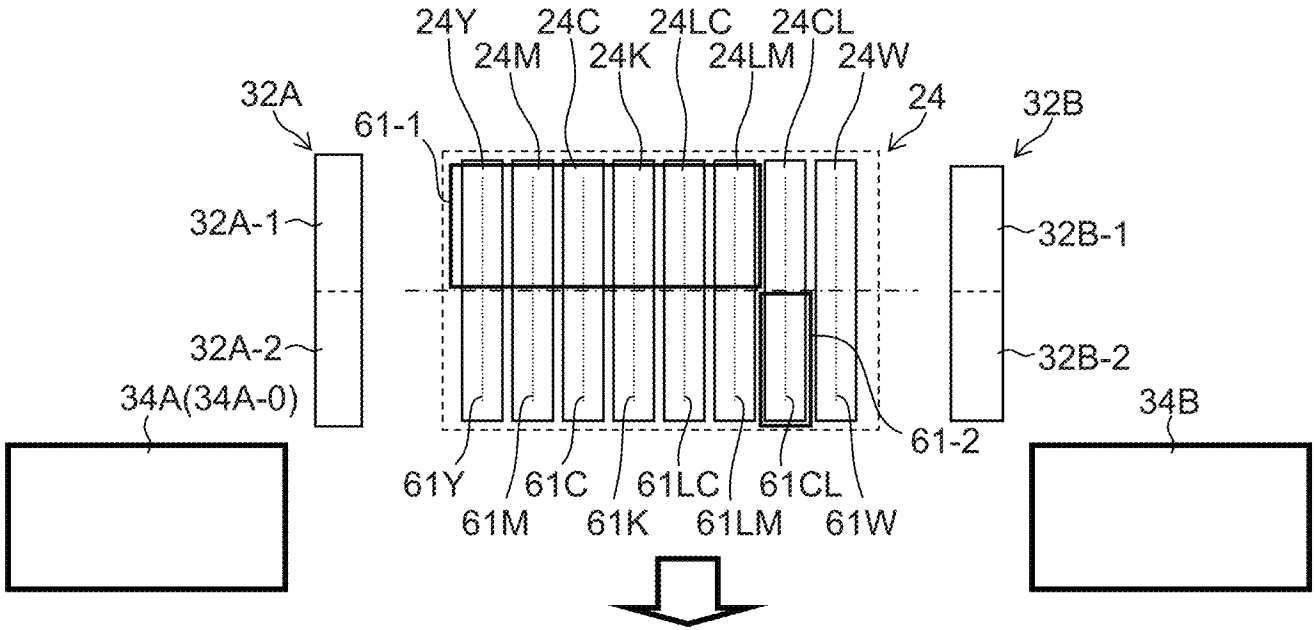
FIG. 30 is an explanatory view showing a configuration embodiment of the ultraviolet emission parts for forming the image shown in FIG. 29.

FIG. 29 is an explanatory view schematically illustrating a layer structure of an image formed by an image forming process according to a third specific embodiment, and FIG. 30 is an explanatory view schematically illustrating a configuration of the inkjet head 24 for forming an image having the layer structure shown in FIG. 29, and disposition of the permanent curing light sources 32A and 34B. In the image shown in FIG. 29, the number of image forming layers is two, the color image layer 82 is formed on the recording medium 12, and the transparent layer 84 is formed on the color image layer 82.

Step 1 is a forming step of the color image layer 82, in which the carriage 30 is caused to scan in the carriage moving direction while the permanent curing light source 34A is not moved and remains to be disposed at the downstream side in the recording medium transporting direction of the inkjet head 24 (illustrated by being denoted with reference 34A-0 in FIG. 30), and the color inks are deposited onto the recording medium 12 from the upstream side regions 61-1 of the nozzle arrays 61Y, 61M, 61C, 61K, 61LC and 61LM. Further, from the temporary curing light sources 32A and 32B following the nozzle arrays 61Y, 61M, 61C, 61K, 61LC and 61LM, ultraviolet light of a small light quantity (1 to 5 mJ/cm$^2$ per one time of scan of the carriage) are applied to the color inks immediately after being landed on the recording medium 12 by scan of the carriage of one time to temporarily cure the color inks and bring the color inks into a gel state. By doing so, landing interference of the color inks is prevented.

Step 2 is a forming step of the transparent layer 84, in which in the ejection position (onto the color image layer 82 already formed) of the clear ink at the downstream side by (Lw/2) in the recording medium transporting direction from the deposition position of the color inks on the recording medium 12, the carriage 30 is caused to scan in the carriage moving direction, and the clear ink is deposited onto the color image layer 82 in the temporary cured state from the downstream side region 61-2 of the nozzle array 61CL. Further, from the temporary curing light sources 32A and 32B following the nozzle array 61CL, ultraviolet light of a small light quantity (smaller light quantity than pinning irradiation light to the color image layer 82) are applied to the clear ink immediately after being landed on the color image layer 82, by scan of the carriage of one time. Alternatively, pinning irradiation is not carried out for the clear ink. Thereby, wetted spreading of the clear ink is promoted, and flattening and uniformization of the transparent layer can be achieved.

Step 3 is a time period from the forming step until a permanent curing processing step of the color layer 82, in which a portion where the transparent layer 84 is stacked on the color image layer 82 at the downstream side by (Lw/2) further in the recording medium transporting direction from the deposition position of the color inks on the recording medium 12, is out of the ejection position of the nozzle array 61, and is located in the ultraviolet irradiation area by the permanent curing light source 34B. The temporarily cured state of the clear ink is kept for a predetermined time period, whereby penetration into the color image layer 82, spread of dots, and reduction in pile height are promoted. Further, the glossiness of the color image layer 82 is more enhanced, adhesion of the recording medium 12 and the color image layer 82, and adhesion of the color image layer 82 and the transparent layer 84 are also improved.

Step 4 is a permanent curing processing step, in which with use of the permanent curing light sources 34A and 34B that are disposed at the downstream side in the recording medium transporting direction of the inkjet head 24, the carriage 30 is caused to scan in the carriage moving direction, and the permanent curing processing is applied to the color image layer 82 and the transparent layer 84. The ultraviolet light quantity in the permanent curing processing like this is 10 mJ/cm$^2$ or more per one time scan of the carriage. The color image layer 82 and the transparent layer 84 are permanently cured, whereby adhesiveness of the recording medium 12 and the color image layer 82 is more improved, with which curing of film quality of the color image layer 82 is made compatible.

Fourth Specific Embodiment

Figure 31:
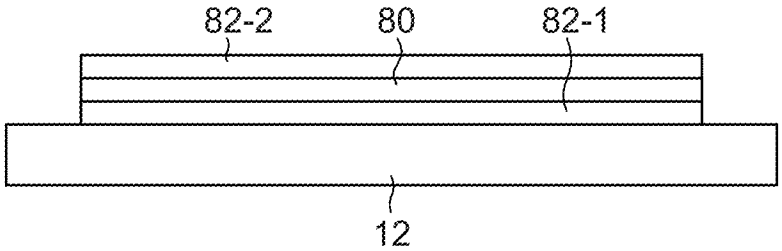
FIG. 31 is an explanatory view schematically illustrating a layer structure of an image according to a fourth specific embodiment.
Figure 32:
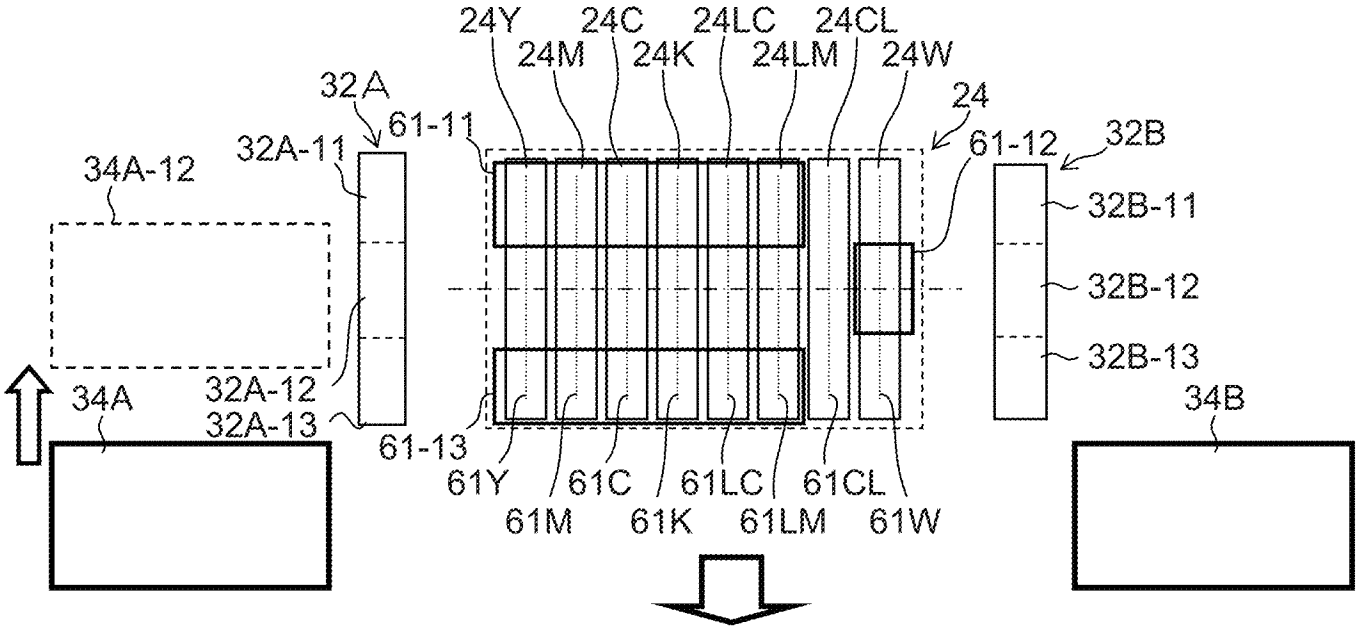
FIG. 32 is an explanatory view showing a configuration embodiment of the ultraviolet emission parts for forming the image shown in FIG. 31.

FIG. 31 is an explanatory view schematically illustrating a layer structure of an image formed by an image forming process according to a fourth specific embodiment. FIG. 32 is an explanatory view schematically illustrating a configuration of the inkjet head 24 for forming the image having the layer structure shown in FIG. 31, and disposition of the permanent curing light source 34A. The image shown in FIG. 31 has a structure in which the number of image forming layers is three, and the respective layers are stacked on the transparent recording medium 12 in sequence of a first color image layer 82-1, the white layer 80, and a second color image layer 82-2. Namely, the image has the structure in which the white layer 80 is arranged between the upper and lower color image layers 82-1 and 82-2. In the image having the structure like this, the color image layer 82 with the white layer 80 as a background is visually recognized from both faces of the recording medium 12.

As shown in FIG. 32, each of the nozzle arrays 61 is divided into three that are an upstream side region 61-11, a central region 61-12 and a downstream side region 61-13, the color inks are ejected from only the upstream side regions 61-11 and the downstream side regions 61-13 of the nozzle arrays 61Y, 61M, 61C, 61K, 61LC and 61LM, and the white ink is ejected from only the central region 61-12 of the nozzle array 61W.

Namely, when the color image layer 82-1 is formed with the color inks ejected from the upstream side regions 61-11 of the nozzle arrays 61Y, 61M, 61C, 61K, 61LC and 61LM, the white layer 80 with the white ink ejected from the central region 61-12 of the nozzle array 61W is formed (stacked) on the color image layer 82-1 in the ejection position of the white ink at the downstream side by a distance (Lw/3) in the recording medium transporting direction on the recording medium 12, and further in an ejection position of the color inks at the downstream side by the distance (Lw/3) in the recording medium transporting direction of the recording medium 12, the color image layer 82-2 is formed (stacked) with the color inks ejected from the downstream side regions 61-13 of the nozzle arrays 61Y, 61M, 61C, 61K, 61LC and 61LM.

In each of the temporary curing light sources 32A and 32B, the emission region is divided into three in the X direction in correspondence with image forming ranges of the respective divided nozzle regions (the upstream side region 61-11, the central region 61-12, and the downstream side region 61-13) of each of the above-described nozzle arrays divided into three, and control of the light quantity is enabled for each of division units (divided emission regions) denoted with references 32A-11, 32A-12, 32A-13, 32B-11, 32B-12 and 32B-13 in FIG. 32.

Further, the permanent curing light source 34A is moved to the ejection position of the white ink (position aligned in the carriage moving direction, with the central region 61-12 of the nozzle array 61W that ejects the white ink), which is illustrated with the broken line by being denoted with reference 34A-12, and ultraviolet light of a large light quantity (10 mJ/cm$^2$ per one time scan of the carriage) equivalent to that of the permanent curing processing or more by scan of the carriage of one time are applied to the white ink immediately after being landed on the recording medium 12. Note that the X direction light application width of the permanent curing light source 34A is set as a width corresponding to the divided nozzle region (reference numeral 61-12).

Meanwhile, after temporary curing processing by ultraviolet irradiation of 1 to 5 mJ/cm$^2$ per one time scan of the carriage from the temporary curing light sources 32A and 32B, permanent curing processing by ultraviolet irradiation of 10 mJ/cm$^2$ or more per one time scan of the carriage is applied to the color inks from the permanent curing light source 34B (or the permanent curing light source 34A).

Step 1 of the image forming process is a forming step of the color image layer 82-1, in which the permanent curing light source 34A is moved to the ejection position of the white ink, the carriage 30 is caused to scan in the carriage moving direction, and the color inks are deposited onto the recording medium 12 from the upstream side regions 61-11 of the nozzle arrays 61Y, 61M, 61C, 61K, 61LC and 61LM. Further, from the temporary curing light sources 32A and 32B following the nozzle arrays 61Y, 61M, 61C, 61K, 61LC and 61LM, ultraviolet light of a small light quantity (1 to 5 mJ/cm$^2$ per one time scan of the carriage) are applied to the color inks immediately after being landed on the recording medium 12 by scan of the carriage of one time to temporarily cure the color inks and bring the color inks into a gel state. By doing so, landing interference of the color inks is prevented.

Step 2 is a time period from the forming step of the color image layer 82-1 until a forming step of the white layer 80, in the portion where the color image layer 82 is formed, the temporarily cured state is kept for a constant time period, whereby adhesion of the color image layer 82-1 and the recording medium 12 is enhanced, and spread of dots and reduction in pile height are promoted.

Step 3 is the forming step of the white layer 80, in which in the white ink ejection position at the downstream side by (Lw/3) in the recording medium transporting direction from the deposition position of the color inks on the recording medium 12, the carriage 30 is caused to scan in the carriage moving direction, and the white ink is deposited from only the central region 61-12 of the nozzle array 61W onto the color image layer 82-1 in the temporarily cured state. Subsequently, from the permanent curing light source 34A that scans by following the nozzle array 61W, ultraviolet light of a large light quantity (10 mJ/cm$^2$ or more per one time scan of the carriage) equivalent to that of the permanent curing processing are applied by scan of the carriage of one time, to the white ink immediately after being landed on the recording medium 12, and the color image layer 82-1 in the temporarily cured state under the white ink, and the white layer 80 with the white ink substantially cured is formed. The light quantity control of the emission regions of the temporary curing light sources 32A and 32B with respect to the white layer 80 is similar to that described in the first specific embodiment.

Step 4 is a forming step of the color image layer 82-2, in which in a color ink ejection position at the downstream side by (Lw/3) further in the recording medium transporting direction from the white ink deposition position on the recording medium 12, the carriage 30 is caused to scan in the carriage moving direction, and the color inks are deposited onto the white layer 80 from the downstream side regions 61-13 of the nozzle arrays 61Y, 61M, 61C, 61K, 61LC and 61LM. Further, from the temporary curing light sources 32A and 32B following the nozzle arrays 61Y, 61M, 61C, 61K, 61LC and 61LM, ultraviolet light of a small light quantity (1 to 5 mJ/cm$^2$ per one time scan of the carriage) are applied by scan of the carriage of one time to the color inks immediately after being landed on the recording medium 12 to temporarily cure the color inks and bring the color inks into a gel state.

By doing so, landing interference of the color inks that are landed on the white layer 80 is prevented, and the temporarily cured state is kept for a constant time period, whereby spread of dots and reduction in pile height are promoted.

Step 5 is a time period from the forming step until a permanent curing processing step of the color image layer 82, in which with use of the permanent curing light source 34B that is disposed at the downstream side in the recording medium transporting direction of the inkjet head 24, the permanent curing processing is applied to the color image layers 82-1 and 82-2 and the white layer 80 arranged between the color image layers 82-1 and 82-2. The ultraviolet light quantity in the permanent curing processing like this is 10 mJ/cm$^2$ or more per one time scan of the carriage. The color image layers 82-1 and 82-2 and the white layer 80 are permanently cured, whereby glossiness of the color image layers 82-1 and 82-2 is more enhanced, improvement of adhesion of the recording medium 12 and the color image layer 82-1, and adhesion of the color image layers 82-1 and 82-2 and the white layer 80, and curing of film quality of the color image layers 82-1 and 82-2 are made compatible.

<Fourth Configuration Embodiment of Temporary Curing Light Source Unit>

Figure 33:
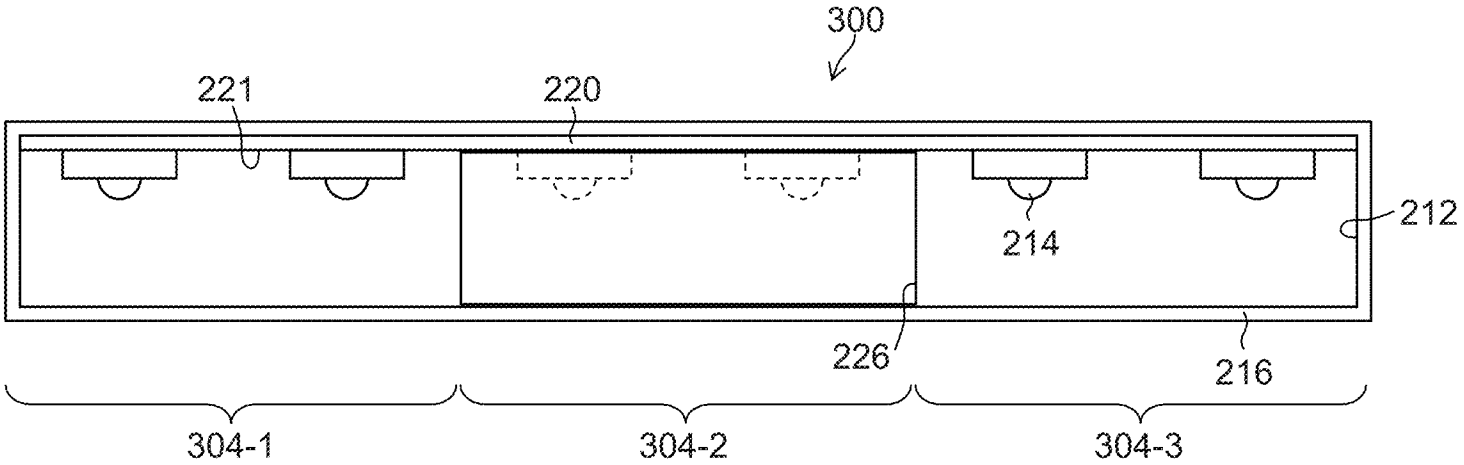
FIG. 33 is a side perspective view showing a configuration of the temporary curing light source unit according to the fourth configuration embodiment.
Figure 34:
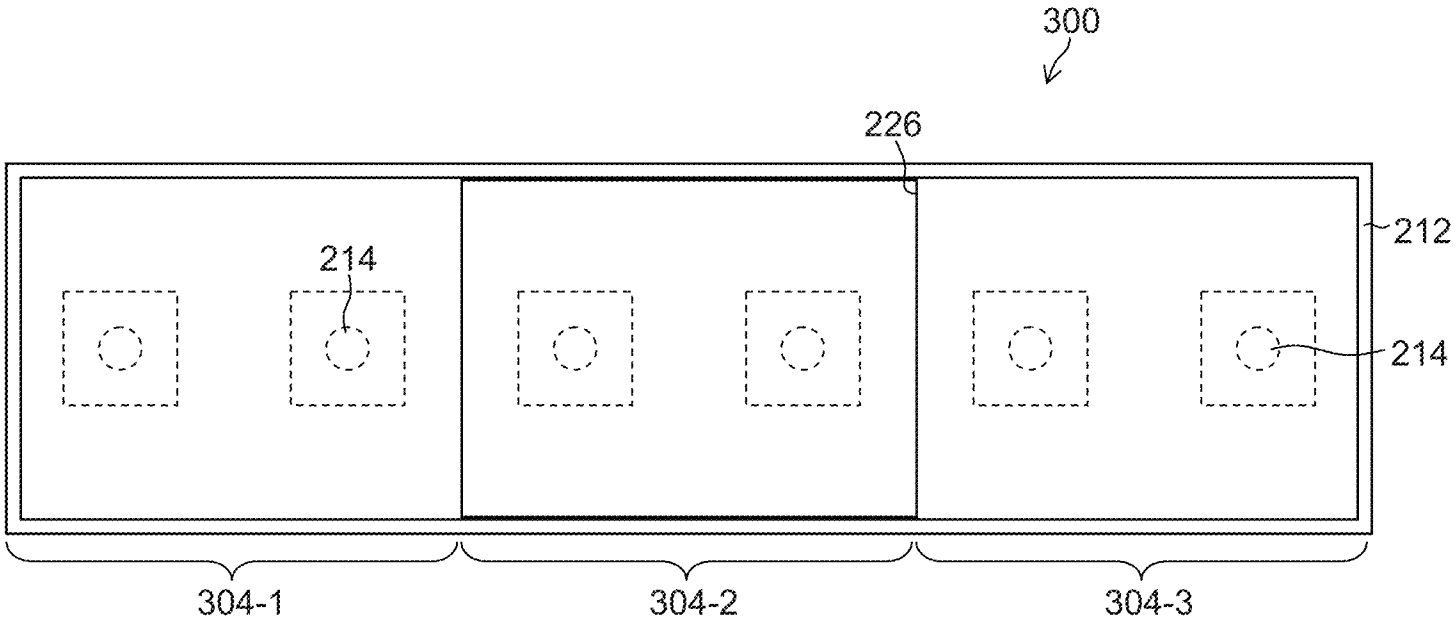
FIG. 34 is a planar perspective view of the temporary curing light source unit in FIG. 33.

FIG. 33 is a side perspective view showing a configuration embodiment of a temporary curing light source unit 300 corresponding to formation of the image of the three-layer structure described in FIG. 31 and FIG. 32. FIG. 34 is a planar perspective view thereof. In a fourth configuration embodiment shown in FIG. 33 and FIG. 34, the same or similar elements to those in the first configuration embodiment described in FIG. 7 and FIG. 8 are denoted with the same references, and the description thereof is omitted.

The temporary curing light source unit 300 shown in FIG. 33 and FIG. 34 is the same as the temporary curing light source unit 210 of the first configuration embodiment (FIG. 7 and FIG. 8) in basic configuration, and differs from the temporary curing light source unit 210 in that a division form of the LED element array is three-part division. Namely, in the temporary curing light source unit 300 shown in FIG. 33 and FIG. 34, a plurality of UV-LED elements 214 aligned along the X direction are divided into three regions that are a region 304-1 at the downstream side in the recording medium transporting direction (X direction), a region 304-2 at the central portion, and a region 304-3 at the upstream side, and two of the UV-LED elements 214 are included in each of the divided regions 304-1, 304-2 and 304-3.

Inside the housing 212, the partitioning members 226 with the light blocking effect are arranged as the range restricting members for partitioning the regions of the above-described LED element array divided into three. The partitioning members 226 are disposed to enclose the periphery of the two UV-LED elements 214 that belong to the region 304-2 at the central portion.

At the time of layer formation with the white ink, the UV-LED elements 214 that belong to the region 304-2 at the central portion are turned off, and the UV-LED elements 214 that belong to the regions 304-1 and 304-3 at the downstream side and the upstream side are turned on.

Alternatively, in place of control of turning off the UV-LED elements 214 that belong to the region 304-2 at the central portion, a mode is possible, that causes the UV-LED elements 214 at the central portion to emit light by setting the light emission amount of the UV-LED elements 214 that belong to the region 304-2 at the central portion to be a lower light amount than the UV-LED elements 214 that belong to the regions 304-1 and 304-3 at the downstream side and the upstream side.

<Fifth Configuration Embodiment of Temporary Curing Light Source Unit>

Figure 35:
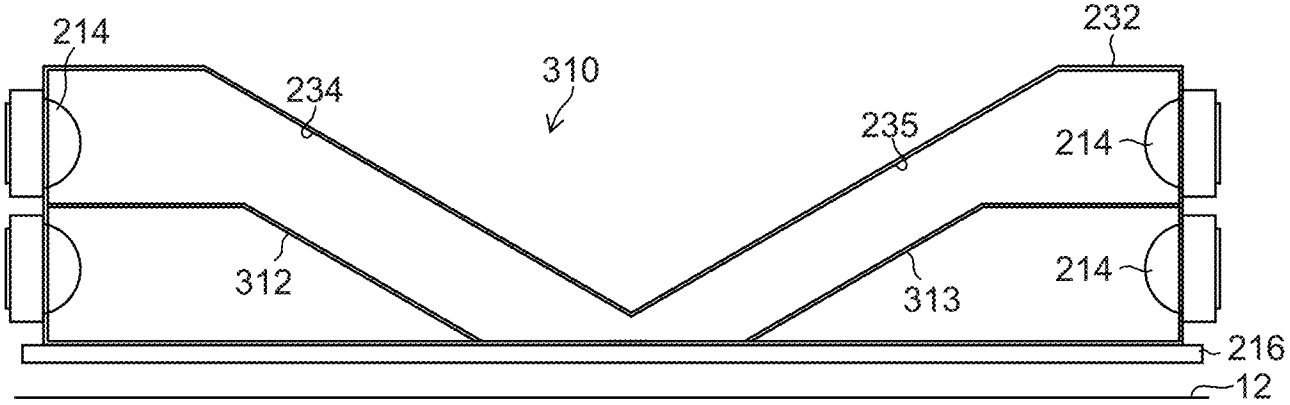
FIG. 35 is a side perspective view showing a temporary curing light source unit according to a fifth configuration embodiment.

FIG. 35 is a side perspective view showing another configuration embodiment of a temporary curing light source unit corresponding to formation of an image of the three-layer structure described in FIG. 31 and FIG. 32. In a fifth configuration embodiment shown in FIG. 35, the same or similar elements to those in the second configuration embodiment described in FIG. 9 to FIG. 11 are denoted with the same references, and the description thereof is omitted.

The temporary curing light source unit 310 shown in FIG. 35 is common to the second configuration embodiment in that the UV-LED elements 214 are disposed on the upstream side end face and the downstream side end face similarly to the temporary curing light source unit 210 (FIG. 9 to FIG. 11) of the second configuration embodiment, and differs from the second configuration embodiment in that inside the housing 232, mirror members 312 and 313 similar to the mirror member 252 described in FIG. 19 are disposed, and the irradiation region is divided into three.

Figure 36:
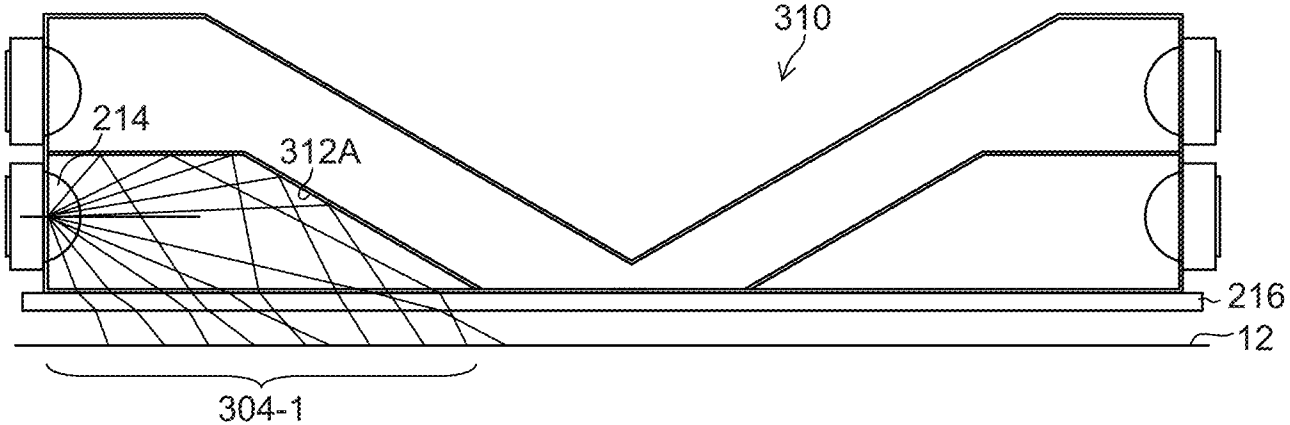
FIG. 36 is a perspective view showing a state in which only a ⅓ region at the downstream side is irradiated, in the temporary curing light source unit according to the fifth configuration embodiment.

FIG. 36 is a perspective view showing a state where only a ⅓ region at the downstream side is irradiated, out of the irradiation region divided into three. In this case, the UV-LED elements 214 disposed at the lower row on the end face at the downstream side are turned on, and the other UV-LED elements are turned off. The light that is emitted from the UV-LED elements 214 that are lit (turned on) is reflected on an undersurface 312A of the mirror member 312 and is applied to the recording medium 12.

Note that the UV-LED elements 214 that are disposed at the lower row on the upstream side end face are lit, and the other UV-LED elements are turned off, whereby only a ⅓ region at the upstream side is irradiated.

Figure 37:
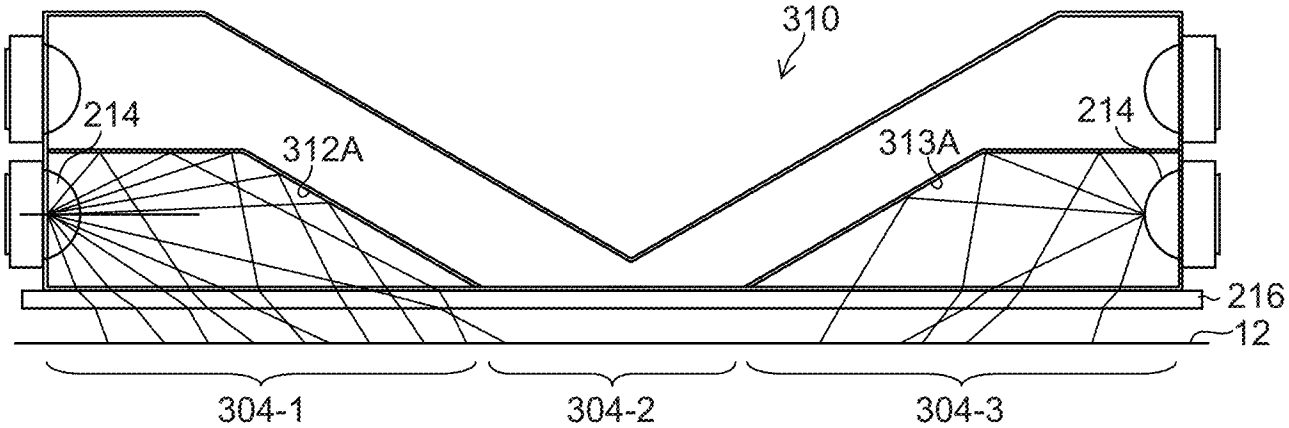
FIG. 37 is a perspective view showing an embodiment of a case in which a ⅓ region at a central portion is not irradiated, in the temporary curing light source unit according to the fifth configuration embodiment.

FIG. 37 is a perspective view showing an embodiment of a case in which irradiation is performed with respect to the ⅓ region at the downstream side and the ⅓ region at the upstream side, out of the irradiation region divided into three, and the ⅓ region at the center portion is not irradiated. In this case, the UV-LED elements 214 that are disposed on the lower rows on both the end faces at the downstream side and the upstream side are turned on, and the UV-LED elements on the upper rows are turned off. The light that is emitted from the UV-LED elements 214 that are lit (turned on) are reflected on the undersurfaces 312A and 313A of the mirror members 312 and 313, and are applied to the recording medium 12.

By the configuration as described above, separate irradiation control is realized, that subjects the color layer deposited from the upstream side (see reference numeral 61-11 in FIG. 32) and the downstream side (see reference numeral 61-13) of the nozzle arrays to temporarily curing irradiation, and does not perform pinning irradiation for the white ink layer in the middle (or performs pinning irradiation of a smaller light quantity than that for the color layer).

The reflection surface 312A on the undersurface side of the mirror member 312 in the temporary curing light source unit 310 shown in FIG. 35 to FIG. 37 corresponds to a "first reflection surface". The reflection surface on the undersurface side of the mirror member 234 corresponds to a "second reflection surface". The reflection surface 313A on the undersurface side of the mirror member 313 corresponds to a "third reflection surface, and the reflection surface on the undersurface side of the mirror member 235 corresponds to a "fourth reflection surface". Further, a region denoted with reference numeral 304-1 in FIG. 37 corresponds to a "first emission region", a region denoted with reference numeral 304-2 corresponds to a "second emission region", and a region denoted with reference numeral 304-3 corresponds to a "third region".

Figure 38B:
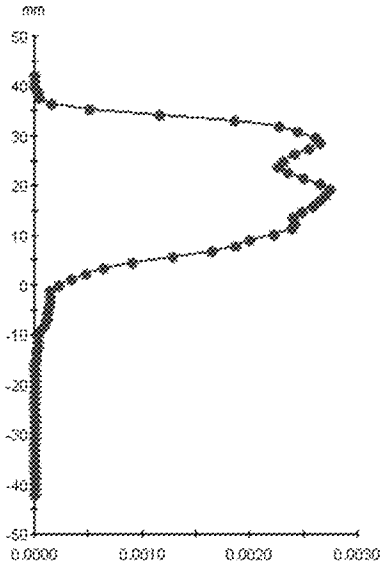
FIG. 38(*a*) is a diagram showing an irradiation distribution on a medium surface at the time of ⅓ irradiation explained in FIG. 36, and FIG. 38(*b*) is a graph showing an illuminance distribution section with respect to the medium transporting direction (X direction) in FIG. 38(*a*).
Figure 38A:
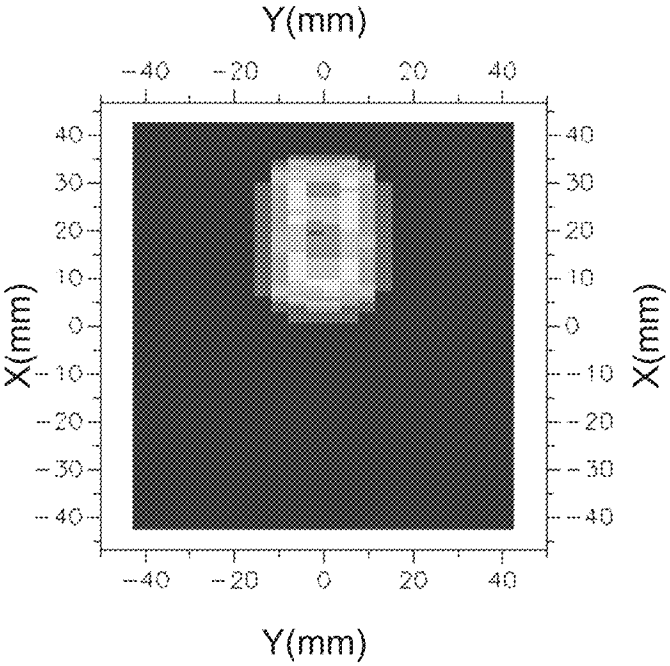

FIG. 38(*a*) is a diagram showing an irradiation distribution on the medium surface at the time of ⅓ irradiation described in FIG. 36. FIG. 38(*b*) is a graph showing an illuminance distribution section (distribution on a center line (Y direction center line) of the irradiation region on the medium surface) with respect to the medium transporting direction (X direction) in FIG. 38(*a*).

Figure 39B:
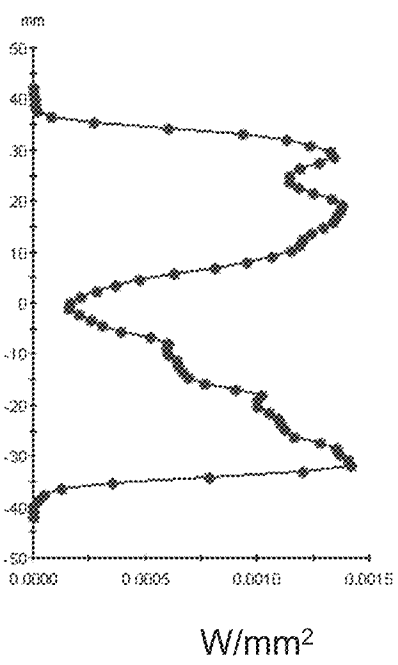
FIG. 39(*a*) is a diagram showing an irradiation distribution on a medium surface in the case in which the central ⅓ region is not irradiated, explained in FIG. 37, and FIG. 39(*b*) is a graph showing an illuminance distribution section with respect to the medium transporting direction (X direction) in FIG. 39(*a*).
Figure 39A:
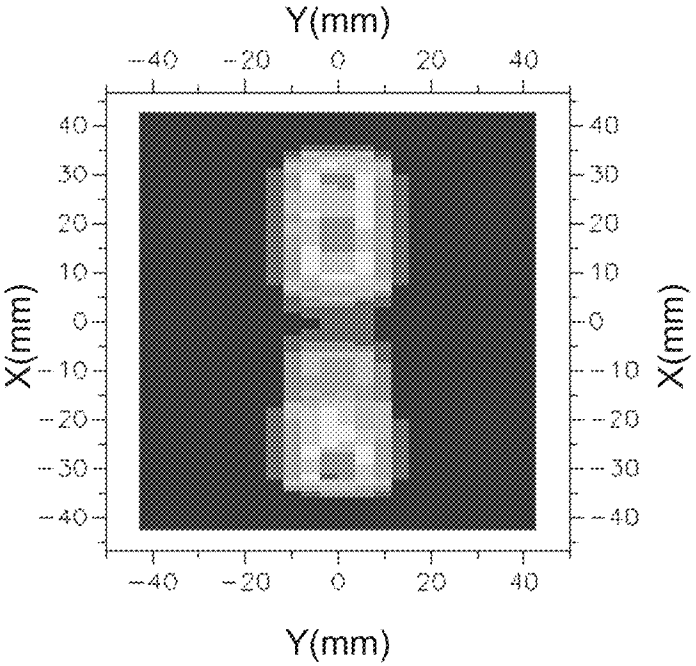

FIG. 39(*a*) is a diagram showing an illuminance distribution on the medium surface in the case of the central ⅓ region is not irradiated, which is described in FIG. 37 (in the case of irradiating the respective downstream and upstream regions). FIG. 39(*b*) is a graph showing an illuminance distribution section (distribution on the center line (Y direction center line) of the irradiation region on the medium surface) with respect to the medium transporting direction (X direction) in FIG. 39(*a*).

<Sixth Configuration Embodiment of Temporary Curing Light Source Unit>

Figure 40:
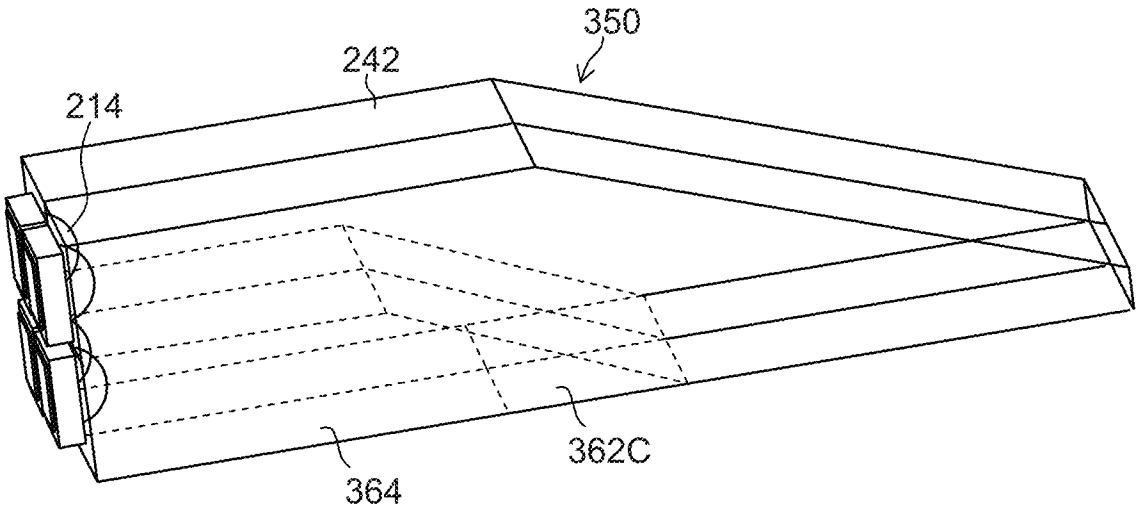
FIG. 40 is a perspective view showing a configuration of a temporary curing light source unit according to a sixth configuration embodiment.

FIG. 40 is a perspective view showing another configuration embodiment of a temporary curing light source unit applicable to formation of an image of the three-layer structure. In a temporary curing light source unit 350 shown in FIG. 40, the same or similar elements to those of the configuration of the temporary curing light source unit 240 of the third configuration embodiment described in FIG. 17 to FIG. 23 are denoted with the same references, and the description thereof is omitted.

The temporary curing light source unit 350 in FIG. 40 is common to the temporary curing light source unit 240 of the third configuration embodiment in that the plurality of UV-LED elements 214 are disposed on one end face that is the end face at the upstream side or the downstream side, but differs from the third configuration embodiment in that inside the housing, a partitioning member 362 that laterally separates the two UV-LED elements 214 on the lower row into the upstream side and the downstream side is disposed, and the irradiation region is divided into three. Respective surfaces of the partitioning member 362 function as reflection surfaces.

When ultraviolet light is applied to the entire range of the nozzle arrays, all the UV-LED elements 214 are lit. When only the irradiation region at the central portion is shut off from ultraviolet irradiation, one UV-LED element (at the rear side in FIG. 40) out of the UV-LED elements 214 on the lower row is turned off. The other (at the front side in FIG. 40) UV-LED element on the lower row is lit, and the light emitted from the UV-LED element is reflected on reflection surfaces 362A, 362B, 362C and the like of the partitioning member 362, and is emitted toward the recording medium 12 from a light passing part 364. Further, the light emitted from the UV-LED elements 214 on the upper row is reflected on a top surface of the partitioning member 362 and an inner surface of the housing and is guided onto the recording medium 12. In this manner, separate irradiation control that shuts off only the region at the central portion (provides a small light quantity) is enabled.

Figure 41:
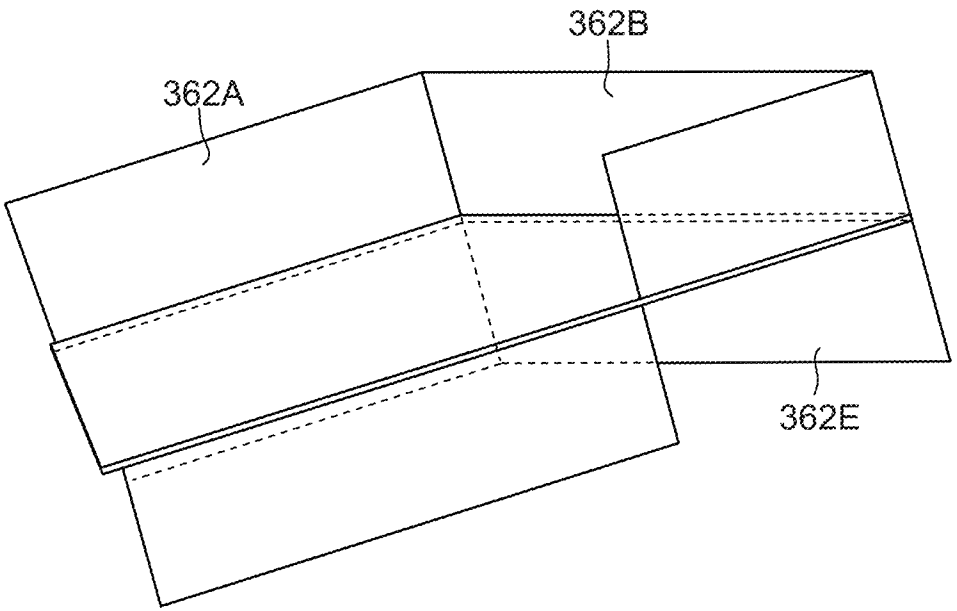
FIG. 41 is a perspective view showing a configuration embodiment of a partitioning member (mirror member) disposed in a housing of the temporary curing light source unit according to the sixth configuration embodiment.
Figure 42:
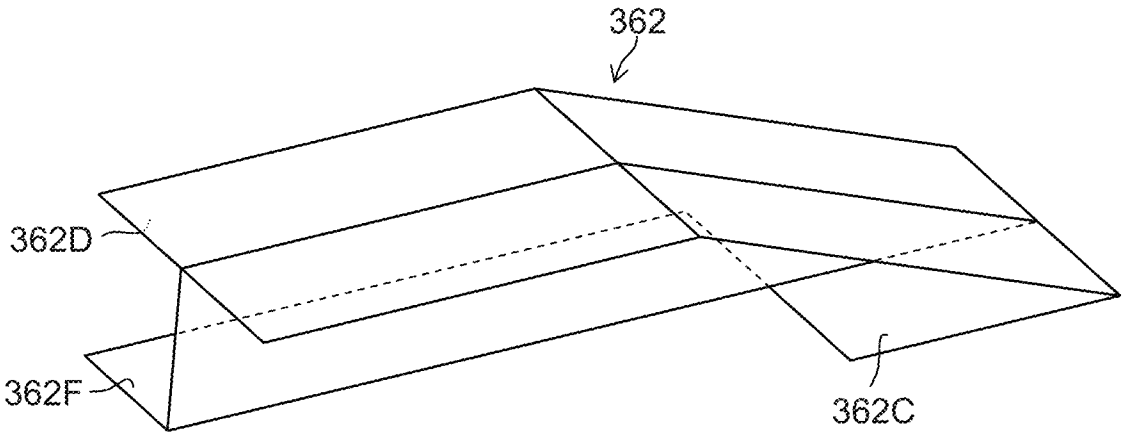
FIG. 42 is a perspective view showing a configuration embodiment of a partitioning member (mirror member) disposed in a housing of the temporary curing light source unit according to the sixth configuration embodiment.

In the temporary curing light source unit 350 shown in FIG. 40 to FIG. 42, a combination of the reflection surfaces 362A, 362B and 362C corresponds to a "fifth reflection surface". A combination of reflection surfaces 362D, 362E and 362F of the partitioning member 362 corresponds to a "sixth reflection surface", and a reflection surface by the ceiling surface of the housing 242 corresponds to a "seventh reflection surface".

Out of the four UV-LED elements 214 shown in FIG. 40, one at the front side on the lower row corresponds to an "activation light emitting element belonging to a first group", and one at the rear side on the lower row corresponds to an "activation light emitting element belonging to a second group". The two UV-LED elements 214 disposed on the upper row correspond to "activation light emitting elements belonging to a third group".

In the present embodiment, due to the configuration using the four UV-LED elements 214, the number of UV-LED elements belonging to each of the groups is one or two, but the number of light emitting elements in each of the groups is not limited to that of the present embodiment. Any number can be adopted if only at least one light emitting element is included in each of the groups.

Figure 43B:
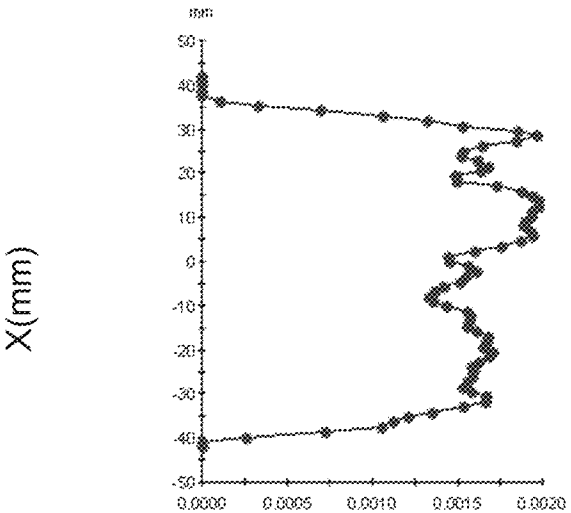
FIG. 43(*a*) is a diagram showing an irradiation distribution on a medium surface in a case in which whole surface is irradiated in the temporary curing light source unit of the sixth configuration embodiment, and FIG. 43 (*b*) is a graph showing an illuminance distribution section with respect to a medium transporting direction (X direction) in FIG. 43(*a*).
Figure 43A:
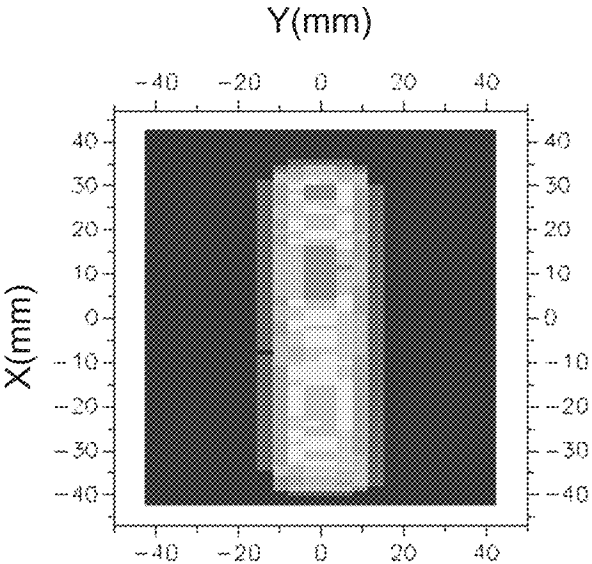

FIG. 43(*a*) is a diagram showing an irradiation distribution on the medium surface in a case in which entire face light emission is performed in the temporary curing light source unit 350 of the sixth configuration embodiment. FIG. 43(*b*) is a graph showing an illuminance distribution section (distribution on the center line (Y direction center line) of the irradiation region on the medium surface) with respect to the medium transporting direction (X direction) in FIG. 43(*a*).

Figure 44B:
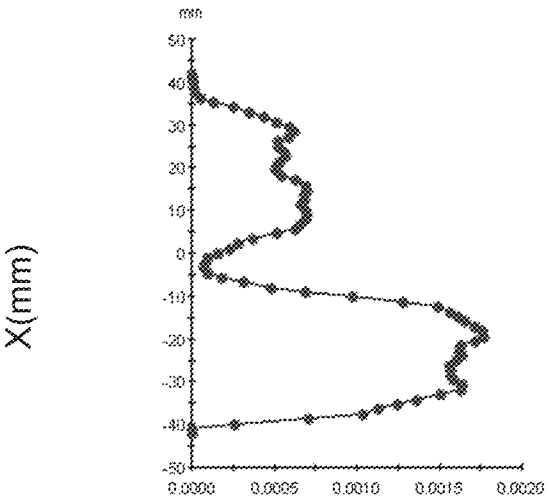
FIG. 44(*a*) is a diagram showing an irradiation distribution on a medium surface in a case in which only a central ⅓ region is not irradiated in the temporary curing light source unit of the sixth configuration embodiment, and FIG. 44(*b*) is a graph showing an illuminance distribution section with respect to the medium transporting direction (X direction) in FIG. 44(*a*).
Figure 44A:
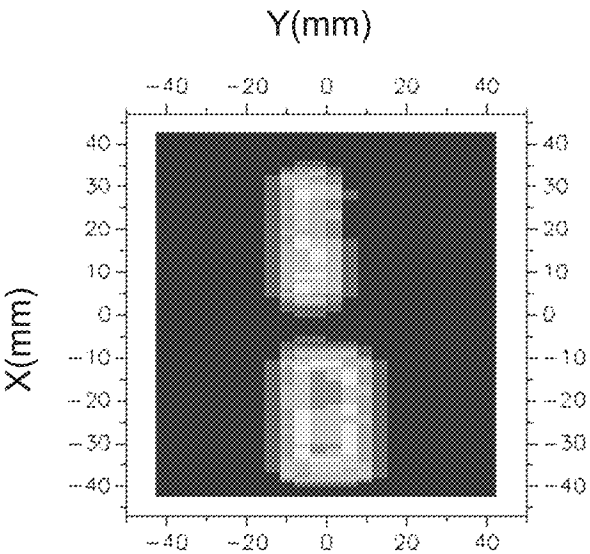

FIG. 44(*a*) is a diagram showing an irradiation distribution on the medium surface in a case in which only the central ⅓ region is not irradiated, with the temporary curing light source unit 350 of the sixth configuration embodiment. FIG. 44(*b*) is a graph showing an illuminance distribution section (distribution on the center line (Y direction center line) of the irradiation region on the medium surface) with respect to the medium transporting direction (X direction) in FIG. 44(*a*).

In the first to the fourth specific embodiments described above, such a mode is preferable that configures the permanent curing light source 34A to be automatically moved to the ejection position of the white ink, when the layer forming modes in which the modes of images to be formed (the kinds of inks forming the respective layers, the number of layers and the like) are switched. Switching of the layer forming modes can be performed in response to an input signal by an input device that will be described later (illustrated by being denoted with reference numeral 122 in FIG. 50).

A configuration embodiment that causes the permanent curing light source 34A to move automatically by switching of the layer forming modes as described above can include a light source moving part of a form including a cam mechanism that presses the permanent curing light source 34A outside the image forming region in the carriage moving direction, and a lock mechanism (stopper) that locks the permanent curing light source 34 to a predetermined position.

Figure 45:
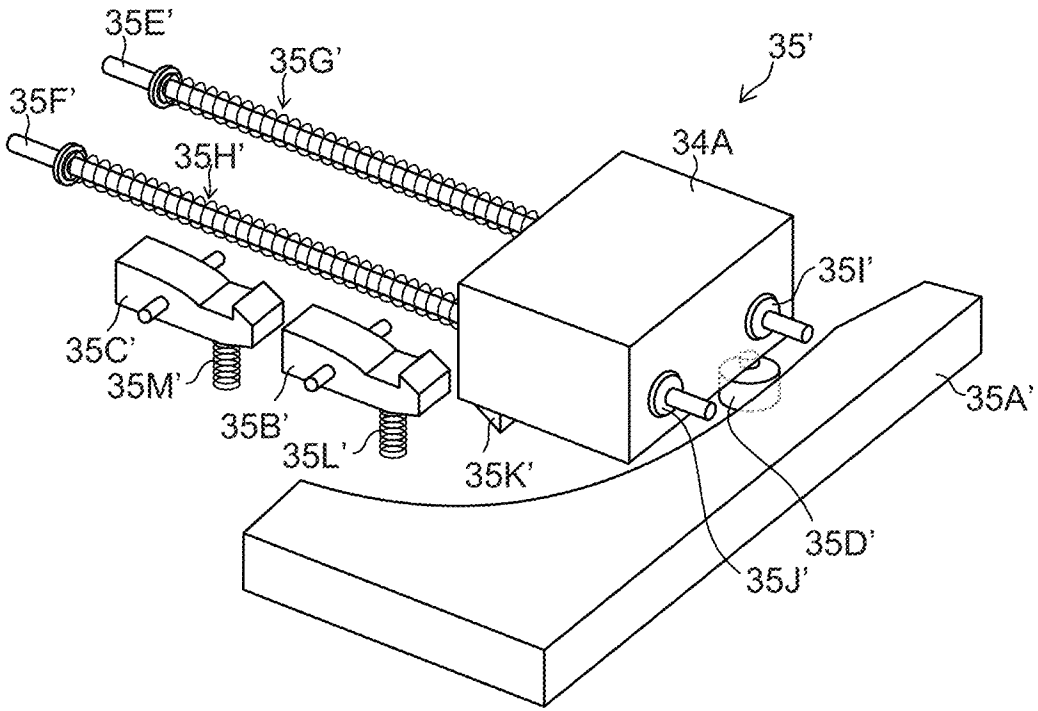
FIG. 45 is a perspective view showing another configuration embodiment of a light source moving mechanism.

FIG. 45 is a perspective view showing a configuration of the light source moving part 35' including the cam mechanism (a cam 35A') and the lock mechanism (stoppers 35B' and 35C' and the like) described above. As shown in FIG. 45, when the carriage 30 (see FIG. 3) is caused to scan in the left-hand direction in FIG. 3 (FIG. 47) and is moved to an installed position of the cam 35A' arranged outside the image forming region, a cam roller 35D' arranged on a bottom face of the permanent curing light source 34A moves along a cum curve formed on the cam 35A' as shown in FIG. 45, and the permanent curing light source 34A slides in the sub-scanning direction X (illustrated by the hollow arrow line in FIG. 47) along slide shafts 35E' and 35F'.

Figure 47:
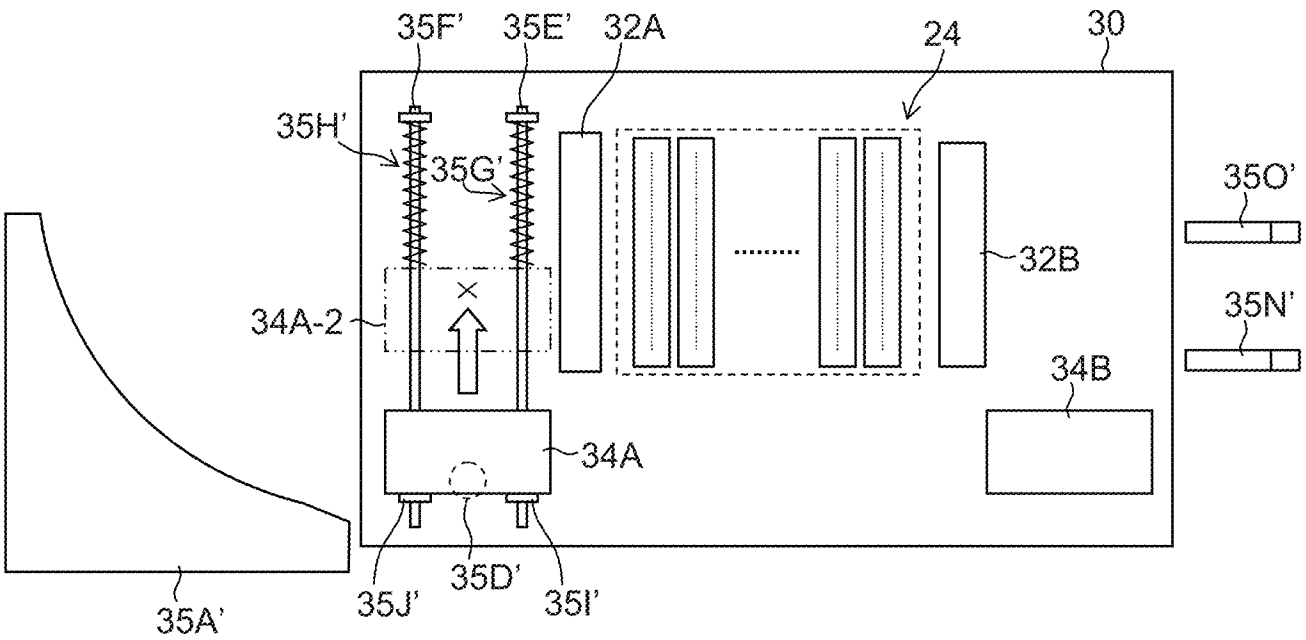
FIG. 47 is a plan view showing disposition of the light source moving mechanism shown in FIG. 45.

Note that the permanent curing light source 34A is urged to the downstream side in the recording medium transporting direction (opposite direction from the hollow arrow line illustrated in FIG. 47) of the inkjet head 24 by pressing springs 35G' and 35H', and at ends of the slide shafts 35E' and 35F', stoppers 35I' and 35J are arranged.

When a claw portion 35K' arranged on the bottom face of the permanent curing light source 34A reaches a position of the lock mechanisms 35B' and 35C', which are arranged at the carriage 30 to correspond to a stop position of the permanent curing light source 34A and are urged in the upper direction by springs (elastically deforming members) 35L' and 35M' from the lower side, the claw portion 35K' and the lock mechanism 35B' (35C') are engaged with each other, and the permanent curing light source 34A is fixed to a predetermined position.

For example, the stopper 35C' corresponds to the fixed position of the permanent curing light source 34A denoted with reference 34A-1 in FIG. 6, and the stopper 35B' corresponds to the fixed position of the permanent curing light source 34A denoted with reference 34A-2 in FIG. 28.

Figure 46:
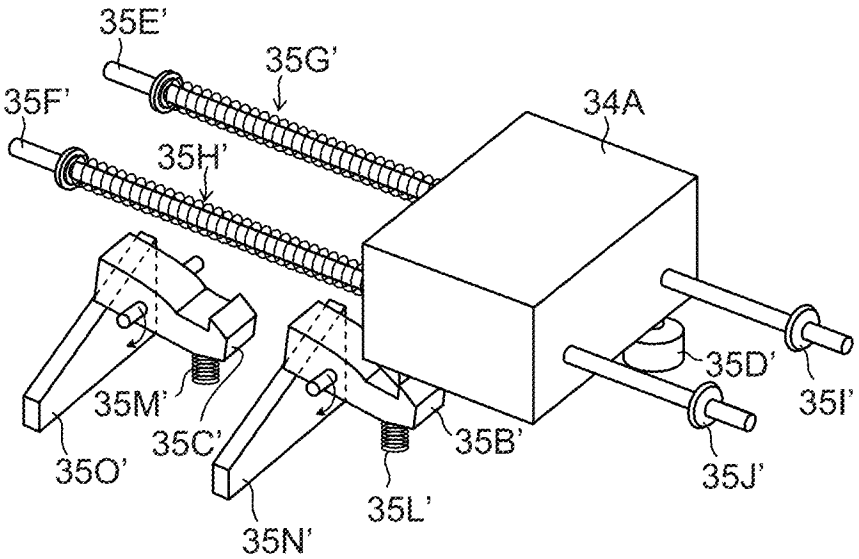
FIG. 46 is a perspective view showing a lock release state of the light source moving mechanism shown in FIG. 45.

FIG. 46 is a perspective view showing an unlocking state of the light source moving mechanism shown in FIG. 45. When the carriage 30 is moved to the right-hand side in FIG. 3, and reaches placement positions of unlocking cams 35N' and 350' outside the image forming region, ends at opposite sides from the ends that are engaged with the claw portion 35K', of the lock mechanisms 35B' and 35C' are pressed up by the unlocking cams 35N' and 350', the ends that are engaged with the claw portion 35K', of the lock mechanisms 35B' and 35C' are pressed down in the lower direction, so that the engagement of the lock mechanism 35B' (35C') and the claw portion 35K' is released.

Then, by elastic forces (restoring forces) of the pressing springs 35G' and 35H', the permanent curing light source 34A is moved to the downstream side in the recording medium transporting direction of the inkjet head 24, the permanent curing light source 34A abuts on the stoppers 35I' and 35J' arranged at the ends of the slide shafts 35E' and 35F', and stops in this position.

FIG. 47 is a plan view showing disposition of the light source moving mechanism shown in FIG. 45. As shown in FIG. 47, the cam 35A' and the unlocking cams 35N' and 350' are arranged outside the image forming region, and the other structure is mounted on the carriage. According to the configuration as described above, the carriage 30 is moved to the position of the cam mechanism (the lock mechanism, and the unlocking mechanism) arranged outside the image forming region, whereby the permanent curing light source 34A can be automatically moved to the ejection position of the white ink.

Note that as another embodiment, it is preferable to detect a position (present position) of the permanent curing light source 34A by a sensor, and when the permanent curing light source 34A is not located in a desired position corresponding to the layer forming mode, it is preferable to display to that effect on a display panel. In such a mode, a configuration is also conceivable, in which an operator visually recognizes the information displayed on the display panel, and manually changes the position of the permanent curing light source 34A.

In the present embodiments, in a case where the white ink is replaced with a metallic ink and a layer is formed with the metallic ink, similar image formation to the above-described first to fifth specific embodiments is also possible, although the description of the specific embodiment is omitted. Namely, when a layer to be a background or a foundation is formed with use of an ink that has a low ultraviolet absorption characteristic, and relatively low sensitivity to ultraviolet light, permanent curing processing is applied to the ink that forms the background layer (foundation layer) without temporary curing processing being performed.

The sensitivity (curing speed) with respect to the activation light in the present invention is defined as follows. First, after an ink film with a constant film thickness is generated, irradiation is performed stepwise while an irradiation light quantity is increased, an inkjet sheet is rubbed against the film, and whether or not a transfer adheres to the rubbed inkjet sheet is visually checked. The ink that requires a large irradiation light quantity before no ink adheres to the rubbed inkjet sheet is defined as an ink having relatively low sensitivity to ultraviolet light.

More specifically, as the ink having low sensitivity to ultraviolet light, a black ink, a white ink, and a metallic ink are generally cited. These inks have low light transmittance in the ultraviolet region to the visible light region, and it takes longer time for these inks to be cured than color inks such as yellow, cyan, and magenta inks.

Namely, unlike the color inks such as the yellow, cyan, and magenta inks, the inks having relatively low sensitivity to ultraviolet light such as the black ink, the white ink and the metallic ink have broad absorption characteristics (corresponding to a frequency band of a wide range) in the ultraviolet region to the visible light region (200 nm to 700 nm), and therefore, transmitting a short wave light and a long wave light is difficult. For example, when the color density of an image desired on the present market is to be realized, the light transmittance of the above-described color inks for ultraviolet light of 365 nm that is the main peak wavelength in many light sources is approximately 1.5 times to ten times as high as those of the white ink and the like.

Further, as described above, when the ultraviolet light emitting diode that has only the long wave emission light wavelength (365 nm to 405 nm) is applied to the curing light source, adaptation of the initiator to the long wavelength is essential, and thereby a cured film is sometimes yellowed. Therefore, in a clear ink or the like in which yellowing becomes significantly outstanding, an initiator quantity is limited, sensitivity to ultraviolet light is low, and curing is slow.

<Modification of Means that Changes Position of Permanent Curing Light Source>

Figure 48:
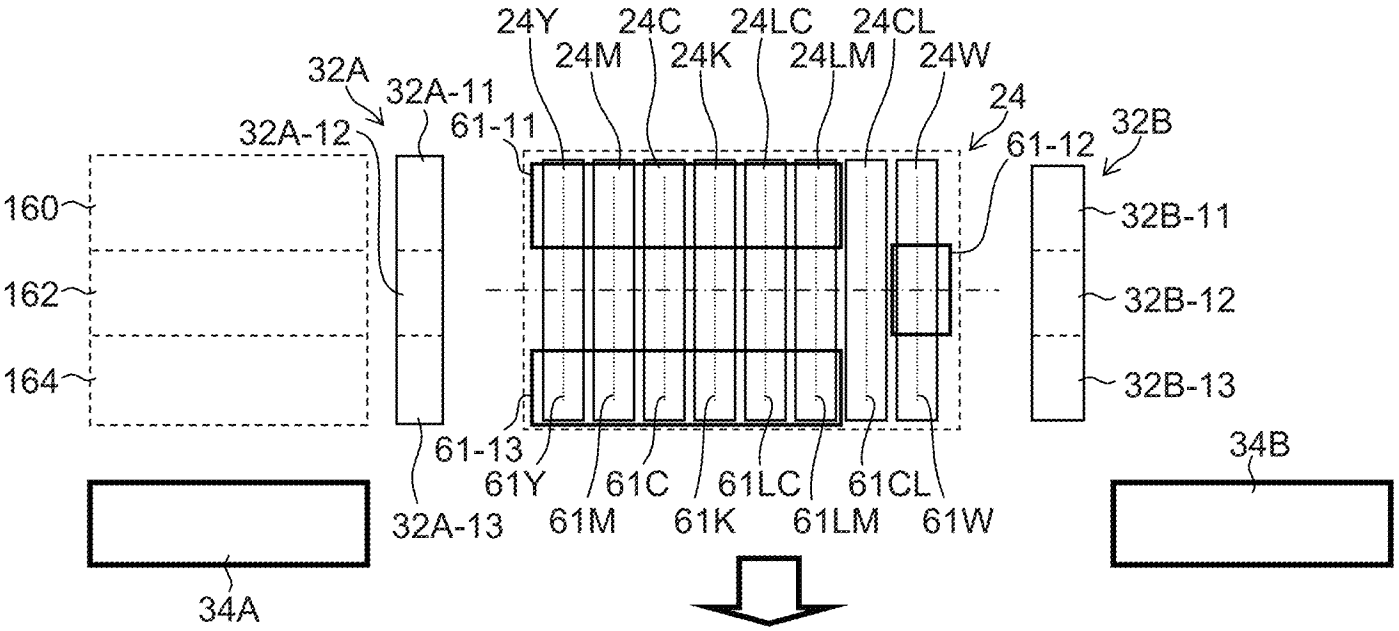
FIG. 48 is an explanatory view schematically illustrating a modification of a permanent curing light source.

FIG. 48 is an explanatory view schematically illustrating a modification of the permanent curing light source 34A. A unit module of the permanent curing light source 34A shown in FIG. 48 is formed in a cassette, and the carriage 30 (see FIG. 3) is provided with cassette (permanent curing light source unit module) insertion portions 160, 162 and 164 in which the permanent curing light source unit module is attached. In the embodiment shown in FIG. 48, in response to the case in which the nozzle arrays 61 are divided into three (the fourth specific embodiment), the cassette insertion portions 160, 162 and 164 are arranged from the upstream side in the recording medium transporting direction.

Namely, a mode is preferable, which includes the same number of cassette insertion portions as the maximum number Nmax of image forming layers, and is configured to insert the permanent curing light source unit module into the cassette insertion portion corresponding to the ejection position of the white ink. In this case, the length in the recording medium transporting direction of the ultraviolet irradiation area of the permanent curing light source unit module is ("the entire length Lw of the nozzle array"/"the maximum number Nmax of image forming layers").

<Explanation of Ink Supply System>

Figure 49:
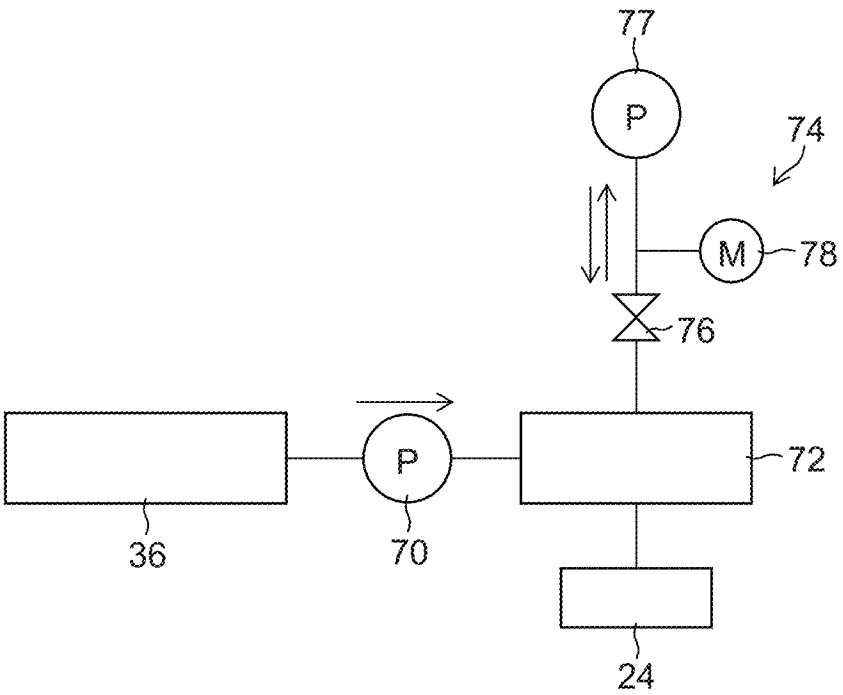
FIG. 49 is a block diagram showing a schematic configuration of an ink supply system of the inkjet head.

FIG. 49 is a block diagram showing a configuration of an ink supply system of the inkjet recording apparatus 10. As shown in FIG. 49, the ink that is contained in an ink cartridge 36 is sucked by a supply pump 70, and is fed to the inkjet head 24 through a sub tank 72. The sub tank 72 is provided with a pressure regulating part 74 for regulating pressure of the internal ink. The pressure regulating part 74 includes a pressure regulating pump 77, which communicates with the sub tank 72 through a valve 76, and a pressure gauge 78, which is arranged between the valve 76 and the pressure regulating pump 77.

At a normal printing time, the pressure regulating pump 77 operates in a direction to suck the ink in the sub tank 72, and the internal pressure of the sub tank 72 and the internal pressure of the inkjet head 24 are kept to be negative pressure. In contrast with this, at a maintenance time of the inkjet head 24, the pressure regulating pump 77 operates in a direction to pressurize the ink in the sub tank 72, the inside of the sub tank 72 and the inside of the inkjet head 24 are forcefully pressurized, and the ink in the inkjet head 24 is discharged through the nozzles. The ink that is forcefully discharged from the inkjet head 24 is received in the above-described ink receiver in the cap (not shown).

<Explanation of Control System of Inkjet Recording Apparatus>

FIG. 50 is a block diagram showing a configuration of the inkjet recording apparatus 10. As shown in FIG. 50, the inkjet recording apparatus 10 is provided with a control device 102 as control means. As the control device 102, for example, a computer or the like including a central processing unit (CPU) can be used. The control device 102 functions as a control unit that controls the whole of the inkjet recording apparatus 10 in accordance with a predetermined program, and functions as an arithmetic unit that performs various computations. The control device 102 includes a recording medium transportation controlling part 104, a carriage drive controlling part 106, a light source controlling part 108, an image processing part 110, and an ejection controlling part 112. The respective parts are realized by hardware circuits or software, or the combination thereof.

The recording medium transportation controlling part 104 controls a transport drive part 114 for transporting the recording medium 12 (see FIG. 1). The transport drive part 114 includes a driving motor that drives the nip rollers 40 shown in FIG. 2 and a drive circuit thereof. The recording medium 12 that is transported onto the platen 26 (see FIG. 1) is intermittently fed in the sub-scanning direction by a swath width unit in accordance with the reciprocal scan (movement of the printing pass) in the main scanning direction by the inkjet head 24.

The carriage drive controlling part 106 shown in FIG. 50 controls a main scan drive part 116 for moving the carriage 30 (see FIG. 1) in the main scanning direction. The main scan drive part 116 includes a driving motor connected to the moving mechanism of the carriage 30, and a control circuit thereof. The light source controlling part 108 is control means that controls light emission of the temporary curing light sources 32A and 32B through a light source drive circuit 118, and controls light emission of the permanent curing light sources 34A and 34B through a light source drive circuit 119. As the temporary curing light sources 32A and 32B and the permanent light sources 34A and 34B, UV-LED elements (ultraviolet LED elements) and UV lamps such as metal halide lamps are applied.

To the control device 102, an input device 122 such as an operation panel and a display device 120 are connected. The input device 122 is means that manually inputs an external operation signal to the control device 102, and, for example, various forms such as a keyboard, a mouse, a touch panel, and an operation button can be adopted. For the display device 120, various forms such as a liquid crystal display, an organic EL display, and a CRT can be adopted. The operator can perform selection of an image formation mode, input of printing conditions, input and edition of supplementary information and the like by operating the input device 122, and can confirm various kinds of information such as input contents and search result through display of the display device 120.

Further, the inkjet recording apparatus 10 is provided with an information storage part 124 in which various kinds of information are stored, and an image input interface 126 for taking in image data for printing. For the image input interface 126, a serial interface can be applied, or a parallel interface can be applied. On this part, a buffer memory (not shown) for enhancing the speed of communication can be mounted.

The image data that is inputted through the image input interface 126 is converted into data for printing (dot data) in the image processing part 110. The dot data is generally generated by performing color conversion processing and halftone processing to the image data of multiple tones. The color conversion processing is processing of converting image data expressed by sRGB or the like (for example, image data of eight bits with respect to respective RGB colors) into color data of respective colors of the inks used in the inkjet recording apparatus 10.

The halftone processing is processing of converting the color data of the respective colors generated by the color conversion processing into dot data of the respective colors by processing such as an error diffusion method and threshold value matrix. As the means of the halftone processing, various kinds of known means can be applied, such as an error diffusion method, a dither method, a threshold value matrix method and a density pattern method. The halftone processing converts tone image data generally having a tone value of three or more into tone image data having a tone value smaller than the original tone value. In the simplest embodiment, tone image data is converted into binary (on and off of a dot) dot image data; however, in the halftone processing, quantization of multiple value corresponding to the kinds of dot sizes (for example, three kinds such as a large dot, a medium dot, and a small dot) can be also performed.

The binary or multiple-value image data (dot data) obtained in this manner is used as drive (on)/non-drive (off) of the respective nozzles, and further ink ejection data (ejection control data) that controls the droplet quantity (dot size) in the case of a multiple value.

The ejection controlling part 112 generates an ejection control signal to a head drive circuit 128, on the basis of the dot data generated in the image processing part 110. Further, the ejection controlling part 112 includes a drive waveform generating part not illustrated. The drive waveform generating part is means that generates a drive voltage signal for driving ejection energy generating elements (piezoelectric elements in this embodiment) corresponding to the respective nozzles of the inkjet head 24. The waveform data of the drive voltage signal is stored in the information storage part 124 in advance, and the waveform data for use is outputted in accordance with necessity. A signal (drive waveform) outputted from the drive waveform generating part is supplied to the head drive circuit 128. Note that the signal that is outputted from the drive waveform generating part can be a digital waveform data, or can be an analogue voltage signal.

A common drive voltage signal is applied to the respective ejection energy generating elements of the inkjet head 24 through the head drive circuit 128, and on/off of the switch elements (not shown) connected to the individual electrodes of the respective energy generating elements is switched in response to the ejection timing of the respective nozzles, whereby the inks are ejected from the corresponding nozzles.

The information storage part 124 stores the programs executed by the CPU of the control device 102, various data necessary for control and the like. The information storage part 124 stores setting information of the resolutions corresponding to the image formation modes, the number of passes (the number of repetitions of scan), control information of the temporary curing light sources 32A and 32B and the permanent curing light sources 34A and 34B and the like.

An encoder 130 is attached to the driving motor of the main scan drive part 116 and the driving motor of the transport drive part 114, and outputs a pulse signal corresponding to the rotation amount and the rotational speed of the drive motor, and the pulse signal is sent to the control device 102. On the basis of the pulse signal outputted from the encoder 130, the position of the carriage 30 and the position of the recording medium 12 are grasped.

A sensor 132 is attached to the carriage 30, and the width of the recording medium 12 can be grasped on the basis of a sensor signal obtained from the sensor 132.

The control device 102 controls an operation of the light source moving part 35 of the permanent curing light sources 34A and 34B. For example, when selection information of the image forming process and the position information of the permanent curing light sources 34A and 34B are inputted from the input device 122, the control device 102 moves the permanent curing light source 34A (34B) to the position corresponding to the image forming process.

According to the inkjet recording apparatus and image forming method that are configured as described above, the pinning light irradiation region can be separately controlled in response to the divided regions of the nozzle arrays, and therefore suitable curing processing can be realized in each ink layer. Thereby, generation of banding phenomena in the white layer and the clear ink gloss layer can be avoided. Namely, pinning light irradiation to the ink deposition region of the white ink and the ink deposition region of the clear ink is shut off, or reduced to a small light quantity, whereby spread of the white ink droplets and the clear ink droplets can be promoted, and flattening and uniformization of the layers can be achieved. Thereby, the situation in which periodical streaks in respective swaths can be visually recognized can be avoided.

Further, according to the present embodiments, to the inks (the color inks and the clear ink) that have favorable ultraviolet transmission properties and high sensitivities to ultraviolet light and are cured quickly, ultraviolet light of a small light quantity are applied from the temporary curing light sources 32A and 32B immediately after deposition to bring the inks into a temporarily cured state, any one of the permanent curing light sources 34A and 34B is moved to the ejection position of the ink (the white ink) that is inferior in ultraviolet transmission property (has low sensitivity to ultraviolet light) and is cured slowly, and ultraviolet light of a large light quantity are applied to the ink that has low sensitivity to ultraviolet light and is cured slowly from the permanent curing light source 34A (34B) immediately after deposition to cure the ink. Therefore, the ultraviolet light quantity (irradiation energy quantity) is optimized in accordance with the ink for use in the image to be created, and image formation in which two or more kinds of inks differing in sensitivity are stacked as layers is enabled.

More specifically, the color inks and the clear ink are irradiated with ultraviolet light of a small light quantity from the temporary curing light sources 32A and 32B immediately after deposition (landing onto the recording medium) and are brought into a temporarily cured state, and after a lapse of dot developing time, and after uniformization of pile height, the color inks and the clear ink are irradiated with ultraviolet light of a large light quantity from the permanent curing light source 34B (34A) and are brought into a permanently cured state. Accordingly, the dot developing time period is taken between the temporary curing and the permanent curing, whereby gain of dots can be taken to be larger, and furthermore, the time for unifomization of pile height is taken, whereby graininess of the image is enhanced.

Further, at least one of the permanent curing light sources 34A and 34B is configured to be movable parallel to the recording medium transporting direction, and can be selectively disposed in the ejection position of the ink that has low sensitivity to ultraviolet light and is cured slowly, and further, the irradiation areas of the permanent curing light sources 34A and 34B are determined to correspond to the ejection range of the ink that has low sensitivity to ultraviolet light and is slowly cured ("the entire length Lw of the nozzle array"/ "the number N of image forming layers (the number of divisions)"). Therefore, ultraviolet light of a large light quantity are selectively applied to only the ink that has low sensitivity to ultraviolet light and is cured slowly, and the malfunction due to the difference in curing time among the inks can be avoided.

<Modification 1>

In the above-described embodiments, the embodiments in which the image forming head part (the inkjet head 24) has one nozzle array for each color are described; however, the arrangement form of the nozzles is not limited to the embodiments. For example, for each color, a staggered arrangement of two arrays, or a matrix arrangement of more arrays, and another two-dimensional arrangement can be adopted.

<Modification 2>

In the inkjet head 24 shown in FIG. 3, the plurality of (the same number of arrays as the number of ink colors) nozzle arrays 61 according to the colors are arranged at constant nozzle array space pitches along the main scanning direction (Y direction); however, the nozzle array intervals in the Y direction do not have to be always constant.

<Modification 3>

In the above-described embodiments, the embodiments are described, in which the temporary curing light sources 32A and 32B and the permanent curing light sources 34A and 34B are symmetrically disposed (disposed to be symmetric about line with respect to the center line) at both sides of the inkjet head 24 with respect to the main scanning direction, and droplet ejection and UV irradiation are performed by reciprocal scan (bidirectional); however, another mode is possible, in which the temporary curing light source and the permanent curing light source are disposed at only one side of the inkjet head 24, and image forming is performed at the time of unidirectional scan.

<Modification 4>

In the above-described embodiments, the cases in which the transporting direction of the recording medium (X direction) and the reciprocally moving direction of the inkjet head (Y direction) are perpendicular to each other are explained; however, the medium transporting direction and the reciprocally moving direction of the head do not have to be always perpendicular to each other. In order to perform two-dimensional image forming on the recording medium, the medium transporting direction and the head reciprocally moving direction only have to be not parallel to each other.

<Modification 5>

The first specific embodiment to the fourth specific embodiment can be properly combined. For example, a mode is possible, in which a white layer is formed on a recording medium, a color image is formed on the white layer, and a transparent layer is formed on the color image.

<Recording Medium>

The "recording medium" is a generic name for the media on which the inks are deposited, and includes media named in various terms such as a printing medium, a recorded medium, an image formed medium, an image receiving medium, a deposited medium, and a print medium. On implementation of the present invention, the material, the shape and the like of the recording medium are not especially limited, and the present invention can be applied to continuous roll paper, cut paper, seal paper, a resin sheet such as an OHP sheet, a film, cloth, unwoven fabric, a print board on which a wiring pattern and the like are formed, a rubber sheet, and the other various media irrespective of the material and the shape.

<Device Application Example>

In the above-described embodiments, the wide format type inkjet recording apparatus is exemplified; however, the application range of the present invention is not limited thereto. Application to inkjet recording apparatuses other than the wide format type is possible.

APPENDIX

As is grasped from the descriptions about the embodiments described in detail in the above, the present specification includes disclosure of various technical ideas including the invention shown as follows.

(Mode 1): An inkjet recording apparatus, including: an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged; a scanning device which is configured to reciprocally move the inkjet head in a first direction with respect to a recording medium on which the first ink and the second ink ejected from the inkjet head are deposited; a relative movement device which is configured to relatively move the recording medium with respect to the inkjet head in a second direction that is not parallel to the first direction; an ejection control device which is configured to control ink ejection of the inkjet head for each of units of divided nozzle regions obtained by dividing each of the nozzle arrays into a plurality of regions in the second direction; an activation light irradiation device which is configured to irradiate the inks deposited on the recording medium with the activation light; an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device.

According to this mode, in correspondence with the divided nozzle regions, irradiation control of the activation light corresponding to the respective regions is enabled. Thereby, suitable curing processing can be performed for each of the divided nozzle regions.

(Mode 2): In the inkjet recording apparatus of mode 1, the ejection control device controls the ink ejection of the inkjet head so as to form layers on the recording medium with the inks ejected respectively from the divided nozzle regions and to stack the layers formed with the inks ejected from the divided nozzle regions different from each other, by controlling ejection of the inks including the first ink and the second ink for each of the units of the divided nozzle regions.

According to the above-described mode, suitable light quantity control is enabled for the respective layers formed with the inks ejected from different divided nozzle regions.

(Mode 3): In the inkjet recording apparatus of mode 1 or 2, the first ink is a color ink, and the second ink is one of a white ink and a clear ink.

For the white ink or the clear ink, irradiation different from that for the color inks can be performed, and banding phenomena in the white layer and the transparent layer can be avoided.

(Mode 4): In the inkjet recording apparatus of mode 3, the light quantity for the divided irradiation region corresponding to the divided nozzle region that is configured to eject the one of the white ink and the clear ink is made smaller than the light quantity for the divided irradiation region corresponding to the divided nozzle region that is configured to eject the color ink.

According to the above-described mode, the deposited droplets of the white ink and the clear ink easily spread, and flatness and uniformization of the layers can be achieved.

(Mode 5): In the inkjet recording apparatus of mode 4, the color ink is ejected from one of the divided nozzle regions, and a color layer is formed on the recording medium with the ejected color ink; and the white ink is ejected from one of the divided nozzle regions different from the one of the divided nozzle regions that forms the color layer, and a white layer is formed on the recording medium with the ejected white ink as a layer under the color layer or a layer over the color layer.

There can be both modes that are the mode of forming the color layer over the white layer, and the mode of forming the white layer over the color layer. Further, there also can be the mode of forming the white layer over the color layer, and another color layer is formed over the white layer.

(Mode 6): In the inkjet recording apparatus of mode 4, the color ink is ejected from one of the divided nozzle regions, and a color layer is formed on the recording medium with the ejected color ink; and the clear ink is ejected from one of the divided nozzle regions different from the one of the divided nozzle regions that forms the color layer, and a clear layer is formed on the recording medium with the ejected clear ink as a layer under the color layer or a layer over the color layer.

Mode 6 and mode 5 can be combined.

(Mode 7): In the inkjet recording apparatus of any one of modes 1 to 6, the activation light irradiation device includes: a first activation light irradiation device which is moved with the inkjet head by the scanning device and serves as a temporary curing device that is configured to irradiate the inks deposited on the recording medium with the activation light of such a level as to incompletely cure the inks; and aside from the first activation light irradiation device, a second activation light irradiation device which serves as a permanent curing device that is configured to irradiate the inks deposited on the recording medium with the activation light of such a level as to permanently cure the inks.

With respect to the device irradiating the activation light for temporary curing irradiation, the mode of applying the configuration of divided irradiation is preferable.

As a specific mode of mode 7, it is preferable, for example, the inkjet head, the temporary curing light sources and the permanent curing light sources are integrally mounted on a carriage, and the scanning device relatively moves the carriage with respect to the recording medium.

(Mode 8): In the inkjet recording apparatus of mode 7, the second activation light irradiation device is disposed at a side outer than the first activation light irradiation device from the inkjet head in the first direction; and the inkjet recording apparatus further comprises an irradiation position changing device which is configured to move the second activation light irradiation device in the second direction to positions corresponding to image forming ranges of the divided nozzle regions.

According to the above-described mode, the activation light irradiation device can be moved so that the irradiation range of the activation light corresponds to the ejection position of the ink that has lower sensitivity to the activation light and is more slowly cured, and abnormality due to differences in curing sensitivity among the inks can be avoided.

(Mode 9): In the inkjet recording apparatus of mode 8, the position of the second activation light irradiation device is set so that an irradiation range of the activation light of the second activation light irradiation device corresponds to a position where an ink that has lower sensitivity to the activation light and is more slowly cured, out of a plurality of kinds of inks including the first ink and the second ink, is ejected.

For example, the second activation light irradiation device (permanent curing device) is disposed in the position corresponding to the divided nozzle region that ejects the white ink with low sensitivity as compared with the color inks.

(Mode 10): In the inkjet recording apparatus of any one of modes 1 to 9, the activation light irradiation device includes a light emitting element array in which a plurality of activation light emitting elements are arranged; and the irradiation region dividing device includes a range restricting member which divides the light emitting element array into a plurality of regions and restricts an emission range of the activation light from the activation light emitting elements in each of the regions.

By dividing the light emitting element array into the regions correspondingly to the divided nozzle regions, adjustment of the irradiation regions corresponding to the divided nozzle regions is enabled.

(Mode 11): In the inkjet recording apparatus of any one of modes 1 to 9, the activation light irradiation device includes activation light emitting elements disposed on respective end faces in the second direction, and has a reflection surface which is configured to reflect the activation light that is emitted from the activation light emitting elements to the recording medium; and the light quantity control device is configured to control light emission amounts of the activation light emitting elements disposed on the respective end faces.

According to the configuration in which the light emitting elements are disposed on both the end faces at the upstream side and the downstream side in the second direction, separate control of the irradiation regions corresponding to the divided nozzle regions is enabled by performing light emission control of the light emitting elements on the respective end faces.

(Mode 12): In the inkjet recording apparatus of mode 11, the activation light irradiation device includes: a plurality of the activation light emitting elements disposed on each of the end faces; a first reflection surface which is configured to reflect the activation light that is emitted from at least one of the activation light emitting elements disposed on one of the end faces, and to guide the activation light to a first emission region; a second reflection surface which is configured to reflect the activation light that is emitted from the other of the activation light emitting elements disposed on the one of the end faces, and to guide the activation light to a second emission region different from the first emission region; a third reflection surface which is configured to reflect the activation light that is emitted from at least one of the activation light emitting elements disposed on the other of the end faces, and to guide the activation light to a third emission region that is different from any of the first emission region and the second emission region; and a fourth reflection surface which is configured to reflect the activation light that is emitted from the other of the activation light emitting elements disposed on the other of the end faces, and to guide the activation light to the second emission region.

According to the above-described mode, the emission region is divided into three, and the light quantity can be controlled for each region.

(Mode 13): In the inkjet recording apparatus of any one of modes 1 to 9, the activation light irradiation device includes: a plurality of activation light emitting elements disposed on only one of end faces in the second direction; a first reflection surface which is configured to reflect the activation light that is emitted from at least one of the activation light emitting elements, and to guide the activation light to a first emission region; and a second reflection surface which is configured to reflect the activation light that is emitted from the other of the activation light emitting elements, and to guide the activation light to a second emission region different from the first emission region, and the light quantity control device is configured to control emission light quantities of the at least one of the activation light emitting elements and the other of the activation light emitting elements.

According to the above-described mode, by the configuration in which the activation light emitting elements are disposed on only one end face at the upstream side or the downstream side in the second direction, division control of the irradiation region can be realized.

(Mode 14): In the inkjet recording apparatus of any one of modes 1 to 9, the activation light irradiation device includes: at least three activation light emitting elements disposed on only one of end faces in the second direction, the activation light emitting elements being divided into a first group, a second group and a third group; a fifth reflection surface which is configured to reflect the activation light that is emitted from the activation light emitting element belonging to the first group, and to guide the activation light to a first emission region; a sixth reflection surface which is configured to reflect the activation light that is emitted from the activation light emitting element belonging to the second group, and to guide the activation light to a second emission region different from the first emission region; and a seventh reflection surface which is configured to reflect the activation light that is emitted from the activation light emitting element belonging to the third group, and to guide the activation light to a third emission region different from any of the first emission region and second emission region, and the light quantity control device is configured to control emission light quantities of the activation light emitting elements by group units of the first group, the second group and the third group.

According to the above-described mode, by the configuration in which the activation light emitting elements are disposed on only one end face at the upstream side or the downstream side in the second direction, the irradiation region is divided into three, and the light quantity can be controlled for each region.

(Mode 15): An image forming method including: a scan step of moving an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged, in a first direction with respect to a recording medium; a relative movement step of relatively moving the recording medium with respect to the inkjet head in a second direction that is not parallel to the first direction; an ejection control step of controlling ink ejection of the inkjet head for each of units of divided nozzle regions obtained by dividing each of the nozzle arrays into a plurality of regions in the second direction; and an activation light irradiation step of irradiating the inks ejected from the inkjet head and deposited on the recording medium in the ejection control step with the activation light, a range irradiated with the activation light being divided into a plurality of divided irradiation regions corresponding respectively to the divided nozzle regions, irradiation with the activation light being performed by controlling light quantities respectively for the divided irradiation regions.

EXPLANATION OF REFERENCE NUMERALS

10: inkjet recording apparatus; 12: recording medium; 24: inkjet head; 32A, 32B: temporary curing light source; 34A, 34: permanent curing light source; 35: light source moving part (moving mechanism); 61, 61C, 61M, 61Y, 61K, 61CL, 61W: nozzle array; 61-1, 61-2, 61-11, 61-12, 61-13: division unit; 80: white layer; 82, 82-1, 82-2: color image layer; 84: transparent layer; 102: control device; 108: light source controlling part; 114: transport drive part; 116: main scan drive part; 118, 119: light source drive circuit; 128: ejection controlling part; 210: temporary curing light source unit; 212: housing; 214, 215: UV-LED element; 226: partitioning member; 230: temporary curing light source unit; 232: housing; 235: reflection surface; 240: temporary curing light source unit; 242: housing; 252: mirror member; 300, 310: temporary curing light source unit; 312, 313: mirror member; 350: temporary curing light source unit

The invention claimed is:

1. An inkjet recording apparatus, comprising:

an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged;

a scanning device which is configured to reciprocally move the inkjet head in a first direction with respect to a recording medium on which the first ink and the second ink ejected from the inkjet head are deposited;

a relative movement device which is configured to relatively move the recording medium with respect to the inkjet head in a second direction that is not parallel to the first direction;

an ejection control device which is configured to control ink ejection of the inkjet head for each of units of divided nozzle regions obtained by dividing each of the nozzle arrays into a plurality of regions in the second direction;

an activation light irradiation device which is configured to irradiate the inks deposited on the recording medium with the activation light;

an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device, wherein the activation light irradiation device includes:

a first activation light irradiation device which is moved with the inkjet head by the scanning device and serves as a temporary curing device that is configured to irradiate the inks deposited on the recording medium with the activation light of such a level as to incompletely cure the inks; and aside from the first activation light irradiation device, a second activation light irradiation device which serves as a permanent curing device that is configured to irradiate the inks deposited on the recording medium with the activation light of such a level as to permanently cure the inks, wherein the light quantity control device is configured to control emission light amounts of the first activation light irradiation device respectively for the divided irradiation regions.

2. The inkjet recording apparatus as defined in claim 1, wherein the ejection control device controls the ink ejection of the inkjet head so as to form layers on the recording medium with the inks ejected respectively from the divided nozzle regions and to stack the layers formed with the inks ejected from the divided nozzle regions different from each other, by controlling ejection of the inks including the first ink and the second ink for each of the units of the divided nozzle regions.

3. The inkjet recording apparatus as defined in claim 1, wherein the first ink is a color ink, and the second ink is one of a white ink and a clear ink.

4. The inkjet recording apparatus as defined in claim 3, wherein the light quantity for the divided irradiation region corresponding to the divided nozzle region that is configured to eject the one of the white ink and the clear ink is made smaller than the light quantity for the divided irradiation region corresponding to the divided nozzle region that is configured to eject the color ink.

5. The inkjet recording apparatus as defined in claim 4, wherein:

the color ink is ejected from one of the divided nozzle regions, and a color layer is formed on the recording medium with the ejected color ink; and the white ink is ejected from one of the divided nozzle regions different from the one of the divided nozzle regions that forms the color layer, and a white layer is formed on the recording medium with the ejected white ink as a layer under the color layer or a layer over the color layer.

6. The inkjet recording apparatus as defined in claim 4, wherein:

the color ink is ejected from one of the divided nozzle regions, and a color layer is formed on the recording medium with the ejected color ink; and the clear ink is ejected from one of the divided nozzle regions different from the one of the divided nozzle regions that forms the color layer, and a clear layer is formed on the recording medium with the ejected clear ink as a layer under the color layer or a layer over the color layer.

7. An inkjet recording apparatus, comprising:

an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged;

a scanning device which is configured to reciprocally move the inkjet head in a first direction with respect to a recording medium on which the first ink and the second ink ejected from the inkjet head are deposited;

a relative movement device which is configured to relatively move the recording medium with respect to the inkjet head in a second direction that is not parallel to the first direction;

an ejection control device which is configured to control ink ejection of the inkjet head for each of units of divided nozzle regions obtained by dividing each of the nozzle arrays into a plurality of regions in the second direction;

an activation light irradiation device which is configured to irradiate the inks deposited on the recording medium with the activation light;

an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device, wherein the activation light irradiation device includes:

a first activation light irradiation device which is moved with the inkjet head by the scanning device and serves as a temporary curing device that is configured to irradiate the inks deposited on the recording medium with the activation light of such a level as to incompletely cure the inks; and aside from the first activation light irradiation device, a second activation light irradiation device which serves as a permanent curing device that is configured to irradiate the inks deposited on the recording medium with the activation light of such a level as to permanently cure the inks, wherein:

the second activation light irradiation device is disposed at a side outer than the first activation light irradiation device from the inkjet head in the first direction; and the inkjet recording apparatus further comprises an irradiation position changing device which is configured to move the second activation light irradiation device in the second direction to positions corresponding to image forming ranges of the divided nozzle regions.

8. The inkjet recording apparatus as defined in claim 7, wherein the position of the second activation light irradiation device is set so that an irradiation range of the activation light of the second activation light irradiation device corresponds to a position where an ink that has lower sensitivity to the activation light and is more slowly cured, out of a plurality of kinds of inks including the first ink and the second ink, is ejected.

9. An inkjet recording apparatus, comprising:

an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged;

a scanning device which is configured to reciprocally move the inkjet head in a first direction with respect to a recording medium on which the first ink and the second ink ejected from the inkjet head are deposited;

a relative movement device which is configured to relatively move the recording medium with respect to the inkjet head in a second direction that is not parallel to the first direction;

an ejection control device which is configured to control ink ejection of the inkjet head for each of units of divided nozzle regions obtained by dividing each of the nozzle arrays into a plurality of regions in the second direction;

an activation light irradiation device which is configured to irradiate the inks deposited on the recording medium with the activation light;

an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device, wherein the activation light irradiation device includes:

a first activation light irradiation device which is moved with the inkjet head by the scanning device and serves as a temporary curing device that is configured to irradiate the inks deposited on the recording medium with the activation light of such a level as to incompletely cure the inks; and aside from the first activation light irradiation device, a second activation light irradiation device which serves as a permanent curing device that is configured to irradiate the inks deposited on the recording medium with the activation light of such a level as to permanently cure the inks, wherein:

the activation light irradiation device includes a light emitting element array in which a plurality of activation light emitting elements are arranged; and the irradiation region dividing device includes a range restricting member which divides the light emitting element array into a plurality of regions and restricts an emission range of the activation light from the activation light emitting elements in each of the regions.

10. An inkjet recording apparatus, comprising:

an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged;

a scanning device which is configured to reciprocally move the inkjet head in a first direction with respect to a recording medium on which the first ink and the second ink ejected from the inkjet head are deposited;

a relative movement device which is configured to relatively move the recording medium with respect to the inkjet head in a second direction that is not parallel to the first direction;

an ejection control device which is configured to control ink ejection of the inkjet head for each of units of divided nozzle regions obtained by dividing each of the nozzle arrays into a plurality of regions in the second direction;

an activation light irradiation device which is configured to irradiate the inks deposited on the recording medium with the activation light;

an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device, wherein the activation light irradiation device includes:

a first activation light irradiation device which is moved with the inkjet head by the scanning device and serves as a temporary curing device that is configured to irradiate the inks deposited on the recording medium with the activation light of such a level as to incompletely cure the inks; and aside from the first activation light irradiation device, a second activation light irradiation device which serves as a permanent curing device that is configured to irradiate the inks deposited on the recording medium with the activation light of such a level as to permanently cure the inks, wherein:

the activation light irradiation device includes activation light emitting elements disposed on respective end faces in the second direction, and has a reflection surface which is configured to reflect the activation light that is emitted from the activation light emitting elements to the recording medium; and the light quantity control device is configured to control light emission amounts of the activation light emitting elements disposed on the respective end faces.

11. The inkjet recording apparatus as defined in claim 10, wherein the activation light irradiation device includes:

a plurality of the activation light emitting elements disposed on each of the end faces;

a first reflection surface which is configured to reflect the activation light that is emitted from at least one of the activation light emitting elements disposed on one of the end faces, and to guide the activation light to a first emission region;

a second reflection surface which is configured to reflect the activation light that is emitted from the other of the activation light emitting elements disposed on the one of the end faces, and to guide the activation light to a second emission region different from the first emission region;

a third reflection surface which is configured to reflect the activation light that is emitted from at least one of the activation light emitting elements disposed on the other of the end faces, and to guide the activation light to a third emission region that is different from any of the first emission region and the second emission region; and a fourth reflection surface which is configured to reflect the activation light that is emitted from the other of the activation light emitting elements disposed on the other of the end faces, and to guide the activation light to the second emission region.

12. An inkjet recording apparatus, comprising:

an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged;

a scanning device which is configured to reciprocally move the inkjet head in a first direction with respect to a recording medium on which the first ink and the second ink ejected from the inkjet head are deposited;

a relative movement device which is configured to relatively move the recording medium with respect to the inkjet head in a second direction that is not parallel to the first direction;

an ejection control device which is configured to control ink ejection of the inkjet head for each of units of divided nozzle regions obtained by dividing each of the nozzle arrays into a plurality of regions in the second direction;

an activation light irradiation device which is configured to irradiate the inks deposited on the recording medium with the activation light;

an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device, wherein the activation light irradiation device includes:

a first activation light irradiation device which is moved with the inkjet head by the scanning device and serves as a temporary curing device that is configured to irradiate the inks deposited on the recording medium with the activation light of such a level as to incompletely cure the inks;

aside from the first activation light irradiation device, a second activation light irradiation device which serves as a permanent curing device that is configured to irradiate the inks deposited on the recording medium with the activation light of such a level as to permanently cure the inks;

a plurality of activation light emitting elements disposed on only one of end faces in the second direction;

a first reflection surface which is configured to reflect the activation light that is emitted from at least one of the activation light emitting elements, and to guide the activation light to a first emission region; and a second reflection surface which is configured to reflect the activation light that is emitted from the other of the activation light emitting elements, and to guide the activation light to a second emission region different from the first emission region, wherein the light quantity control device is configured to control emission light quantities of the at least one of the activation light emitting elements and the other of the activation light emitting elements.

13. An inkjet recording apparatus, comprising:

an inkjet head which has a plurality of nozzle arrays including a first nozzle array in which a plurality of nozzles configured to eject a first ink that is cured by irradiation with activation light are arranged, and a second nozzle array in which a plurality of nozzles configured to eject a second ink that has a curing characteristic different from a curing characteristic of the first ink are arranged;

a scanning device which is configured to reciprocally move the inkjet head in a first direction with respect to a recording medium on which the first ink and the second ink ejected from the inkjet head are deposited;

a relative movement device which is configured to relatively move the recording medium with respect to the inkjet head in a second direction that is not parallel to the first direction;

an ejection control device which is configured to control ink ejection of the inkjet head for each of units of divided nozzle regions obtained by dividing each of the nozzle arrays into a plurality of regions in the second direction;

an activation light irradiation device which is configured to irradiate the inks deposited on the recording medium with the activation light;

an irradiation region dividing device which is configured to divide a range irradiated with the activation light by the activation light irradiation device into a plurality of divided irradiation regions corresponding respectively to the divided nozzle regions; and a light quantity control device which is configured to control light quantities respectively for the divided irradiation regions divided by the irradiation region dividing device, wherein the activation light irradiation device includes:

a first activation light irradiation device which is moved with the inkjet head by the scanning device and serves as a temporary curing device that is configured to irradiate the inks deposited on the recording medium with the activation light of such a level as to incompletely cure the inks;

aside from the first activation light irradiation device, a second activation light irradiation device which serves as a permanent curing device that is configured to irradiate the inks deposited on the recording medium with the activation light of such a level as to permanently cure the inks;

at least three activation light emitting elements disposed on only one of end faces in the second direction, the activation light emitting elements being divided into a first group, a second group and a third group;

a fifth reflection surface which is configured to reflect the activation light that is emitted from the activation light emitting element belonging to the first group, and to guide the activation light to a first emission region;

a sixth reflection surface which is configured to reflect the activation light that is emitted from the activation light emitting element belonging to the second group, and to guide the activation light to a second emission region different from the first emission region; and a seventh reflection surface which is configured to reflect the activation light that is emitted from the activation light emitting element belonging to the third group, and to guide the activation light to a third emission region different from any of the first emission region and second emission region, wherein the light quantity control device is configured to control emission light quantities of the activation light emitting elements by group units of the first group, the second group and the third group.

14. The inkjet recording apparatus as defined in claim 10, wherein the first activation light irradiation device serving as the temporary curing device in the activation light irradiation device includes activation light emitting elements disposed on respective end faces in the second direction, and has a reflection surface which is configured to reflect the activation light that is emitted from the activation light emitting elements to the recording medium.

15. The inkjet recording apparatus as defined in claim 10, wherein the activation light emitting elements are disposed so as to face to each other on the respective end faces in the second direction which face to each other.

* * * * *